US007955155B2

(12) United States Patent
Tremblay et al.

(10) Patent No.: US 7,955,155 B2
(45) Date of Patent: Jun. 7, 2011

(54) MAGNETIC AND ELECTRONIC TOY CONSTRUCTION SYSTEMS AND ELEMENTS

(75) Inventors: Daniel Tremblay, Quebec (CA); Andreanne Lavoie, Quebec (CA); Pascal Messier, Quebec (CA)

(73) Assignee: MEGA Brands International, Luxembourg, Zug Branch (CH)

( * ) Notice: Subject to any disclaimer, the term of this patent is extended or adjusted under 35 U.S.C. 154(b) by 442 days.

(21) Appl. No.: 12/169,159

(22) Filed: Jul. 8, 2008

(65) Prior Publication Data

US 2009/0015361 A1 Jan. 15, 2009

Related U.S. Application Data

(60) Provisional application No. 60/948,631, filed on Jul. 9, 2007, provisional application No. 60/951,071, filed on Jul. 20, 2007, provisional application No. 60/979,290, filed on Oct. 11, 2007, provisional application No. 61/029,241, filed on Feb. 15, 2008.

(51) Int. Cl.
*A63H 33/04* (2006.01)

(52) U.S. Cl. ..... 446/92; 446/85

(58) Field of Classification Search ..... 446/85, 446/92

See application file for complete search history.

(56) References Cited

U.S. PATENT DOCUMENTS

| | | | | |
|---|---|---|---|---|
| 744,718 | A | | 11/1903 | Cassidy |
| 1,236,234 | A | | 8/1917 | Troje |
| 1,535,035 | A | | 4/1925 | Philipp |
| 2,448,692 | A | | 9/1948 | Teetor |
| 2,795,893 | A | | 6/1957 | Vayo |
| 2,846,809 | A | | 8/1958 | Majewski |
| 2,872,754 | A | | 2/1959 | Cronberger |
| 2,939,246 | A | | 6/1960 | Glos, II |
| 2,949,697 | A | | 8/1960 | Licitis et al. |
| 2,970,388 | A | * | 2/1961 | Yonkers ..... 434/277 |
| 2,983,071 | A | | 5/1961 | Oliver |
| 3,077,696 | A | | 2/1963 | Barnett et al. |
| 3,095,668 | A | | 7/1963 | Dorsett |
| 3,184,882 | A | | 5/1965 | Vega |
| 3,196,579 | A | | 7/1965 | Lepper et al. |
| 3,254,440 | A | | 6/1966 | Duggar |
| 3,411,237 | A | | 11/1968 | Crosman |

(Continued)

FOREIGN PATENT DOCUMENTS

DE 33 23 489 A1 1/1984

(Continued)

OTHER PUBLICATIONS

German Office Action (dated Jun. 27, 2002).

(Continued)

*Primary Examiner* — Gene Kim
*Assistant Examiner* — Michael D Dennis
(74) *Attorney, Agent, or Firm* — Plumsea Law Group, LLC

(57) ABSTRACT

Magnetic and electronic toy construction systems and elements are provided that include an assembly of at least two panels that have at least two magnet holders located around the perimeter of the panel for embedding and positioning magnets therein. Magnets are disposed in each of the magnet holders such that all of the dipole axes of magnets in a single panel are coplanar and intersect to define a polygon. When attaching two adjacent panels, at least two ferromagnetic spheres are used such that the dipole axes of one magnet from each of the adjacent panels are collinear. In this manner, several panels configured in this way may be nested together to form great varieties of constructions.

20 Claims, 80 Drawing Sheets

U.S. PATENT DOCUMENTS

| | | | | |
|---|---|---|---|---|
| 3,453,773 | A | 7/1969 | Compton et al. | |
| 3,458,949 | A | 8/1969 | Young | |
| 3,466,795 | A | 9/1969 | Friedman | |
| 3,594,924 | A | 7/1971 | Baker | |
| 3,601,921 | A | 8/1971 | Strohmaier | |
| 3,606,333 | A | 9/1971 | Green | |
| 3,696,548 | A | 10/1972 | Teller | |
| 3,706,158 | A | 12/1972 | Jensen | |
| 3,775,901 | A | 12/1973 | Ellman et al. | |
| 3,798,833 | A | 3/1974 | Campbell | |
| 3,867,786 | A | 2/1975 | Greenblatt | |
| 3,906,658 | A | 9/1975 | Gross | |
| 3,979,855 | A | 9/1976 | Schmidt | |
| 3,998,003 | A | 12/1976 | Rosenbaum | |
| 3,998,004 | A | 12/1976 | Ehrlich | |
| 4,109,398 | A | 8/1978 | Hida | |
| 4,118,888 | A | 10/1978 | Ogawa | |
| D253,121 | S | 10/1979 | Hida | |
| 4,238,905 | A | 12/1980 | MacGraw, II | |
| D260,662 | S | 9/1981 | Hida | |
| D264,694 | S | 6/1982 | Takahashi | |
| 4,334,870 | A | 6/1982 | Roane | |
| 4,334,871 | A | 6/1982 | Roane | |
| 4,364,196 | A | 12/1982 | Shacket | |
| 4,650,424 | A | 3/1987 | Mitchell | |
| 4,722,712 | A | 2/1988 | McKenna | |
| 4,726,800 | A | 2/1988 | Kobayashi | |
| 4,741,534 | A | 5/1988 | Rogahn | |
| D301,161 | S | 5/1989 | Dunse | |
| 4,836,787 | A | 6/1989 | Boo | |
| 4,886,273 | A | 12/1989 | Unger | |
| 5,009,625 | A | 4/1991 | Longuet-Higgins | |
| 5,021,021 | A | 6/1991 | Ballard | |
| 5,028,053 | A | 7/1991 | Leopold | |
| 5,045,013 | A | 9/1991 | Fujitani | |
| 5,088,951 | A | 2/1992 | Majurinen | |
| 5,127,652 | A | 7/1992 | Unger | |
| 5,297,981 | A | 3/1994 | Maxim et al. | |
| 5,347,253 | A | 9/1994 | Ogikubo | |
| 5,409,236 | A | 4/1995 | Therrien | |
| 5,411,262 | A | 5/1995 | Smith | |
| 5,520,396 | A | 5/1996 | Therrien | |
| 5,643,038 | A | 7/1997 | Olsen | |
| 5,746,638 | A | 5/1998 | Shiraishi | |
| 5,785,529 | A | 7/1998 | Hearn et al. | |
| 5,826,872 | A | 10/1998 | Hall | |
| 5,833,465 | A | 11/1998 | Jarzewiak | |
| 5,848,926 | A | 12/1998 | Jardetzky | |
| 5,897,417 | A | 4/1999 | Grey | |
| 6,024,626 | A | 2/2000 | Mendelsohn | |
| 6,116,981 | A | 9/2000 | Zheng | |
| 6,158,740 | A | 12/2000 | Hall | |
| 6,241,249 | B1 | 6/2001 | Wang | |
| 6,256,914 | B1 | 7/2001 | Yeh | |
| 6,280,282 | B1 | 8/2001 | Puchalski | |
| 6,386,540 | B1 | 5/2002 | Stevkovski | |
| 6,431,936 | B1 | 8/2002 | Kiribuchi | |
| 6,491,563 | B1 | 12/2002 | Bailey | |
| 6,566,992 | B1 | 5/2003 | Vicentelli | |
| 6,626,727 | B2 | 9/2003 | Balanchi | |
| 6,846,216 | B1 * | 1/2005 | Balanchi | 446/85 |
| 6,963,261 | B2 | 11/2005 | Vicentelli | |
| 6,969,294 | B2 * | 11/2005 | Vicentelli | 446/92 |
| 7,140,944 | B2 | 11/2006 | Harris | |
| 7,641,534 | B2 * | 1/2010 | Holman | 446/85 |
| 2002/0115373 | A1 | 8/2002 | Lazerman | |
| 2002/0135125 | A1 | 9/2002 | Wu | |
| 2002/0167127 | A1 | 11/2002 | Fang | |
| 2003/0148699 | A1 | 8/2003 | Balanchi | |
| 2006/0205316 | A1 * | 9/2006 | Kretzschmar | 446/92 |

FOREIGN PATENT DOCUMENTS

| | | |
|---|---|---|
| DE | 39 10 304 | 10/1990 |
| FR | 2 153 792 | 5/1973 |
| GB | 2 123 306 | 2/1984 |
| JP | 40-32360 | 11/1940 |
| JP | 48-087510 | 7/1948 |
| JP | 54-48795 | 9/1952 |
| JP | 54-81770 | 11/1954 |
| JP | 57-13085 | 6/1955 |
| JP | 57-54170 | 9/1955 |
| JP | 57-116283 | 12/1955 |
| JP | 53-15945 | 2/1978 |
| JP | 57-45881 | 3/1982 |
| JP | 61-109600 | 7/1986 |
| JP | 62-78969 | 5/1987 |
| JP | 1-82082 | 6/1989 |
| JP | 2-23579 | 2/1990 |
| JP | 2-118600 | 9/1990 |
| JP | 2-264690 | 10/1990 |
| JP | 60-43397 | 3/1995 |
| JP | 3052774 | 7/1998 |
| JP | 3068102 | 2/2000 |
| WO | WO 99/60583 | 11/1999 |
| WO | WO 02/055168 | 7/2002 |

OTHER PUBLICATIONS

International Search Report (dated Apr. 14, 2003).
Magna-Tiles Instruction Booklet, date unknown.
International Search Report (dated Mar. 26, 2009).
Electro Mag (dated Jan. 15, 2009).
Electro Mag Series (undated).
Japanese Office Action and English Translation Thereof.
European Office Action mailed by the European Patent Office on May 12, 2010 in European Application No. 08788866.5-2318.

* cited by examiner

MAGNETIC AND ELECTRONIC TOY CONSTRUCTION SYSTEMS AND ELEMENTS

This application claims the benefit of U.S. Provisional Patent Applications Ser. Nos. 60/948,631, filed Jul. 9, 2007; 60/951,071 filed Jul. 20, 2007; 60/979,290, filed Oct. 11, 2007; and 61/029,241, filed Feb. 15, 2008, all of which are herein incorporated by reference in their entirety.

BACKGROUND

1. Field of the Invention

The present invention relates generally to magnetic construction kits and more particularly to magnetic construction elements that facilitate the convenient, rapid construction of stable, electrically conductive, large-scale constructions.

2. Background of the Invention

A major challenge in working with magnetic construction toy assemblies is the ability to build large, complex structures that maintain sufficient stability. Typically, magnetic construction sets include a variety of magnetic and ferromagnetic elements to enable users to design and build different structures. Basic sets include (1) rods having magnets at both ends, and (2) ferromagnetic balls or spheres to join the rods at different angles and without being restricted by the polarity of the magnets. More advanced sets also include panels that attach to the magnetic rods and ferromagnetic balls, either mechanically or with additional magnets disposed in the panels. These panels can be, for example, triangular, square, or rectangular in shape, and can add stability and an appealing appearance to constructions by closing the openings between the rods and spheres.

Although providing a variety of construction elements allows a user flexibility in building core components of a large structure, the many small parts can be difficult to handle and very time-consuming to construct. Thus, for example, in building a model of a skyscraper, a user may have to repetitively assemble many cubic, tetrahedron, or pyramidal sub-assemblies to join together and serve as the foundation of the structure. Each sub-assembly may require the manipulation and attachment of many elements. For example, one cube may require twelve magnetic rods, eight ferromagnetic balls, and six panels. Repetitive construction of common sub-assemblies (such as the tetrahedron, pyramid, or cube) can be monotonous for a person trying to build a stable large-scale structure. Moreover, the use of non-magnetic support panels complicates construction of the subassemblies because of the need to insert the panels into partially built sub-assemblies.

Also, larger scale rod components are seen to be advantageous because they allow assembly of larger constructions. However, known magnetic element construction kits typically require use of standard length rods. Thus, it is difficult to use rods of one scale together with rods of another scale.

Therefore, there remains a need for magnetic construction elements that can be assembled together conveniently and rapidly, and integrated with other construction elements and sub-assemblies to build stable, large-scale constructions. There also remains a need for such constructions to be visually interesting, engaging, and aesthetically appealing.

BRIEF SUMMARY OF THE INVENTION

Embodiments of the present invention provide magnetic construction elements that facilitate the convenient and rapid construction of stable, large-scale constructions.

One embodiment of the present invention provides an integral panel element that includes a panel portion and a plurality of magnet enclosing portions, each containing a magnet. Each of the magnets has a dipole axis (north pole to south pole axis). The panel portion of the panel element extends generally in an x-y plane and supports the magnets in a fixed relationship relative to one another. Preferably the magnets are supported by the panel portion such that the dipole axes of the plurality of magnets are coplanar and not aligned such that the dipole axis of each magnet intersects with the dipole axis of an adjacent magnet. The magnets are arranged such that the segments of the respective dipole axes between points of intersection with the axes of adjacent magnets define a simple polygonal geometric shape, such as an equilateral triangle, square, rhombus, regular pentagon, regular hexagon, and so on.

Importantly, only one edge magnet is provided in the panel element for each side of the polygonal shape defined by the geometric figure. Thus, for example, in a "triangular" panel element where the points of intersection with the axes of adjacent magnets define an equilateral triangle, the panel element includes only three magnets along the edges of the element (additional magnets could optionally be provided within the panel element). By virtue of this arrangement, the panel elements are adapted to interconnect or nest with one or more identical panel elements so that the axis of at least one magnet of the panel element is collinear with the axis of at least one magnet of the other panel element. When used in conjunction with a kit that includes spherical ferromagnetic balls, the nested panel element arrangement results in an extremely stable construction formed only with balls and panel elements, without the use of separate small magnetic rod pieces.

Various configurations of panel elements are possible. Though the panel portion may or may not be strictly polygonal, the panel element will have a generally polygonal construction corresponding to the number of magnets supported along its edge. Thus, the panel element can be shaped, for example, as a triangle (three edge magnets), square (four edge magnets), diamond or rhombus (four edge magnets), pentagon (five edge magnets), or hexagon (six edge magnets). The magnets preferably protrude from the edges of the panel portion and each magnet can be positioned with its dipole (north to south pole) axis generally parallel to the edge. A face of the magnet can be positioned adjacent to a corner of the panel shape. The alignment of the magnets with the edges of the panel portion can be modified so long as the relationship of the dipole axes is maintained and the configuration allows nesting with identical panel elements. In this regard, it is important that the magnet enclosing portion occupy no more than half (preferably, somewhat less) of the edge of the panel element. In this manner, two similarly sized and shaped panel elements can be nested together and joined to common ferromagnetic balls. The nested arrangement can also provide a hinge between two panels such that each panel can rotate with respect to the coaxial magnetic axes of two respective nested magnet enclosing portions. In addition, panels can include conductors attached to the magnets that extend along the edge of the panel, so that when two panels are nested, the conductors contact each other and form a continuous magnetic and/or electrical path between the magnets of the two panels.

Another embodiment of the present invention provides an improved larger scale rod assembly that is adapted for use with smaller scale magnetic construction kits. The improved rod assembly of the present invention comprises a "ball portion" and a plurality of rod portions, which are all integrally joined to each other so that the alignment of the rod portions and ball portion is fixed. For example, one implementation of a rod and ball element includes a ball integrally joined to two rods in between the two rods, with magnets disposed at the ends of the rods opposite the ball. The rods can be positioned collinearly and permanently affixed to the ball, to provide a basic long rod element. By dimensioning each rod portion to be the same length as a rod element and using a ball portion having the same dimension of the ferromagnetic balls in a smaller scale magnetic construction kit, the improved rod construction can be used in conjunction with components of the smaller scale kit, thus increasing play value.

Another embodiment of the present invention provides an element having an "H" shape. This H-shaped element can include two magnetic rod portions integrally joined by a center strut so that the alignment of the rod portions and the center strut relative to one another is fixed. The rod portions each have two ends with magnets at each end. Preferably, the rod portions and strut are coplanar and the north to south pole (dipole) axes of the magnets are generally perpendicular to the longitudinal axis of the strut. The H-shaped element can attach to four ferromagnetic balls to provide a stable foundation on which to build further elements, for example, building a pyramid having a square base.

Further embodiments of the present invention provide alternatively configured magnetic construction elements that add stability and aesthetically-pleasing appearances to large-scale magnetic constructions.

Further embodiments of the present invention provide electrically conducting magnetic construction elements and illuminated elements.

Further embodiments of the present invention provide mechanical movement, for example, hinges and wheels.

Further embodiments of the present invention provide a construction support on which construction assemblies can be built and can spin.

Further embodiments of the present invention provide a non-planar magnetic construction element that allows user to build onto constructions that appear closed.

DETAILED DESCRIPTION OF THE INVENTION

Figure 1A:
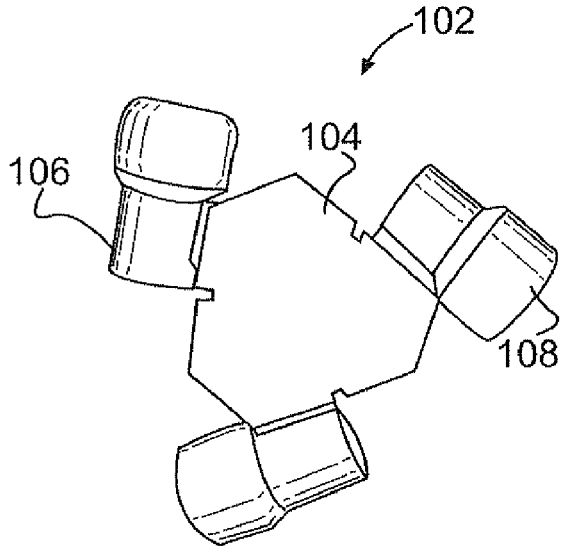
FIGS. 1A and 1B are schematic diagrams illustrating a plan view and a perspective view, respectively, of a triangular panel element according to an embodiment of the present invention.

An embodiment of the present invention provides a panel element extending generally in an x-y plane (although having some thickness in the z-direction). The panel element is an integral construction that includes a panel portion and a plurality of magnet containing portions all maintained in a fixed spatial relationship relative to one another. Each of the magnets has a dipole axis (north pole to south pole axis). The panel portion of the panel element extends generally in an x-y plane to support the magnets in a fixed relationship relative to one another. Preferably the magnets are supported by the panel portion such that the dipole axes of the plurality of magnets are coplanar and not aligned such that the axis of each magnet intersects with the axis of an adjacent magnet. The magnets are arranged such that the segments of the respective dipole axes between points of intersection with the axes of adjacent magnets define a simple polygonal geometric shape, such as an equilateral triangle, square, rhombus, regular pentagon, regular hexagon, and so on.

Importantly, only one edge magnet is provided in the panel element for each side of the polygonal figure defined by the geometric figure. Thus, for example, in a "triangular" panel element where the points of intersection with the axes of adjacent magnets define an equilateral triangle, the panel element includes only three edge magnets along the edges of the element (additional magnets could optionally be provided within the panel element). By virtue of this arrangement, the panel elements are adapted to interconnect or nest with one or more identical panel elements so that the dipole axis of at least one magnet of the panel element is collinear with the dipole axis of at least one magnet of the other panel element. When used in conjunction with a kit that includes spherical ferromagnetic balls, the nested panel element arrangement results in an extremely stable construction formed only with balls and panel elements, without the use of separate small magnetic rod pieces.

Various configurations of panel elements are possible. Though the panel portion may or may not be strictly polygonal, the panel element will have a generally polygonal construction corresponding to the number of magnets supported along its edge. Thus, the panel element can be shaped, for example, as a triangle (three edge magnets), square (four edge magnets), diamond or rhombus (four edge magnets), pentagon (five edge magnets), or hexagon (six edge magnets). The magnets preferably protrude from the edges of the panel portion and each magnet can be positioned with its dipole (north to south pole) axis generally parallel to an edge. A face of the magnet can be positioned adjacent to a corner of the panel shape. The alignment of the magnets with the edges of the panel portion can be modified but it is advantageous to maintain the relationship of the dipole axes described above and to maintain a configuration that allows nesting with identical panel elements. In this regard, it is important that the magnet enclosing portion occupy no more than half (preferably somewhat less) of the edge of the panel element. In this manner, two similarly sized and shaped panel elements can be nested together and joined to common ferromagnetic balls.

Though the specific panel configurations described herein are preferred for various reasons, including aesthetic value, minimization of material, structural performance and additional construction utility, the fixed orientation of the dipole magnets by itself provides significant play value when used in conjunction with other panels and ferromagnetic spheres. In this instance, the essential feature is the orientation of the magnets that is maintained by the nonmagnetic portions of the panels.

The magnets are preferably substantially cylindrical magnets that extend along an axis. Each panel includes three or more magnets, preferably of like size and shape (cylindrical). The panel is designed such that each magnet is secured in a non-magnetic material such that the orientation of the magnets relative to one another is substantially fixed. Preferably, the magnets are oriented such that the cylindrical axes of all of the magnets are substantially coplanar. Moreover, the axes of the magnets preferably intersect at points that define the vertices of a polygon. In a preferred embodiment, the polygon having vertices defined by the intersection points of the axes of the coplanar magnets has the same number of sides as the number of coplanar magnets. Thus, for example, if a panel piece has three coplanar magnets the polygon will have three sides and if the panel piece has four coplanar magnets, the polygon preferably has four sides. It is most preferable that the polygon be a regular polygon, e.g., equilateral triangle, square, etc.

Though not essential, it is preferable, for aesthetic and structural reasons, that the non-magnetic portion of the panel has a configuration that generally conforms to the shape of the polygon having vertices defined by the intersection points of the axes of the coplanar magnets. Thus, for example, a piece with three coplanar magnets would have a generally triangular shape, a piece with four coplanar magnets would have a rectangular (preferably square) shape, a piece with five sides would have a pentagon shape, and so on.

Though the pieces have a "generally" polygonal shape, an important aspect of the present invention is that that the magnets are secured at the outer peripheral of the polygonal shape in a way that allows adjacent pieces to be "nested" into one another so that pieces can be arranged such that the cylindrical axis of one magnet of one panel can be aligned so that it is substantially collinear with the cylindrical axis of one magnet of another panel of similar scale while at the same time held out of contact with the other panel. When pieces having this structure are used in conjunction with spherical ferromagnetic balls of appropriate scale, the adjacent panels are able to move in a unique hinge-like fashion even when there is no contact between the adjacent panel and no additional support that extends between the pins. This hinge-like motion is unique to the field of construction toys and contributes to the play value of construction toy sets that include this feature.

Figure 1B:
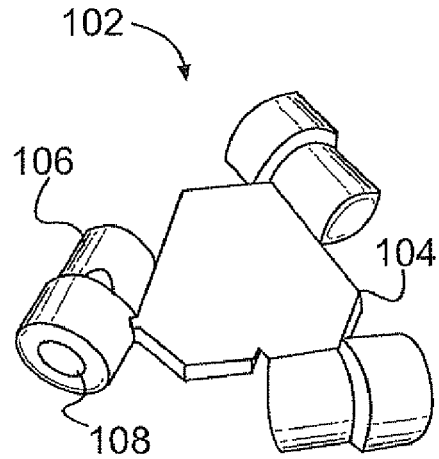
Figure 3A:
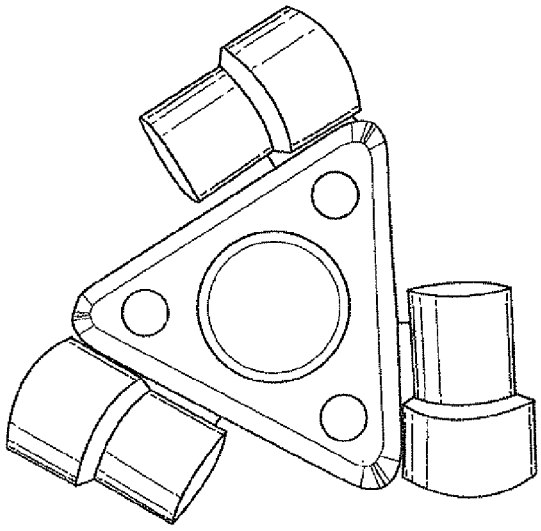
FIG. 3A is a schematic diagram illustrating a plan view of another exemplary triangular panel element, according to an alternative embodiment of the present invention.

As an example of this embodiment, FIGS. 1A and 1B illustrate an integrally constructed triangular panel element 102 having a center panel portion 104 and three magnets contained within magnet enclosing portions 106 permanently attached to the edges of the center panel 104, with each magnet enclosing portion occupying no more than half of the length of the edge. The magnet enclosing portions 106 each include one magnet 108 (e.g., a cylindrical magnet) having a face positioned adjacent to a corner of the triangular shape represented by the center panel 104 and its north to south pole axis positioned generally parallel to the edge. Although the triangular corners of the center panel 104 have been removed in the embodiment of FIGS. 1A and 1B, the corners could be maintained as shown in FIG. 3A. In any case, the dipole axes of the three magnets 108 extend along lines that define the edges of an equilateral triangle.

Figure 1C:
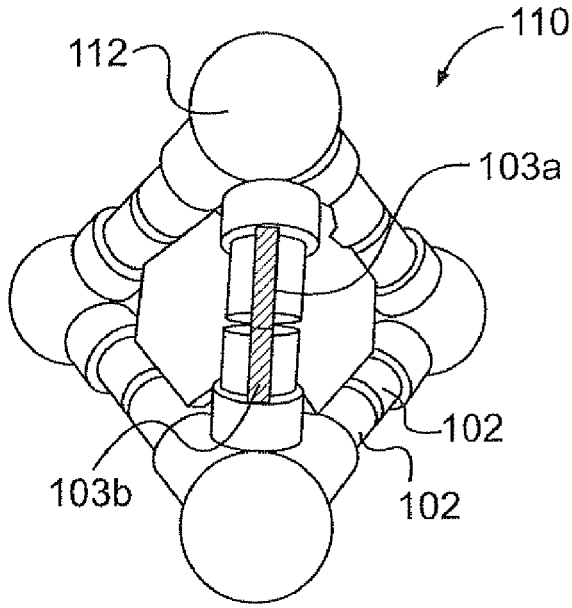
FIG. 1C is a schematic diagram of a nested assembly of the triangular panel element of FIGS. 1A and 1B, according to an embodiment of the present invention.
Figure 3B:
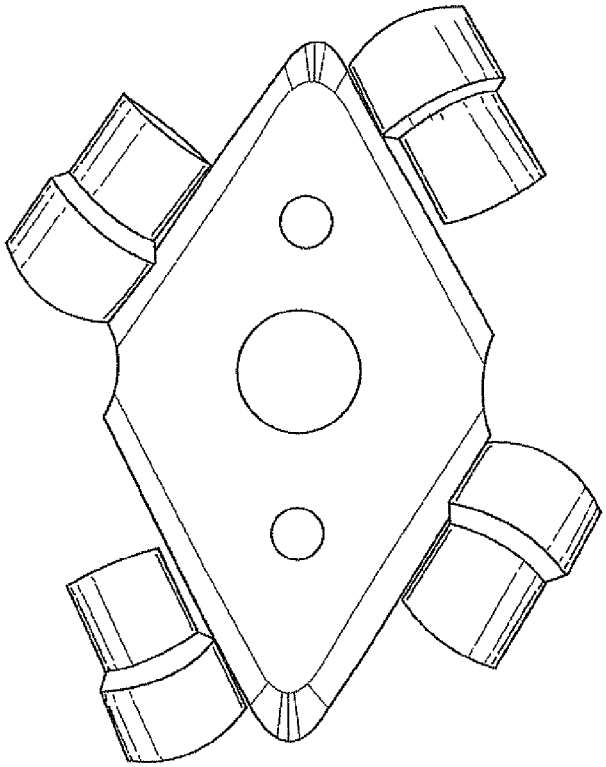
FIGS. 3B, 3C, and 3D are schematic diagrams illustrating a diamond (rhombus) panel element, a pentagonal panel element, and a square panel element, respectively, according to alternative embodiments of the present invention.
Figure 3C:
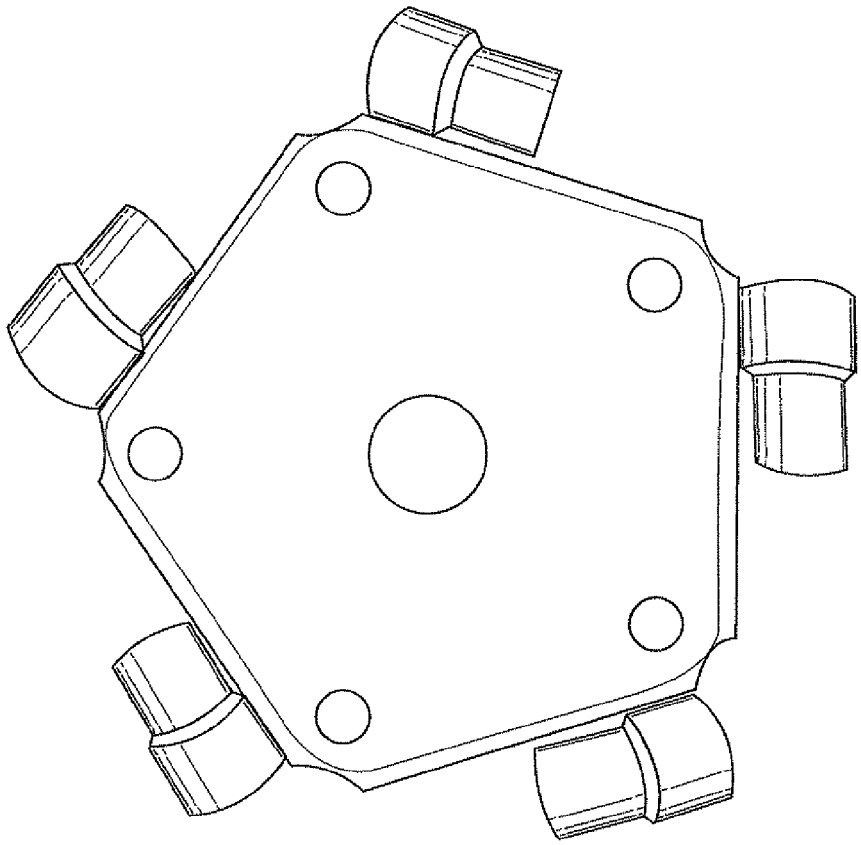
Figure 3D:
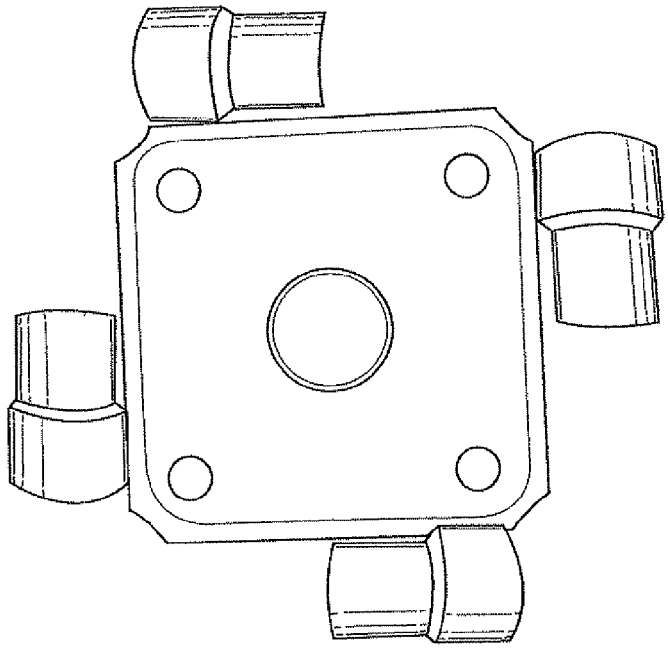

The orientation of the magnets 108 with respect to the center panel 104 enable panel 102 to be joined with other similarly constructed panels in a unique nested assembly, an example of which is shown in FIG. 1C. The assembly 110 includes three panel elements 102 nested with each other and joined by four ferromagnetic balls 112 to form a substantially tetrahedron structure. The nesting between the panel elements 102 provides a magnetic, mechanical, and frictional fit (for example, between the non-magnet ends of the magnet enclosing portions 106) between the panel elements 102 and the ferromagnetic balls 112 to provide improved stability. Similar polyhedron structures could be built from square panel elements (e.g., see FIG. 3D), rectangular panel elements, diamond panel elements (e.g., see FIG. 3B), and pentagonal panel elements (e.g., see FIG. 3C).

In a further embodiment, panel 102 can include an electrical and/or magnetic conductor within each magnet enclosing portion 106, in contact with the magnet 108 and extending to the end of the magnet enclosing portion 106 opposite the magnet 108. In this manner, when multiple panels 102 are nested with each other as shown, for example, in FIG. 1C, the conductors contact each other to provide a complete electrical and/or magnetic circuit throughout the assembly. An example of two internal conductors contacting each other (and their respective magnets) is represented in FIG. 1C by the blocks 103*a* and 103*b*. An electrical and magnetic conductor could comprise a steel plug, for example. Such conductors enable stronger magnetic connections. For example, the ferromagnetic balls can attach to two magnets having opposite polarities, which creates a north and south pole in the ball. Repeating this connection ensures that the polarities are in series through the conductors and throughout an assembly, which minimizes dispersion of the magnetism and creates a magnetic circuit that maximizes magnetic attraction between the components. In addition to enabling stronger magnetic constructions, the conductors can also provide electrically conductive magnetic constructions, which are described in more detail below.

In addition to nesting the panel elements to form polyhedron structures, panel elements can be sandwiched with each other with their faces contacting each other. For example, referring again to FIGS. 1A and 1B, two triangular panel elements 102 can be sandwiched together with the faces of the center panels 104 contacting each other, and with the panel elements 102 offset radially from each other so that the half rods 106 alternate between each other to form a triangular panel capable of magnetically coupling to a ferromagnetic ball at each of its three corners.

Figure 2A:
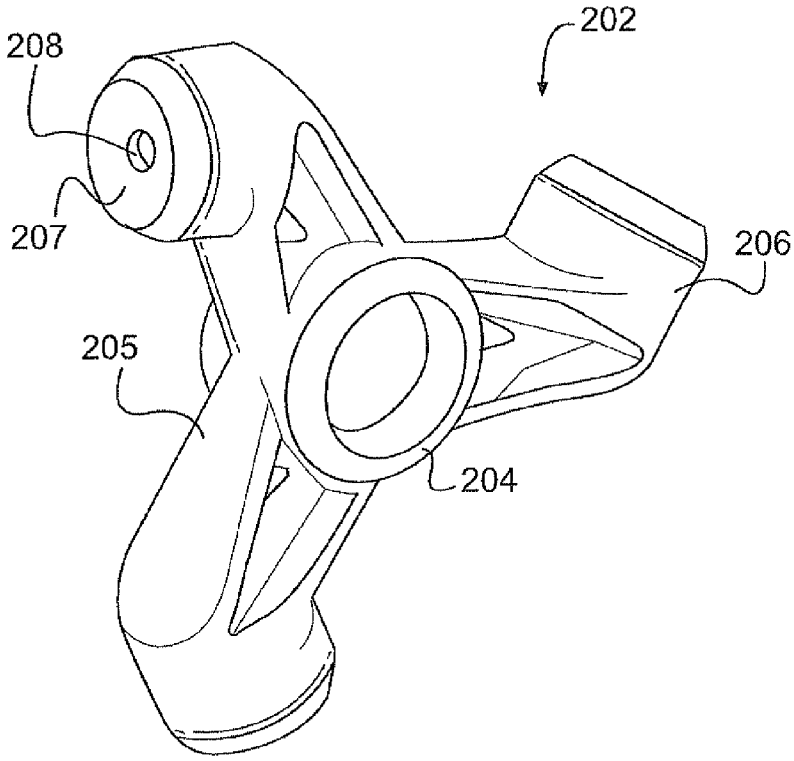
FIGS. 2A and 2B are schematic diagrams illustrating a perspective view and a plan view, respectively, of another triangular panel element according to an alternative embodiment of the present invention.
Figure 2B:
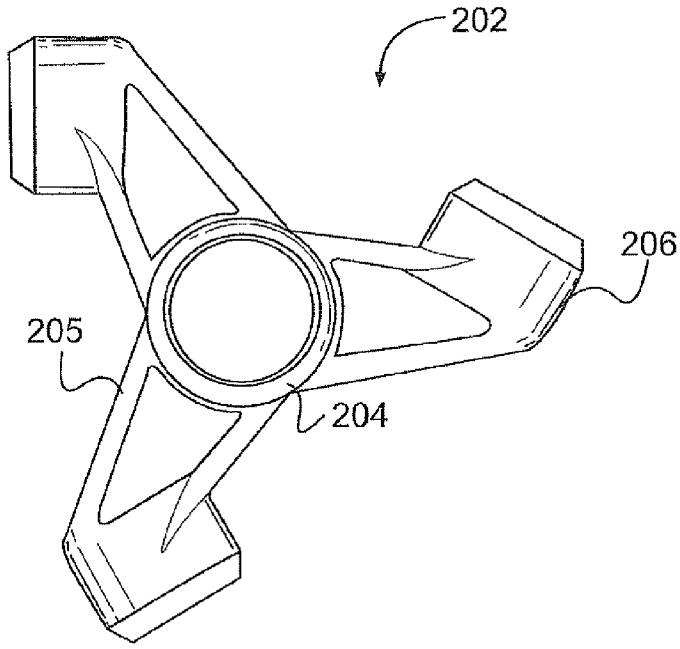

FIGS. 2A and 2B illustrate another triangular panel element 202 according to an alternative embodiment of the present invention. In this example, triangular panel element 202 includes a center body 204 from which three arms 205 extend. Magnets 208 are disposed at the distal ends of the arms 205, with the north to south pole axes of the magnets 208 oriented similarly to the magnets 108 of panel element 102 of FIGS. 1A and 1B, i.e., extending along lines that define edges of an equilateral triangle. As with the magnet enclosing portions 106 of panel element 102, the magnet housings 206 of panel element 202 occupy no more than half of an edge of the equilateral triangle. Panel element 202 can be an integrally molded part, for example, by placing the magnets in a mold and insert molding around them. Alternatively, the center body 204, arms 205, and housings 206 can be integrally molded with magnet recesses formed in the housings 206, and in a post-molding process, the magnets can be glued or welded in place in the recesses, perhaps with a cover glued or welded in place and secured over them. As shown in FIG. 2A, the insert molded or glued cover can be concave and include an opening 207 exposing a face of the magnet, to allow a positive secure contact between the magnet and a ferromagnetic ball. This contact enables the completion of magnetic and electrical circuits. The center body 204 and arms 205 can also include recesses or openings that reduce the amount of material used in the element 202, to reduce the weight and cost of the part, and that also can provide additional mechanical couplings discussed in more detail below.

Figure 2C:
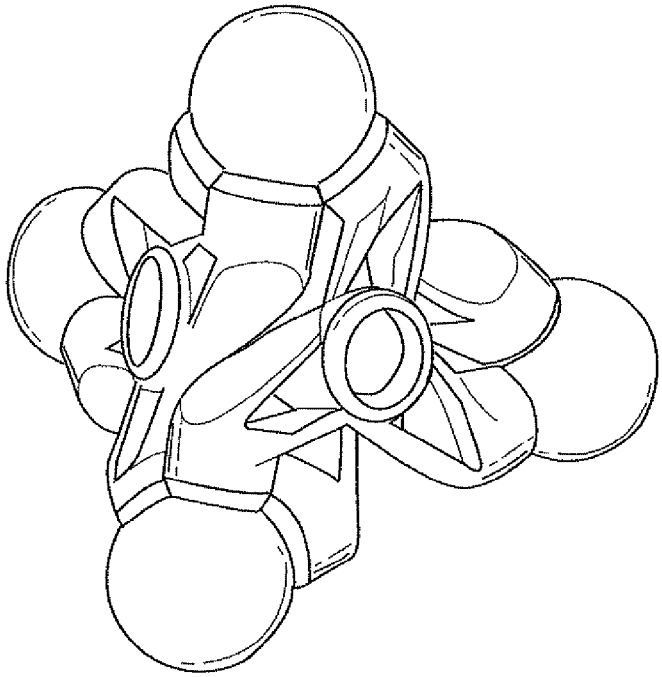
FIG. 2C is a schematic diagram of a nested assembly of the triangular panel element of FIGS. 2A and 2B, according to an embodiment of the present invention.
Figure 2D:
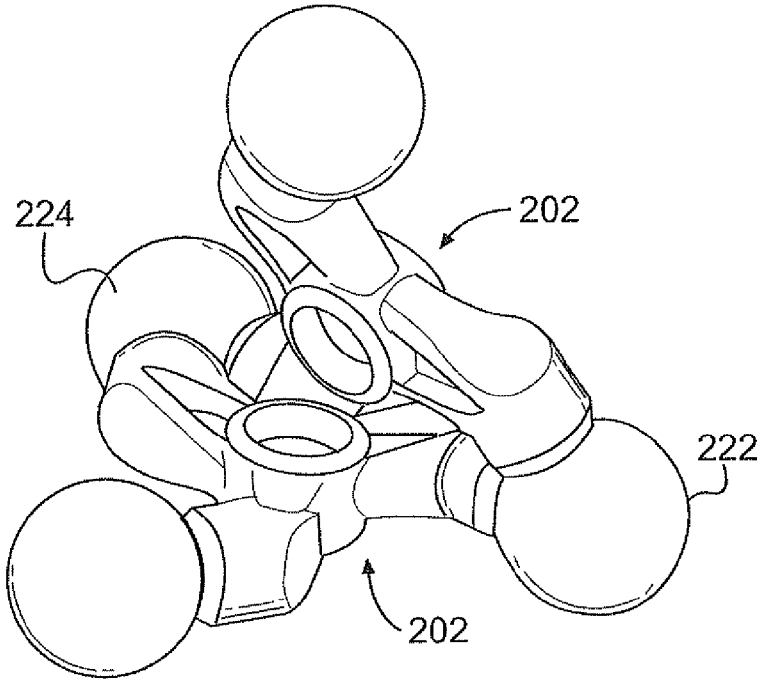
FIG. 2D is a schematic diagram illustrating the nested assembly and hinge movement of the triangular panel element of FIGS. 2A and 2B, according to an embodiment of the present invention.

The orientation and position of the magnets in panel element 202 enables nested assemblies similar to those described above. FIG. 2C illustrates a nested assembly of four panel elements 202 and four ferromagnetic balls, forming a tetrahedron structure. For additional clarity, FIG. 2D illustrates two panel elements 202 nested and magnetically coupled, before the addition of third and fourth panel elements 202 to form the tetrahedron structure of FIG. 2C. With the four panel elements 202 nested and magnetically coupled via the four ferromagnetic balls, the resulting tetrahedron structure is rigid and strong, and can serve as a core component of a stable large-scale magnetic construction. In addition, the two panel element structure of FIG. 2D can provide useful and interesting mechanical movement, in effect acting as a hinge. For example, each panel element 202 in FIG. 2D can pivot with respect to a line joining the centers of ferromagnetic balls 222 and 224. Similar hinge-like constructions could be formed with panels of other shapes, such as square, rectangular, diamond (rhombus), and pentagonal.

FIGS. 2E-2I illustrate a skeletal triangular panel element 252, according to an alternative embodiment of the present invention. In this example, panel element 252 includes a center body 254 from which three pairs of arms 255 extend. Magnets 258 are disposed at the distal ends of the arms 255, with the north to south pole axes of the magnets 258 oriented similarly to the magnets 108 of panel element 102 of FIGS. 1A and 1B, i.e., extending along lines that define edges of an equilateral triangle. As with the magnet enclosing portions 106 of panel element 102, the magnet housings 256 of panel element 252 occupy no more than half of an edge of the equilateral triangle. Panel element 252 can be a molded part, either integrally or in portions that are glued or welded together (as described above with reference to panel element 202). As shown best in FIGS. 2G and 2H, the magnet housings 256 can be concave and include an opening 257 exposing a face of the magnet 258, to allow a positive secure contact between the magnet and a ferromagnetic ball. This contact enables the completion of magnetic and electrical circuits.

Figure 2E:
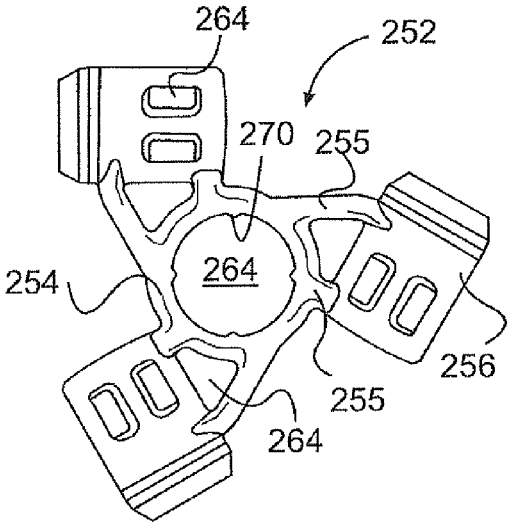
FIG. 2E is a schematic diagram illustrating a bottom plan view of a skeletal triangular panel element, according to an alternative embodiment of the present invention.
Figure 2F:
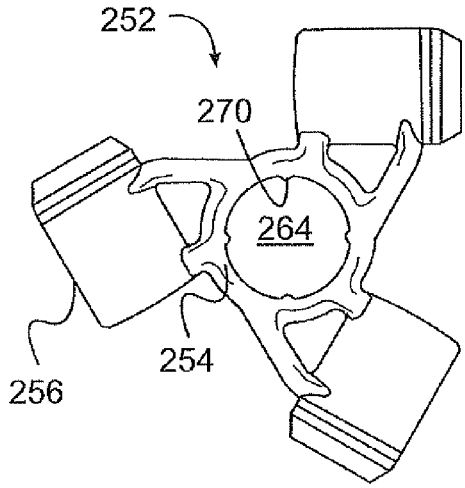
FIG. 2F is a schematic diagram illustrating a top plan view of the skeletal triangular panel element of FIG. 2E.
Figure 2G:
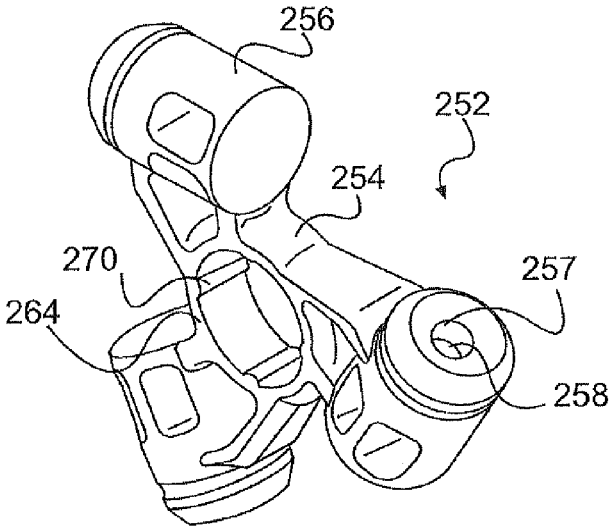
FIG. 2G is a schematic diagram illustrating a bottom perspective view of the skeletal triangular panel element of FIG. 2E.
Figure 2H:
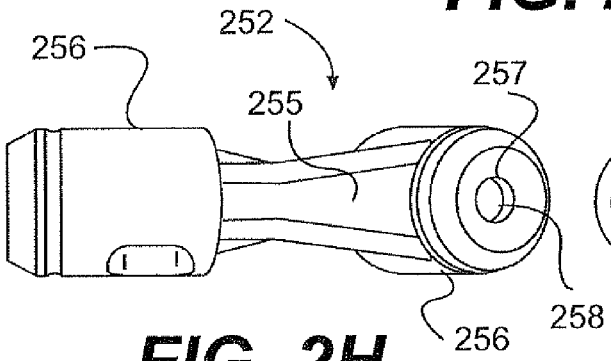
FIG. 2H is a schematic diagram illustrating a side view of the skeletal triangular panel element of FIG. 2E, facing in a direction perpendicular to the axis of a magnet of the element.
Figure 2I:
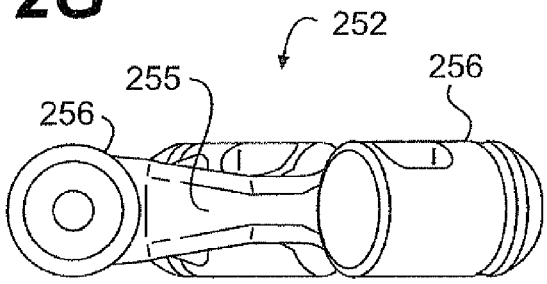
FIG. 2I is a schematic diagram illustrating another side view of the skeletal triangular panel element of FIG. 2E, facing in a direction coaxial with an axis of a magnet of the element.

As shown in FIGS. 2E-2G, center body 254, arms 255, and magnet housings 256 can define recesses or openings 264 that reduce the amount of material used in the element 252, to reduce the weight and cost of the part, while still providing requisite structural support. In addition, in this particular implementation, as shown best in FIGS. 2H and 2I, arms 255 can increase in thickness from the center body 254 to the magnet housings 256 to minimize the amount of material used in the panel element 252 while still providing the rigidity and strength necessary for the panel element 252 to comply with typical consumer safety standards. The recesses and openings can also provide additional mechanical couplings discussed in more detail below.

Similar to the skeletal triangular panel element 252 of FIGS. 2E-2I, FIGS. 3E-3I illustrate a skeletal square panel element 352, according to another alternative embodiment of the present invention. In this example, panel element 352 includes a enter body 354 from which four arms 355*a* extend. Magnets 358 are disposed at the distal ends of the arms 355*a*, with the north to south pole axes of the magnets 358 oriented similarly to the magnets of the panel element of FIG. 3D, i.e., extending along lines that define edges of a square. As with the magnet enclosing portions of the panel element of FIG. 3D, the magnet housings 356 of panel element 352 occupy no more than half of an edge of the square. Panel element 352 also includes perimeter members 355*b*, each of which extend between an arm 355*a* and a magnet housing 356 adjacent to the magnet housing 356 to which the arm 355*a* is connected. Together, perimeter members 355*b* approximate a square shape, as shown best in FIGS. 3E and 3F, and provide panel element 352 with further structural strength and rigidity. Panel element 352 can be a molded part, either integrally or in portions that are glued or welded together (as described above with reference to panel element 202). As shown best in FIGS. 3G and 3H, the magnet housings 356 can be concave and include an opening 357 exposing a face of the magnet 358, to allow a positive secure contact between the magnet and a ferromagnetic ball. This contact enables the completion of magnetic and electrical circuits.

Figure 3E:
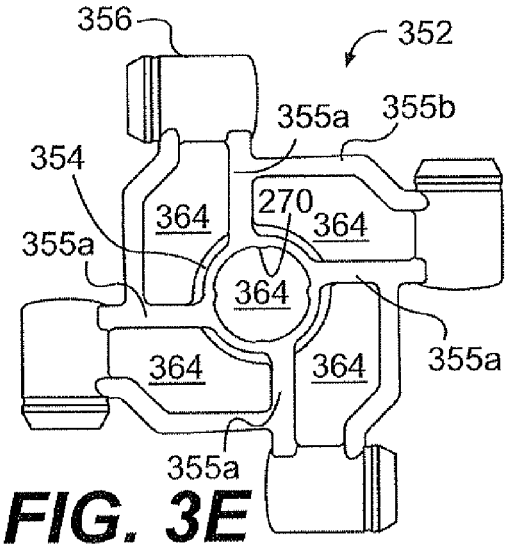
FIG. 3E is a schematic diagram illustrating a top plan view of a skeletal square panel element, according to an alternative embodiment of the present invention.
Figure 3F:
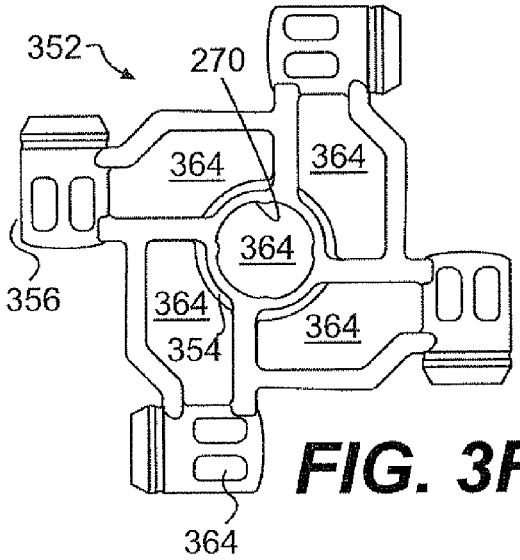
FIG. 3F is a schematic diagram illustrating a bottom plan view of the skeletal square panel element of FIG. 3E.
Figure 3G:
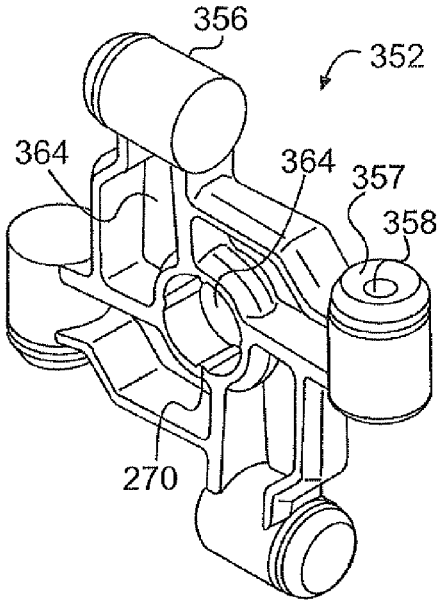
FIG. 3G is a schematic diagram illustrating a top perspective view of the skeletal square panel element of FIG. 3E.
Figure 3H:
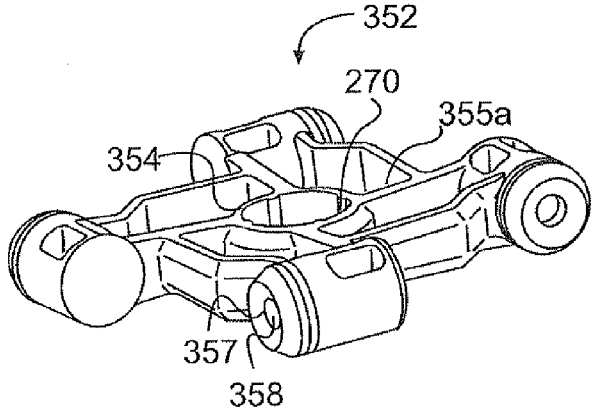
FIG. 3H is a schematic diagram illustrating a bottom perspective view of the skeletal square panel element of FIG. 3E.
Figure 3I:
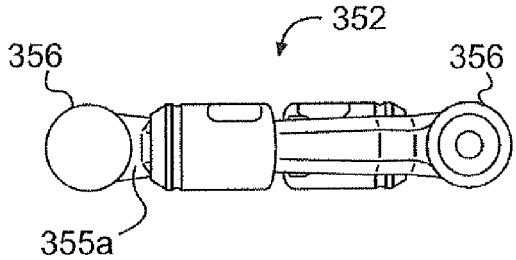
FIG. 3I is a schematic diagram illustrating a side view of the skeletal square panel element of FIG. 3E, facing in a direction coaxial with the axes of two magnets of the element and perpendicular to the axes of the other two magnets.

As shown in FIGS. 3E-3G, center body 354, arms 355*a*, perimeter members 355*b*, and magnet housings 356 can define recesses or openings 364 that reduce the amount of material used in the element 352, to reduce the weight and cost of the part, while still providing requisite structural support. In addition, in this particular implementation, as shown best in FIG. 3I (a side view of the edge of panel element 352, of which the remaining three edge views are mirrors), arms 355*a* can increase in thickness from the center body 354 to the magnet housings 356 to minimize the amount of material used in the panel element 352 while still providing the rigidity and strength necessary for the panel element 352 to comply with typical consumer safety standards. The recesses and openings can also provide additional mechanical couplings discussed in more detail below.

Figure 3J:
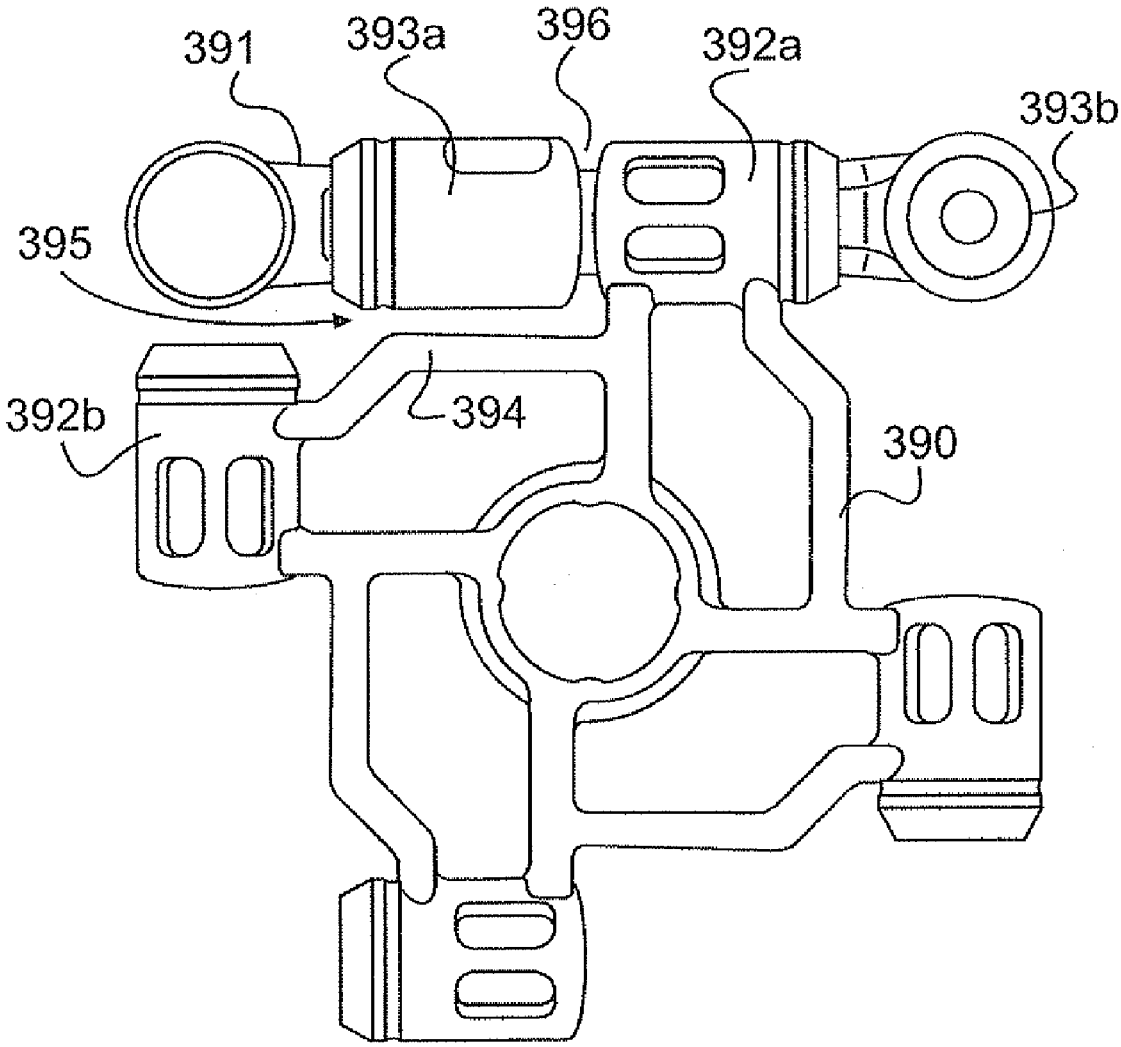
FIG. 3J is a schematic diagram illustrating two nest square panel elements, according to an embodiment of the present invention.
Figure 3K:
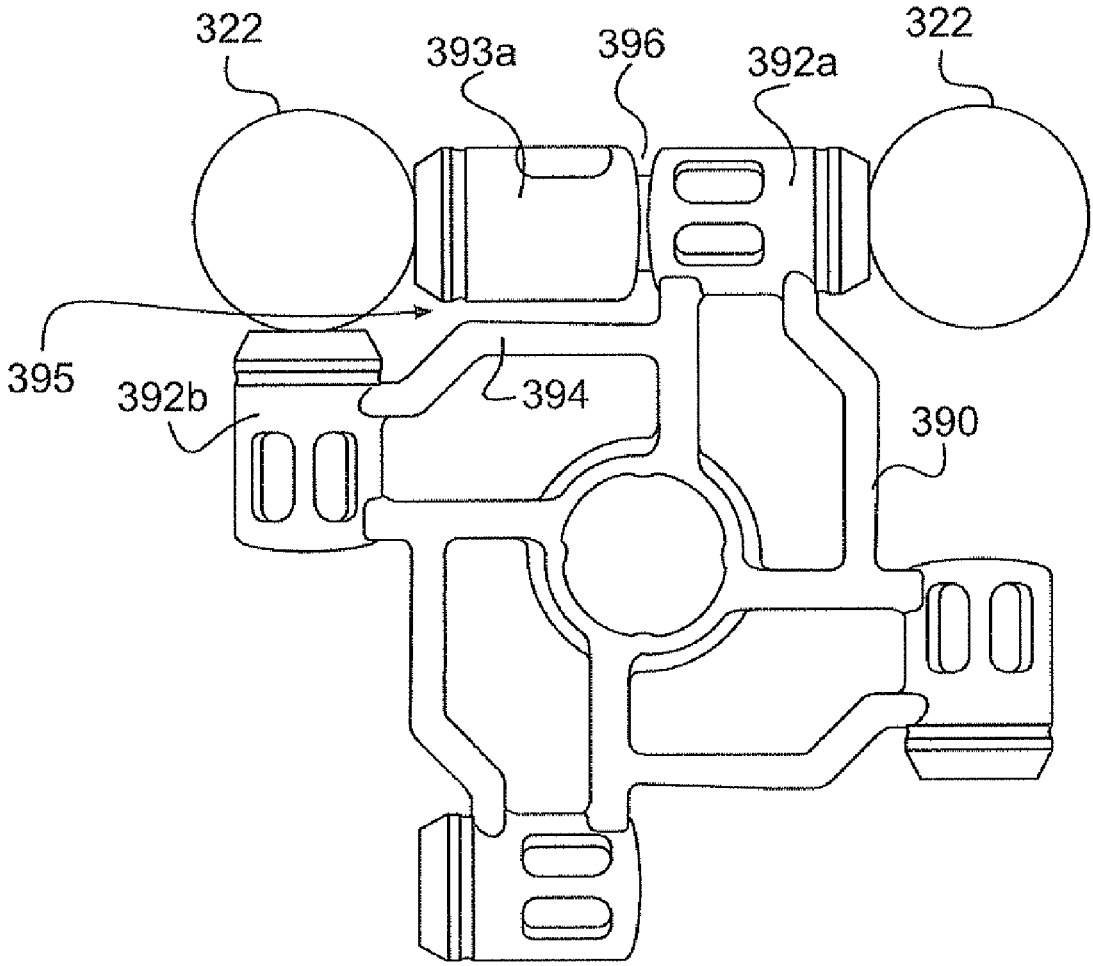
FIG. 3K is a schematic diagram illustrating two nest square panel elements with ferromagnetic spheres, according to an embodiment of the present invention.

In a further aspect of the present invention, panel elements such as elements 252 and 352, can be nested and overlapped with each other in three-dimensional constructions that, together with ferromagnetic balls, provide hinge-like connections, stronger vertical support to horizontally aligned members, and "give" that enables the structure to accommodate varying loads. FIG. 3J illustrates an example of this aspect of the present invention using two nested square panels 390 and 391. As shown, panels 390 and 391 can be positioned at an angle to each other (e.g., perpendicular to each other), with the magnet housing 392*a* of panel 390 nested with the magnet housing 393*a* of panel 391. In this configuration, magnet housing 392*a* is coaxial with the magnet housing 393*a*. A ferromagnetic ball can then be magnetically coupled to the outwardly facing side of each of magnet housings 392*a* and 393*a* (with the axes of the magnet housings generally aligned with the center of the balls), and to the other two magnetic housings 392*b* and 393*b*, which are orthogonal to magnet housings 392*a* and 393*a*, respectively, as shown in FIG. 3K. With this assembly, panels 390 and 391 can pivot with respect to each other generally around the coaxial axes of magnet housings 392*a* and 393*a*. The hinge feature provided by the nested magnet housings enables a unique reversible three-dimensional structure. For example, referring to FIG. 3K, to form a cube structure, four additional square panel elements could be magnetically coupled to the two panel elements shown in the figure, nested in a similar manner, with eight ferromagnetic balls at the corners of the cube. By virtue of the hinge connections, the cube could be opened by unfolding each panel until all panels lay flat in a single plane with the ferromagnetic balls still attached. The panels could then be folded toward the opposite side of the single plane to reverse the cube, such that the opposite sides of the panels face outward. In this manner, the three-dimensional structure could be reversed to display different images on the opposing sides of the panel elements. Thus, for example, the structure could show first colors, indicia, or images in a first configuration, and could be reversed to show different second colors, indicia, or images in a second reversed configuration. This reversible aspect could be incorporated into games or educational constructions that challenge a user to build three-dimensional structures having a first appearance that transforms to a second appearance when the structure is reversed.

As shown in the example of FIG. 3J, nested panel elements can also provide further structural support and "give" to a three-dimensional construction, such as a cube. The added structural support and give is made possible by the overlap between coaxial magnet housings and the overlap between the magnet housing of one panel and the body of an adjacent panel. For example, as shown in FIG. 3J, magnet housings 392*a* and 393*a* can contact each other to limit relative movement between panel elements 390 and 391 and opposing directions generally along the axes of magnet housings 392*a* and 393*a*. As another example, magnet housing 393*a* is disposed over the perimeter member 394 of panel element 390. In this manner, perimeter member 394 can limit the movement of magnet housing 393*a* in a direction toward perimeter member 394. For example, if a force were applied to panel element 391 in a direction generally toward perimeter member 394, movement of panel element 391 would be limited by perimeter member 394, and the magnet housing 393*a* could essentially rest on top of perimeter member 394. In a completed cube construction, panel element 391 could likewise also rest on the perimeter members of the other three side panel elements, providing a sturdy construction. In this configuration, further structural support could be provided as pairs of nested magnet housings contact each other and limit relative movement between the panel elements.

In providing this additional strength, the construction also provides "give," due to the initial positioning of the panel elements with respect to each other and to the ferromagnetic balls, and the gaps between the panel elements that exist in the initial positioning. FIG. 3J illustrates exemplary gaps 395 and 396 (before any loading) that are provided when the panel elements 390 and 391 are joined by ferromagnetic balls (not shown). Then, for example, when a load is applied to panel element 391 in a direction generally toward perimeter member 394, the magnet housing 393*a* slides down the ferromagnetic ball, resisting the applied force by virtue of the magnetic bond. As the force overcomes the magnetic bond, the magnet housing 393*a* continues to slide and the gap 395 narrows until the magnet housing 393*a* contacts the perimeter member 394 as described above. At the same time, and in a similar manner, magnet housing 393*b* resists the applied force by virtue of its magnetic bond to the other ferromagnetic ball (not shown). In a three-dimensional structure, this "give" and added structural support could be provided simultaneously at several connections. For example, in a completed cube, a force applied generally perpendicular to the top horizontal panel element could cause that top panel to "give" toward the four underlying vertical panel elements.

Panel elements having magnets positioned with their axes along an edge of a polygon enable the convenient, rapid construction of stable core assemblies (using ferromagnetic balls) for large-scale constructions. The panel elements and core assemblies stiffen the overall structure and resist shearing and torsional stresses to maintain their shape. The center portions or bodies of the panel elements can also act as a surface for supporting a weight and can provide an aesthetically pleasing closed wall structure representative of actual architecture. In addition, core sub-assemblies of the magnetic constructions can be built with fewer parts in comparison to traditional construction sets consisting of only magnetic rods and ferromagnetic balls.

Figure 3L:
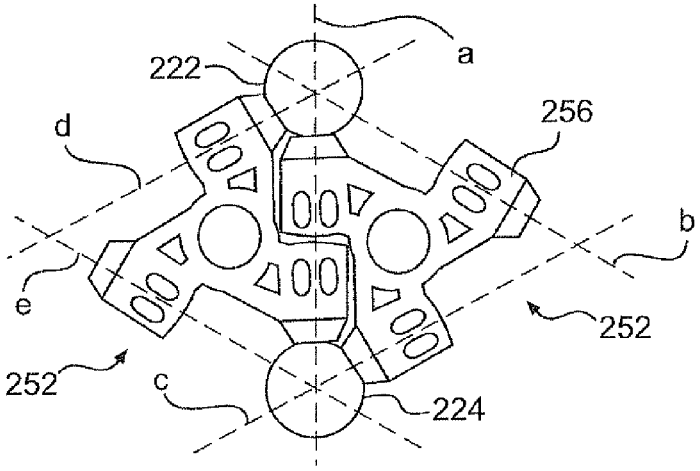
FIG. 3L is a schematic diagram illustrating a plan view of a hinge-like construction that includes two triangular panels and two spheres, according to an embodiment of the present invention.
Figure 3M:
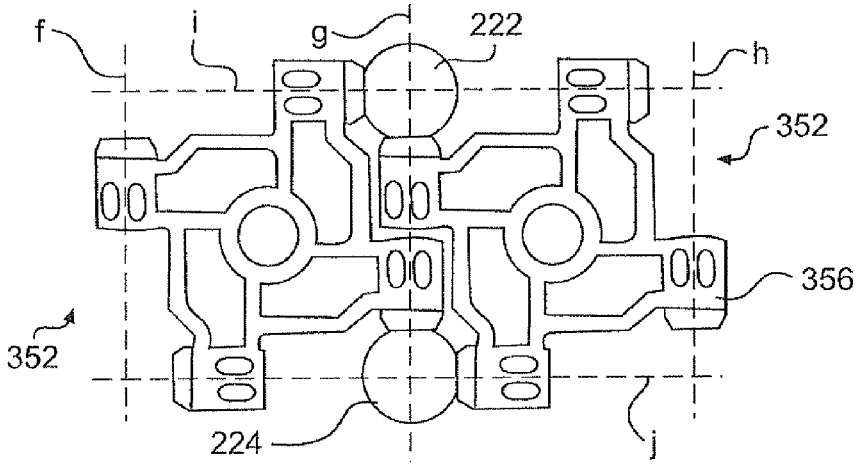
FIG. 3M is a schematic diagram illustrating a plan view of a hinge-like construction that includes two square panels and two spheres, according to an embodiment of the present invention.
Figure 3N:
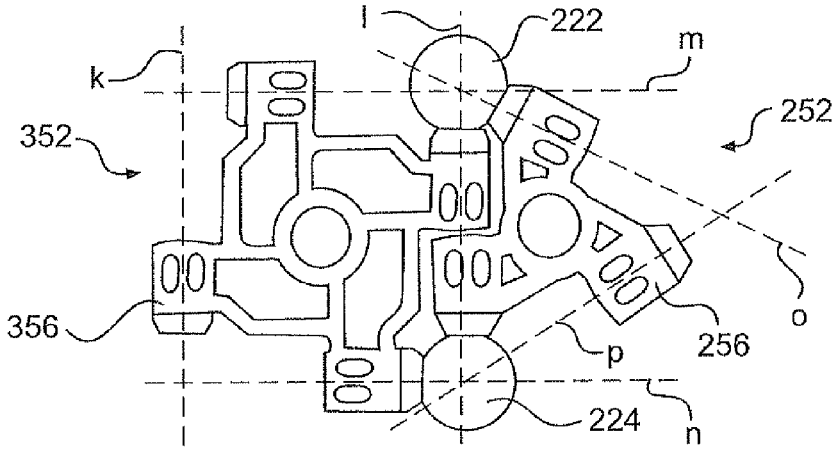
FIG. 3N is a schematic diagram illustrating a plan view of a hinge-like construction that includes a triangular panel and a square panel and two spheres, according to an embodiment of the present invention.

A preferred construction that provides the above-mentioned hinge-like movement is illustrated in FIGS. 3L-3N, in which "triangular" and "square" panels together with two spheres provide a hinge-like construction. As can be appreciated from the drawings, the terms "triangular" and "square" are not meant literally in this context since the panels are not, strictly speaking, "triangular" or "square" panels. The terminology, in this context, refers to the general appearance of the panels.

In FIG. 3L, which shows a hinge-like construction that includes two triangular panels 252 and two spheres 222, 224, an outer portion 256 of each panel 252 holds the magnets such that cylindrical axes of all of the magnets on that panel are substantially coplanar (e.g., axes a, b, and c on the right-hand panel 252 and axes a, d, and e on the left-hand panel 252). Moreover, the axes of the magnets preferably intersect at points that define the vertices of an equilateral triangle. When the two triangular pieces 252 are placed in magnetic contact with two spheres 222, 224 and nested so that two magnets, one magnet from each panel, are axially aligned (e.g., along axis a in FIG. 3L), another magnet from each panel is brought into contact with the ferromagnetic spheres as shown. Thus each sphere 222, 224 is contacted by two magnets, one from each panel 252. The two magnets are coaxially aligned and are aligned with the centers of the spheres 222, 224. In this instance, because the panels have like shapes, the two magnets that are not in coaxial alignment are parallel to one another (e.g., the axes d and c of the non-aligned sphere-contacting magnets in FIG. 3L are parallel), but this is not essential as can be seen with reference to FIG. 3N. In this instance (FIG. 3L), the two magnets of one panel that are not in coaxial alignment each contact a sphere (ball) at an angle of about 60 degrees relative to the other magnet contacting that sphere (e.g., the angle between axis b and axis a), which provides lateral stability to the hinge-like assembly. When configured as shown, the panels may pivot relative to one another in a hinge-like fashion through a range of motion that is limited principally by the contact of one panel body with the other panel body. In the preferred embodiment, the range of pivoting motion substantially exceeds 180 degrees and approaches 270 degrees. This easily created stable construction having a range of hinge motion substantially greater than 180 degrees provides improved play value in construction sets.

In FIG. 3M, which shows a hinge-like construction that includes two square panels 352 and two spheres 222, 224, an outer portion of each panel 352 holds the magnets such that cylindrical axes of all of the magnets on that panel are substantially coplanar (e.g., axes g, h, i, and j of the right-hand panel 352 and axes f, g, i, and j of the left-hand panel 352). Moreover, the axes of the magnets preferably intersect at points that define the vertices of a square. When the two square pieces 352 are placed in magnetic contact with two spheres 222, 224 and nested so that two magnets, one magnet from each panel 352, are axially aligned (e.g., along axis g in FIG. 3M), another magnet from each panel is brought into contact with the ferromagnetic spheres 222, 224, as shown. Thus each sphere 222, 224 is contacted by two magnets, one from each panel 352. The two magnets are coaxially aligned and are aligned with the centers of the spheres 222, 224. In this instance, because the panels have like shapes, the two magnets that are not in coaxial alignment are parallel to one another (e.g., axes i and j of the non-aligned sphere-contacting magnets are parallel in FIG. 3M), but this is not essential as can be seen with reference to FIG. 3N. In this instance (FIG. 3M), the two magnets that are not in coaxial alignment each contact a sphere at an angle of about 90 degrees relative to the other magnet contacting its respective sphere (e.g., axes g and j of the right-hand panel are perpendicular, and axes g and i of the left-hand panel are perpendicular), which provides lateral stability to the hinge-like assembly. When configured as shown, the panels 352 may pivot relative to one another in a hinge-like fashion through a range of motion that is limited principally by the contact of one panel body with the other panel body. In the preferred embodiment, the range of pivoting motion substantially exceeds 180 degrees and approaches 270 degrees. This easily created stable construction having a range of hinge motion substantially greater than 180 degrees provides improved play value in construction sets.

FIG. 3N, which shows a hinge-like construction that includes a triangular panel 252 and a square panel 352 and two spheres 222, 224, an outer portion of each panel holds the magnets such that cylindrical axes of all of the magnets on that panel are substantially coplanar (e.g., axes l, o, and p of the right-hand triangular panel 252, and axes k, l, m, and n of the left-hand square panel 352). Moreover, the axes of the magnets preferably intersect at points that define the vertices of a regular polygon (one a square and one a triangle). When the triangle 252 and square pieces 352 are placed in magnetic contact with two spheres 222, 224 and nested so that two magnets, one magnet from each panel, are axially aligned (e.g., along axis l in FIG. 3N), another magnet from each panel is brought into contact with the ferromagnetic spheres as shown. Thus, each sphere 222, 224 is contacted by two magnets, one from each panel. The two magnets are coaxially aligned and are aligned with the centers of spheres 222, 224. In this instance (FIG. 3N), because the panels have different shapes, the two magnets that are not in coaxial alignment are not parallel to one another (e.g., axes n and o of non-aligned sphere-contacting magnets are not parallel). In this instance, one of the two magnets of the same panel that are not in coaxial alignment contact the sphere at an angle of about 90 degrees relative to other magnet contacting that sphere (e.g., axes l and n of left-hand panel 352 are 90 degrees apart) and the other of the two magnets that are not in coaxial alignment contacts its sphere at an angle of about 60 degrees relative to other magnet contacting that sphere (e.g., axes l and o of right-hand panel 252 are about 60 degrees apart). This arrangement provides lateral stability to the hinge-like assembly. When configured as shown, the panels 252, 352 may pivot relative to one another in a hinge-like fashion through a range of motion that is limited principally by the contact of one panel body with the other panel body. In the preferred embodiment, the range of pivoting motion substantially exceeds 180 degrees and approaches 270 degrees. This easily created stable construction having a range of hinge motion substantially greater than 180 degrees provides improved play value in construction sets.

FIGS. 4A-5G illustrate an improved large-scale rod construction according to an embodiment of the present invention. The improved larger scale rod assembly is designed to allow its use with smaller scale magnetic construction kits. The rod comprises a "ball portion" and a plurality of rod portions, which are all integrally joined to each other so that the alignment of the rod portions and ball portion is fixed. These large-scale rods facilitate convenient, rapid, and stable assembly of large-scale magnetic constructions, yet are still compatible with smaller-scale magnetic components (such as traditional magnetic rods of a shorter length).

Figure 4A:
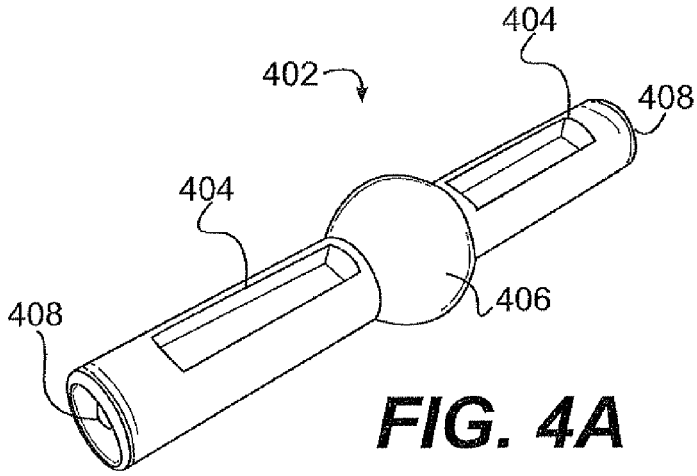
FIGS. 4A-5K are schematic diagrams illustrating integrally formed large-scale rods, according to an embodiment of the present invention.
Figure 4B:
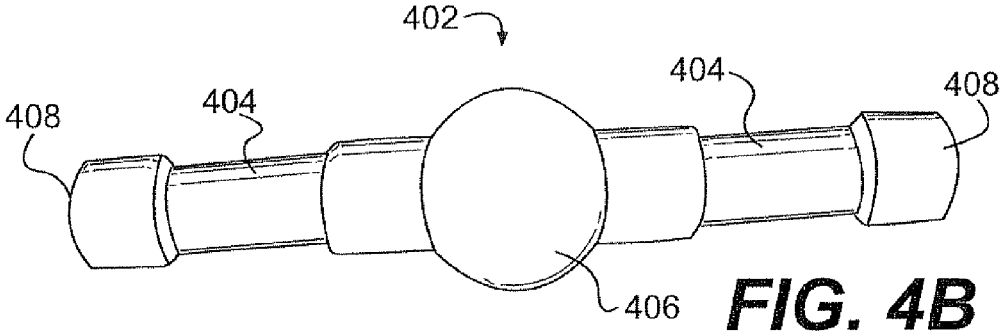
Figure 4C:
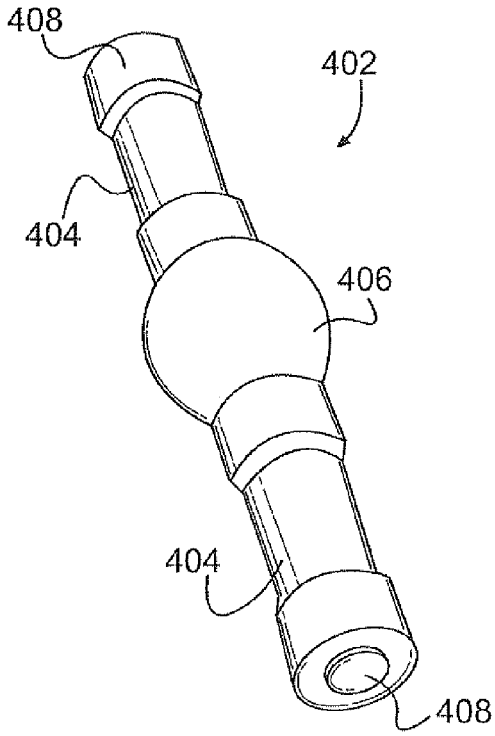

As an example, FIGS. 4A-4C illustrate an integrally formed large-scale rod (which can be referred to as a "rod and ball element") 402 comprising two rod portions 404 and a ferromagnetic ball portion 406. The rod portions 404 and ball portion 406 are permanently affixed to each other such that the spatial relationship of the portions is fixed. In this embodiment, the rod portions 404 and ball portion 406 are aligned such that the longitudinal axes of the rod portions 404 are collinear and intersect the center of ball 406. Magnets 408 are disposed at the distal ends of the large-scale rod element 402. It will be appreciated that the dipole axes of the magnets are also substantially collinear.

Figure 4D:
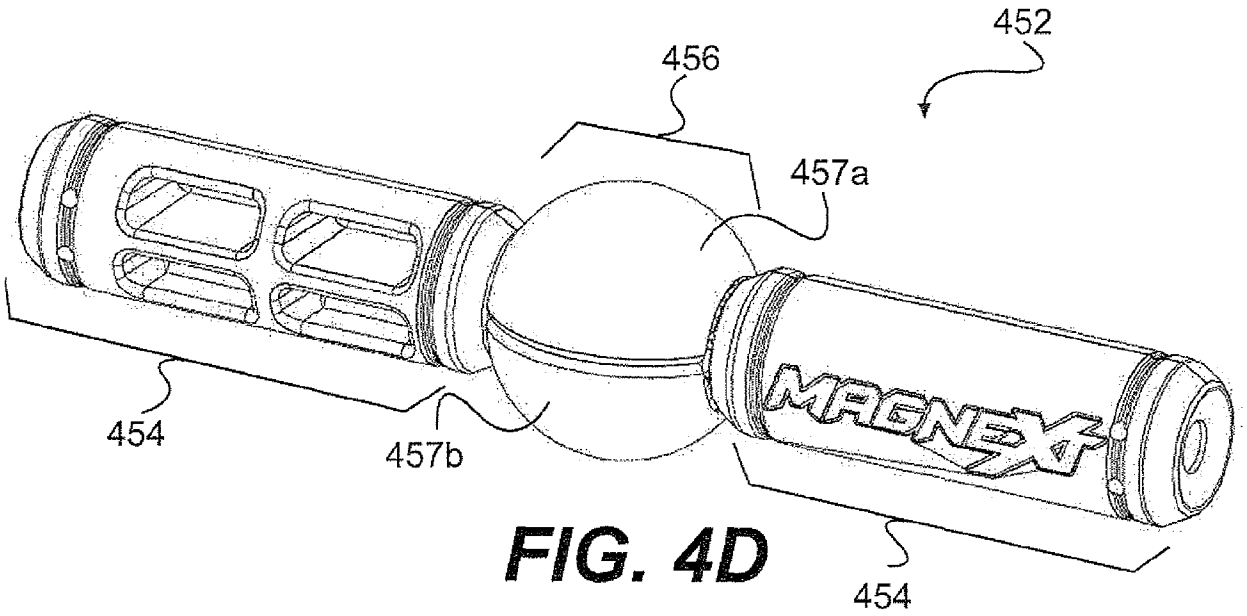
Figure 4E:
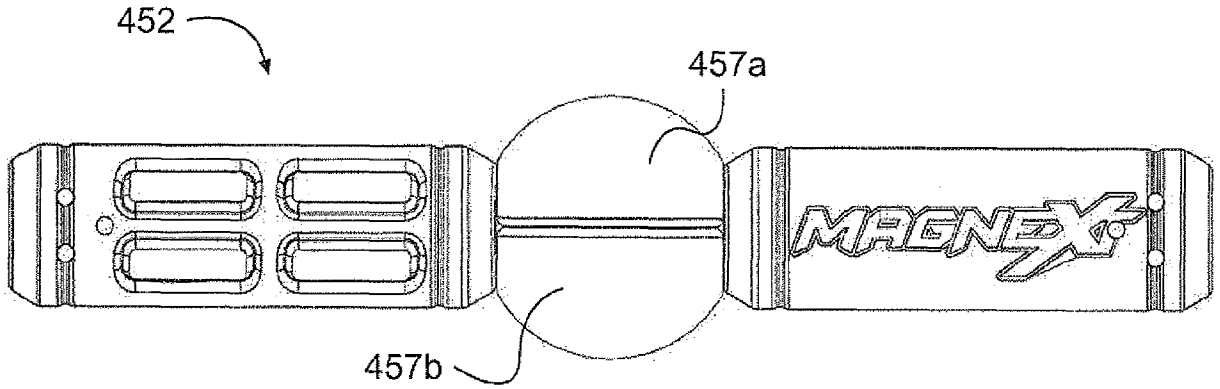
Figure 4F:
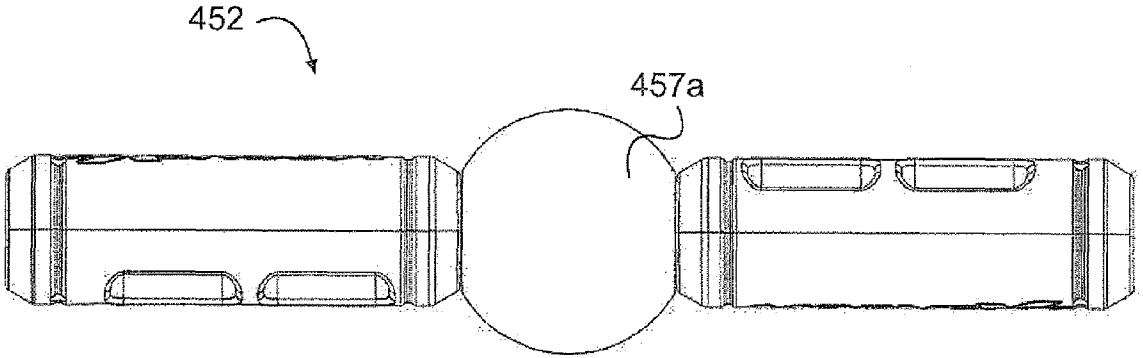

FIGS. 4D-4F illustrate another large-scale rod 452 comprising two rod portions 454 and a ferromagnetic ball portion 456, according to an alternative embodiment of the present invention. Rod portions 454 can contain magnets at their ends opposite the ball portion 456. In this embodiment, the large-scale rod 452 is formed as a continuous member from one rod portion, through the spherical ball portion, and to the opposite rod portion. For example, the continuous member can be a plastic injection molded part comprising the spherical ball portion and the two rod portions on opposite sides of the ball portion. Ferromagnetic material can then be applied over the ball portion to provide means for magnetically coupling magnetic elements to the center portion of large-scale rod 452. In one implementation, as shown in FIGS. 4D and 4E, a metal shell is applied over the ball portion (e.g., glued), formed from two hemispherical parts 457*a* and 457*b*, with circular cutouts at their ends to accommodate the rod portions. In another implementation, ferromagnetic material is molded over or painted on the ball portion.

Figure 4G:
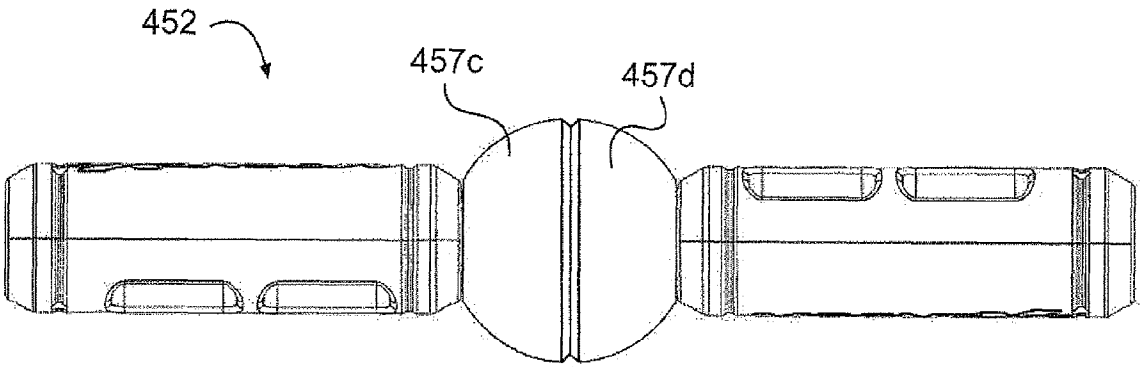

In an alternative embodiment, shown in FIG. 4G, instead of forming the ferromagnetic spherical portions as shown in FIGS. 4D-4F with the seam between two hemispheres being in a common plane with the longitudinal axis of the rod 452, the ferromagnetic spherical portion can be formed by two hemispheres having a seam that is generally perpendicular to the axis of the rod 452. In such an embodiment, each hemispherical portion 457*c*, 457*d* may comprise a hole in a "polar" region that is sized so that the rod portions 454 may fit through the hole. Each of the hemispherical portions are then slid over the rod portions 454 so that they meet at the ball portion 456 to be joined, for example, by gluing, snap-fit, or the like. This embodiment may provide an added advantage in that the two hemispherical ferromagnetic portions 457*c*, 457*d* joined together create a complete circumferential seal.

The large-scale rod (or, rod and ball) elements can be assembled with other similar construction elements to quickly form large core assemblies for a construction. In particular, by dimensioning each rod portion to be the same length as a rod element and using a ball portion having dimensions equal to the ferromagnetic balls in a smaller scale magnetic construction kit, the improved rod construction can be used in conjunction with components of the smaller scale kit. The rod element may also include internal conductors to provide a complete magnetic and/or electrical circuit through the rod. Conductors such as the blocks 103*a*, 103*b* of FIG. 1C could be used, as an example.

Figure 6:
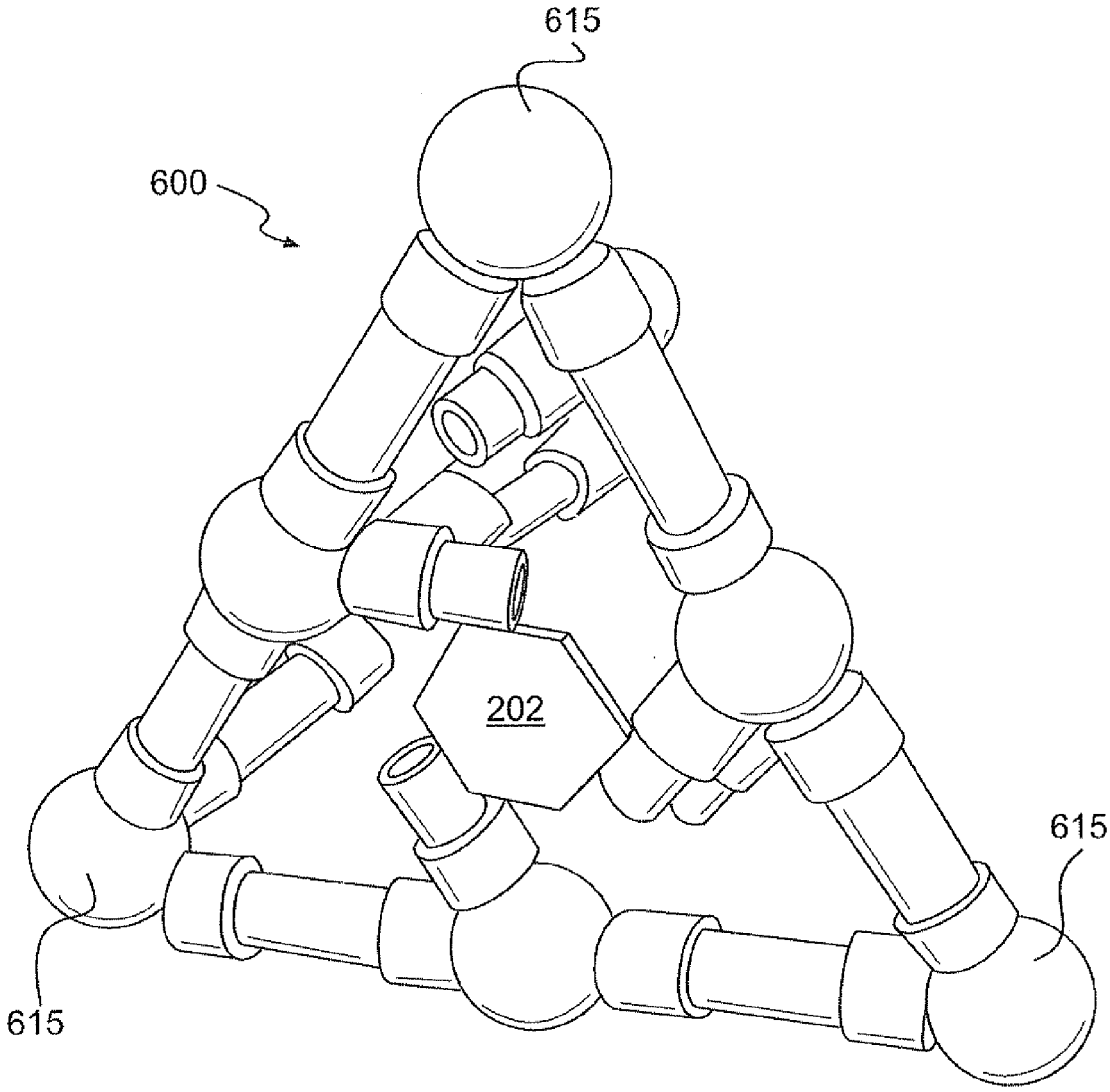
FIG. 6 is a schematic diagram of an exemplary construction using integrally formed large-scale rods of FIG. 4B and triangular panel elements of FIGS. 1A and 1B, according to an embodiment of the present invention.

FIG. 6 illustrates an example of such a construction 600, using six large-scale rods 402 (having rod and ball portions) and four ferromagnetic balls 615 to form a tetrahedron structure. In addition, to provide further strength and stability to construction 600, triangular panel elements 202 can be attached at each face of the tetrahedron structure, magnetically coupling to the intermediate ball portions of the large-scale rods 402.

Figure 5A:
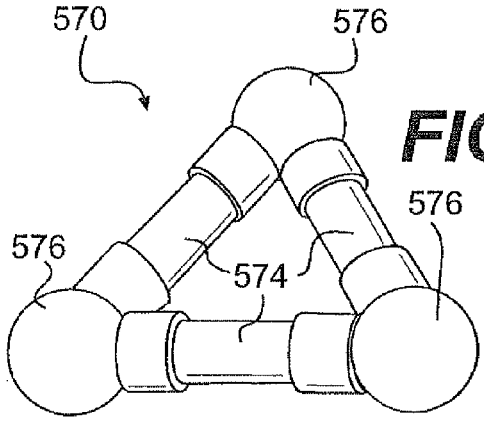
FIG. 5L is a schematic diagram illustrating long triple bars, each with three rods and two intermediate metal balls, disposed on top of a tram, with seats in the tram spaced to cooperate with the spaced apart balls of the long triple bars, according to an embodiment of the present invention.

FIGS. 5A-5E illustrate additional implementations of integral large-scale rods. FIG. 5A illustrates a large-scale rod 570 comprising three rods 574 permanently affixed to three ferromagnetic balls 576 to form a triangular element that extends substantially in an x-y plane. The element 570 need not include any magnets.

Figure 5B:
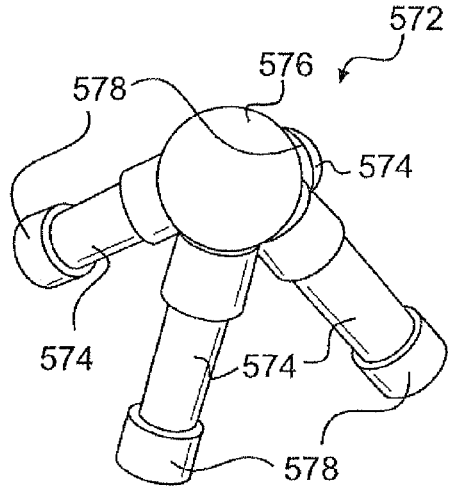

FIG. 5B illustrates a large-scale rod 572 comprising four rods 574 permanently affixed to a single ferromagnetic ball 576, in a configuration that can serve as the top of a square pyramid. The rods 574 can have magnets 578 at their ends opposite the ball 576, for magnetically coupling to other ferromagnetic or magnetic elements (such as ferromagnetic balls).

Figure 5C:
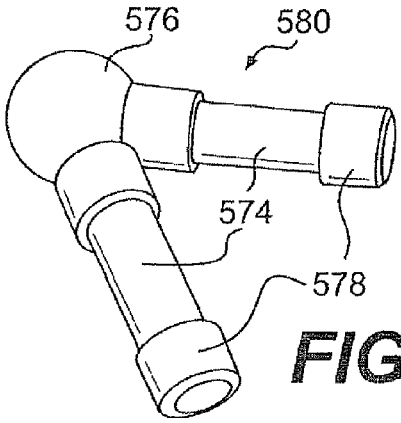

FIG. 5C illustrates a large-scale rod 580 comprising two rods 574 permanently affixed to a single ferromagnetic ball 576. The rods 574 can have magnets 578 at their ends.

Figure 5D:
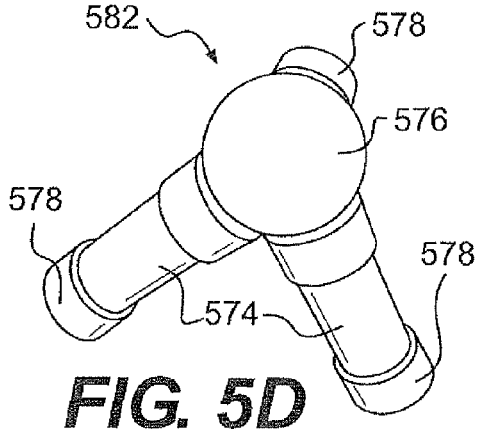

FIG. 5D illustrates a large-scale rod 582 comprising three rods 574 permanently affixed to a single ferromagnetic ball 576, in a configuration that can serve as the top of a triangular pyramid. The rods 574 can have magnets 578 at their ends.

Figure 5E:
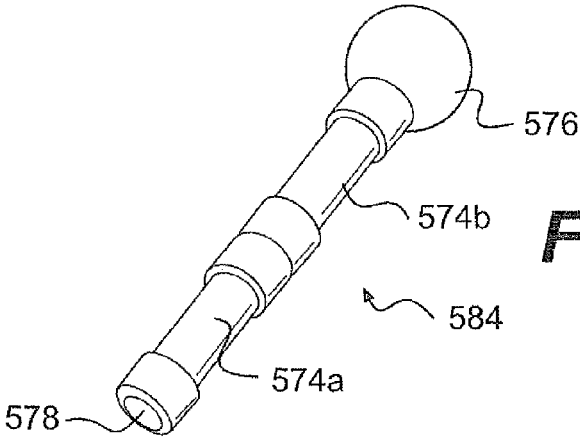

FIG. 5E illustrates a large-scale ball and rod element 584 comprising two rods 574*a* and 574*b* permanently affixed to each other and a ferromagnetic ball 576 permanently affixed to one end of rod 574*b*. The rod 574*b* in between the ball 576 and other rod 574*a* need not have any magnets. The rod 574*a* can have a magnet 578 disposed at its end opposite to rod 574*b*.

Figure 5F:
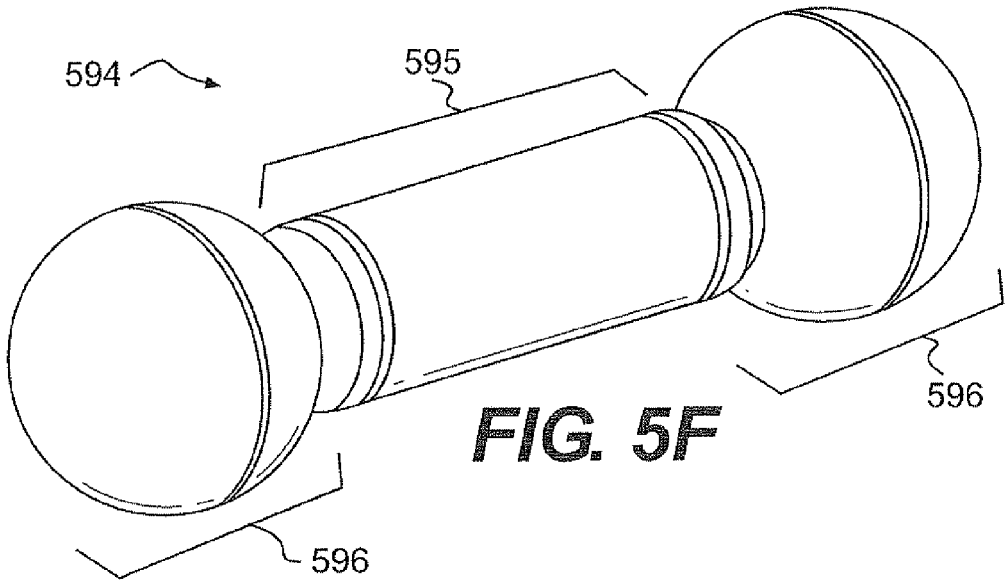
Figure 5G:
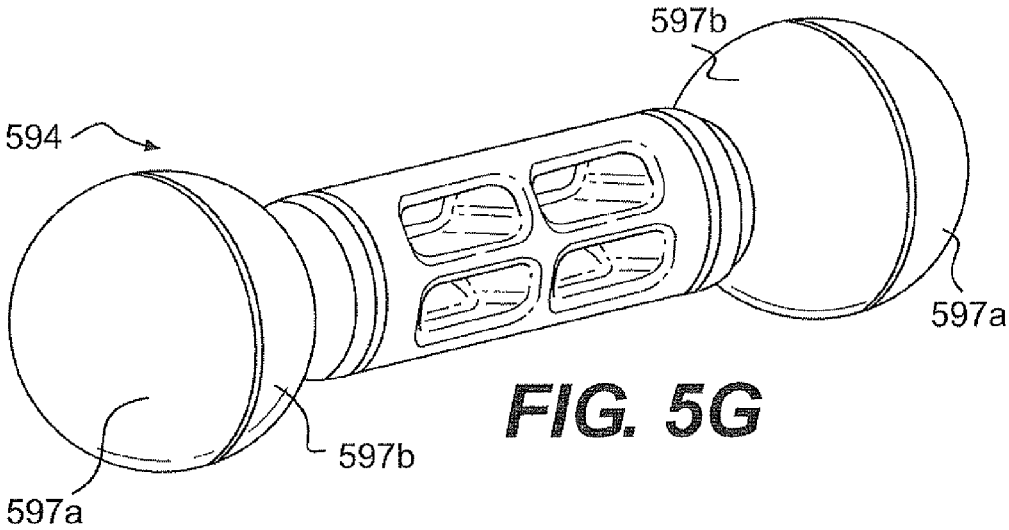

FIGS. 5F and 5G illustrate a large-scale ball and rod element 594 comprising two ferromagnetic ball portions 596 permanently affixed on opposite ends of a rod portion 595. In one implementation, element 594 is formed as a continuous member from a first ball portion, through the rod portion, and to the second ball portion. For example, the continuous member could be a plastic injection molded part comprising the two ball portions and the rod portion. Ferromagnetic material can then be applied over the ball portions to provide means for magnetically coupling magnetic elements to the balls 596. In one implementation, as shown in FIGS. 5F and 5G, a metal shell is applied over the ball portion (e.g., glued), formed from two hemispherical parts 597*a* and 597*b*, with a circular cutout in one hemispherical part 597*b* to accommodate the rod portion. In another implementation, ferromagnetic material is molded over or painted on the ball portions.

Figure 5H:
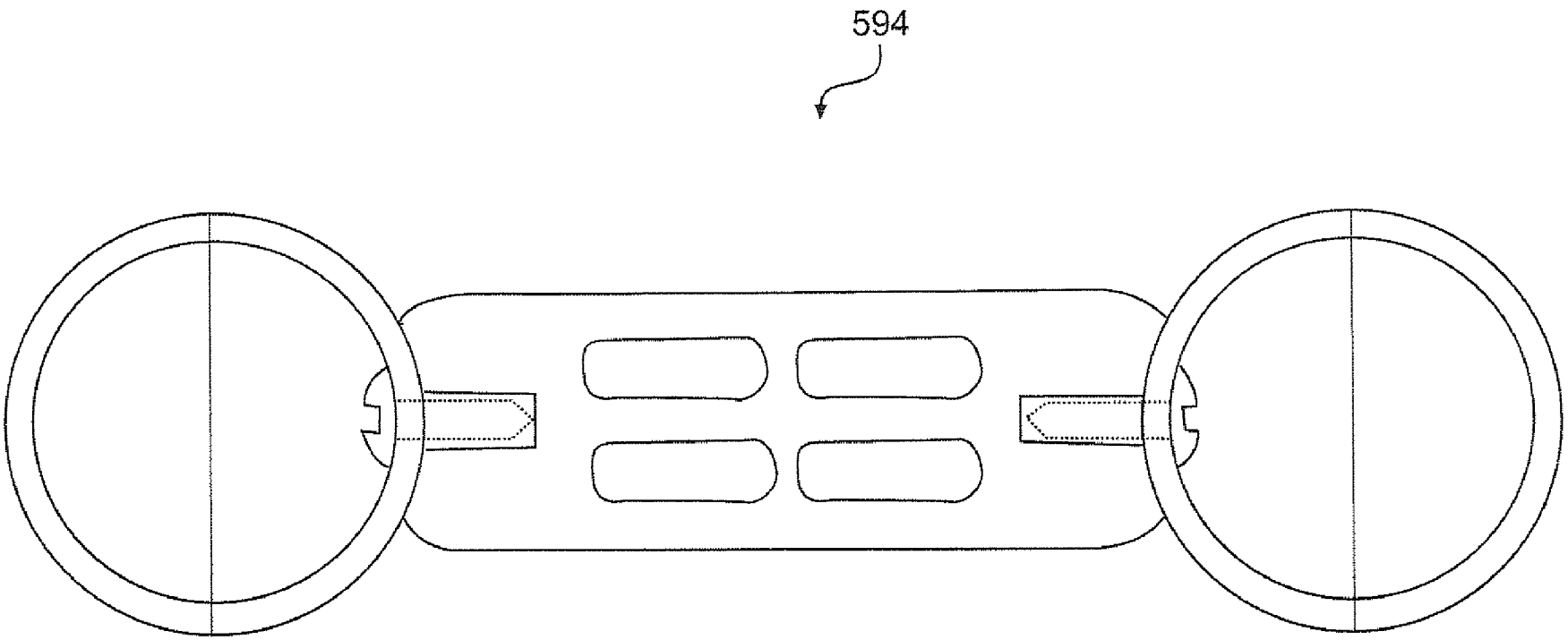
Figure 5I:
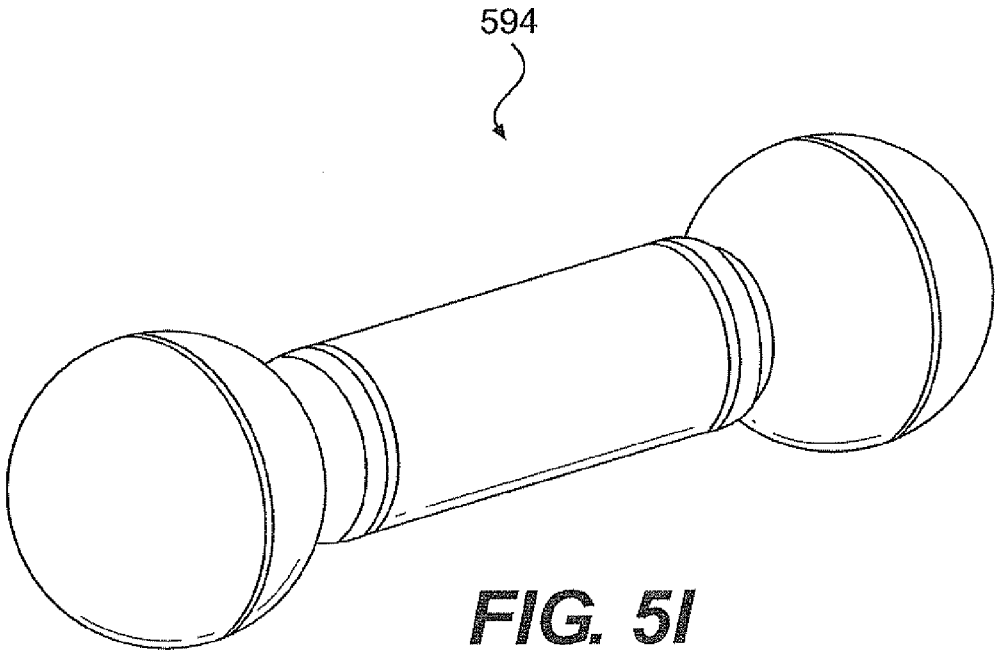

FIGS. 5H and 5I illustrate an exemplary construction of the large-scale ball and rod element 594 shown in FIGS. 5F and 5G. As shown in FIG. 5H, ferromagnetic (e.g., metal) half balls are screwed into the ends of rod portion 595. Ferromagnetic (e.g., metal) half-ball ends are then glued at the ends of the screwed-in half balls. Triangular head screws can be used. The rod portion 595 can be made of 0.06-inch shelled ABS, and dimensions of approximately 1.09×0.36×0.36 inches. Metal half-balls can have a thickness of approximately 0.04 inches.

Figure 5J:
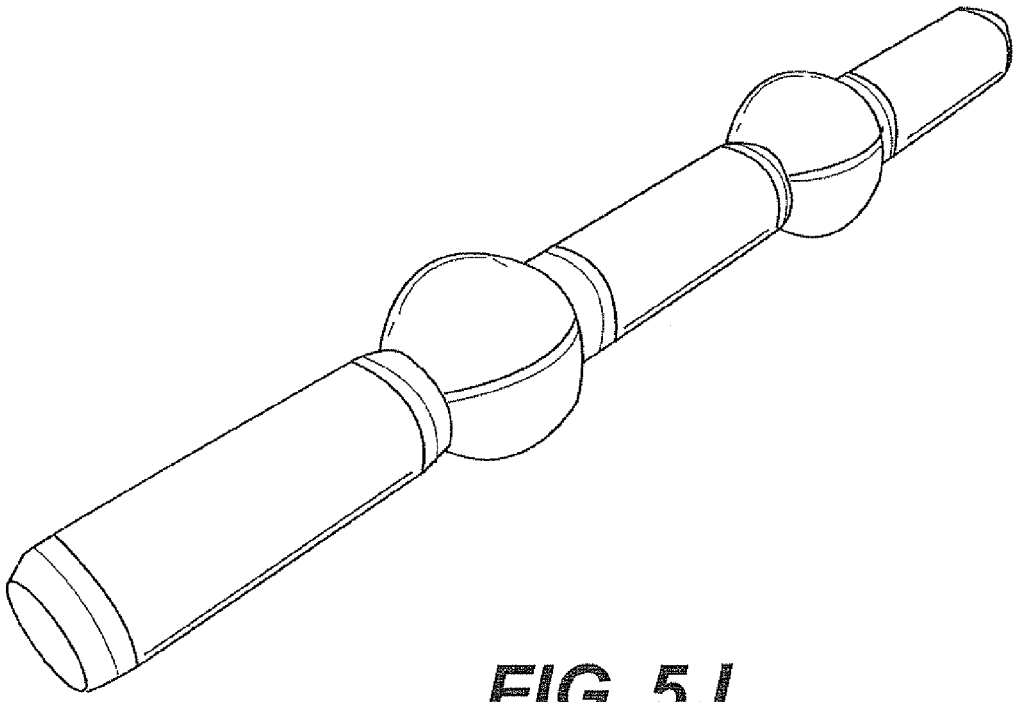
Figure 5K:
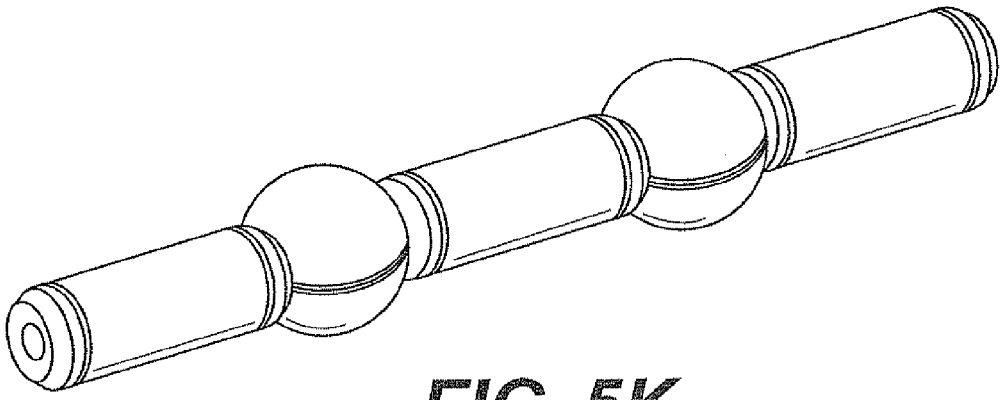

In a further embodiment, FIGS. 5J and 5K illustrate a large-scale ball and rod element comprising two ferromagnetic ball portions permanently affixed to a long rod portion having three sub-portions, also referred to herein as a long triple bar. The distal ends of the long triple bar have magnets. The intermediate ball portions call be made of metal half-balls that are glued together around spherical sections (not shown) of the long rod portion. The half-balls can have semicircular notches such that when two half-balls are glued together, opposing circular openings are created in which the long rod portion is disposed. The assembly creates the appearance that the long triple bar has three individual rods (i.e., the three sub-portions), when in fact it has only one long rod portion of varying widths. The long rod portion can be made of ABS overmolding with 0.05 inch thick walls, and can be approximately 4.326×0.55×0.55 inches.

Alternatively, the ferromagnetic half-balls may be constructed in a manner similar to that described with respect to the large-scale rod 452 of FIGS. 4D-4F, wherein the seam between the half-balls is oriented in a plane perpendicular to the longitudinal axis of the rod 594 and creates a complete circumferential seal between them.

Figure 5L:
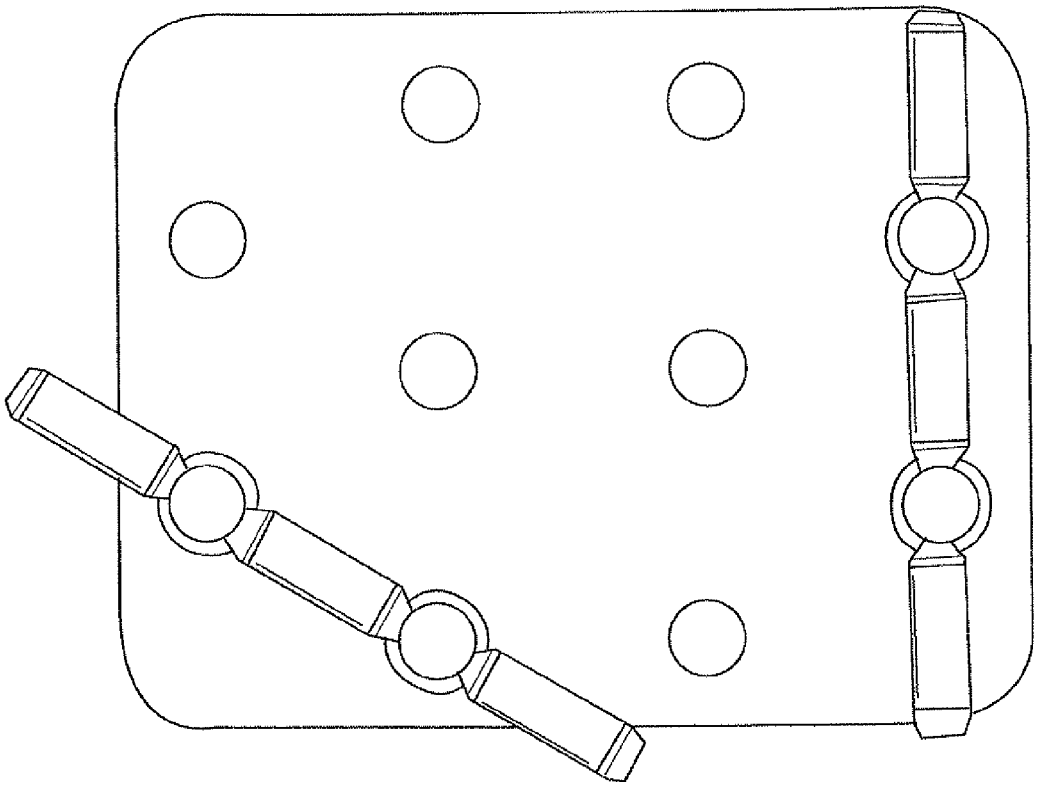

In a further aspect of the present invention, FIG. 5L illustrates long triple bars, each with three rods and two intermediate metal balls, disposed on top of a tram, with seats in the tram spaced to cooperate with the spaced apart balls of the long triple bars. The seats can be cup shaped, for example.

Integrally formed large-scale rods having permanently affixed rods and balls in other configurations are possible and are within the spirit and scope of the present invention. The important feature of all such constructions is that the spatial relationship of the rod and ball portions is fixed. Naturally, assemblies may include panel portions in addition to or in lieu of rod portions as shown, for example, in FIGS. 14A-14G.

Figure 7A:
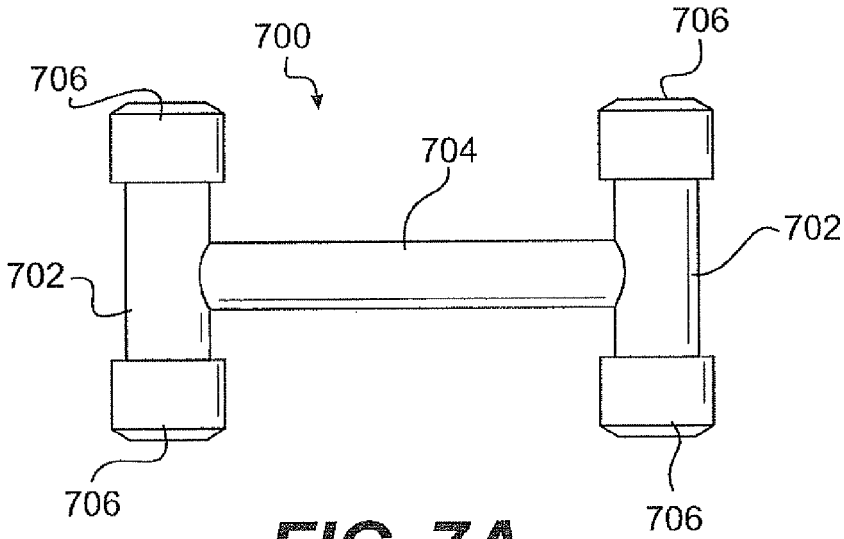
FIGS. 7A-8 are schematic diagrams of H-shaped elements, according to embodiments of the present invention.
Figure 7B:
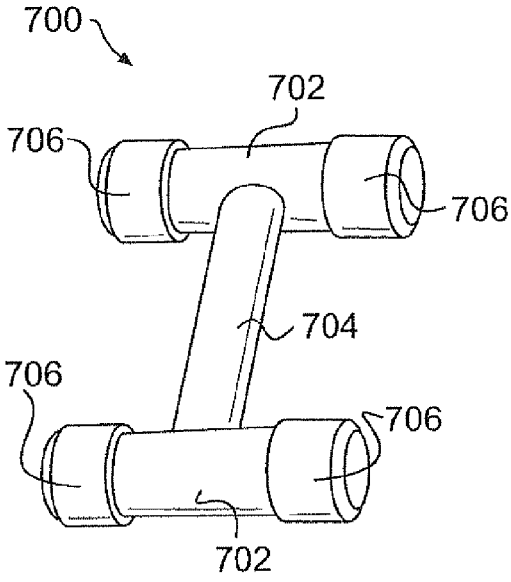
Figure 7C:
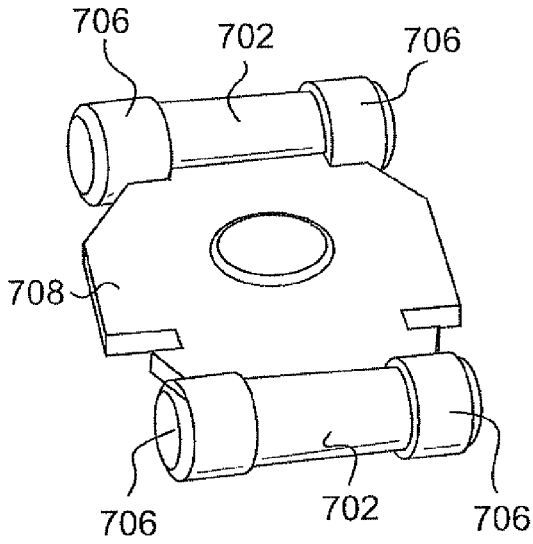

FIGS. 7A and 7B illustrate another embodiment of the present invention, providing an "H" shaped element that, when magnetically coupled with ferromagnetic balls, provides essentially a panel element that extends substantially in an x-y plane. This H-shaped element can serve as a stable foundation for a polyhedron construction, such as a cube, prism, or pyramid. As shown in FIGS. 7A and 7B, an exemplary H-shaped element 700 has two magnetic rods 702 joined by a center strut 704, with the rods 702 and strut 704 being substantially coplanar, and with the north to south pole axes of the magnets 706 disposed at the ends of the rods 702 being generally perpendicular to the longitudinal axis of the strut. The H-shaped element 700 can attach to four ferromagnetic balls to provide a stable foundation on which to build further elements, for example, building a pyramid having a square base. FIG. 7C illustrates an alternative embodiment in which a panel 708 is used in place of the center strut 704.

Figure 8:
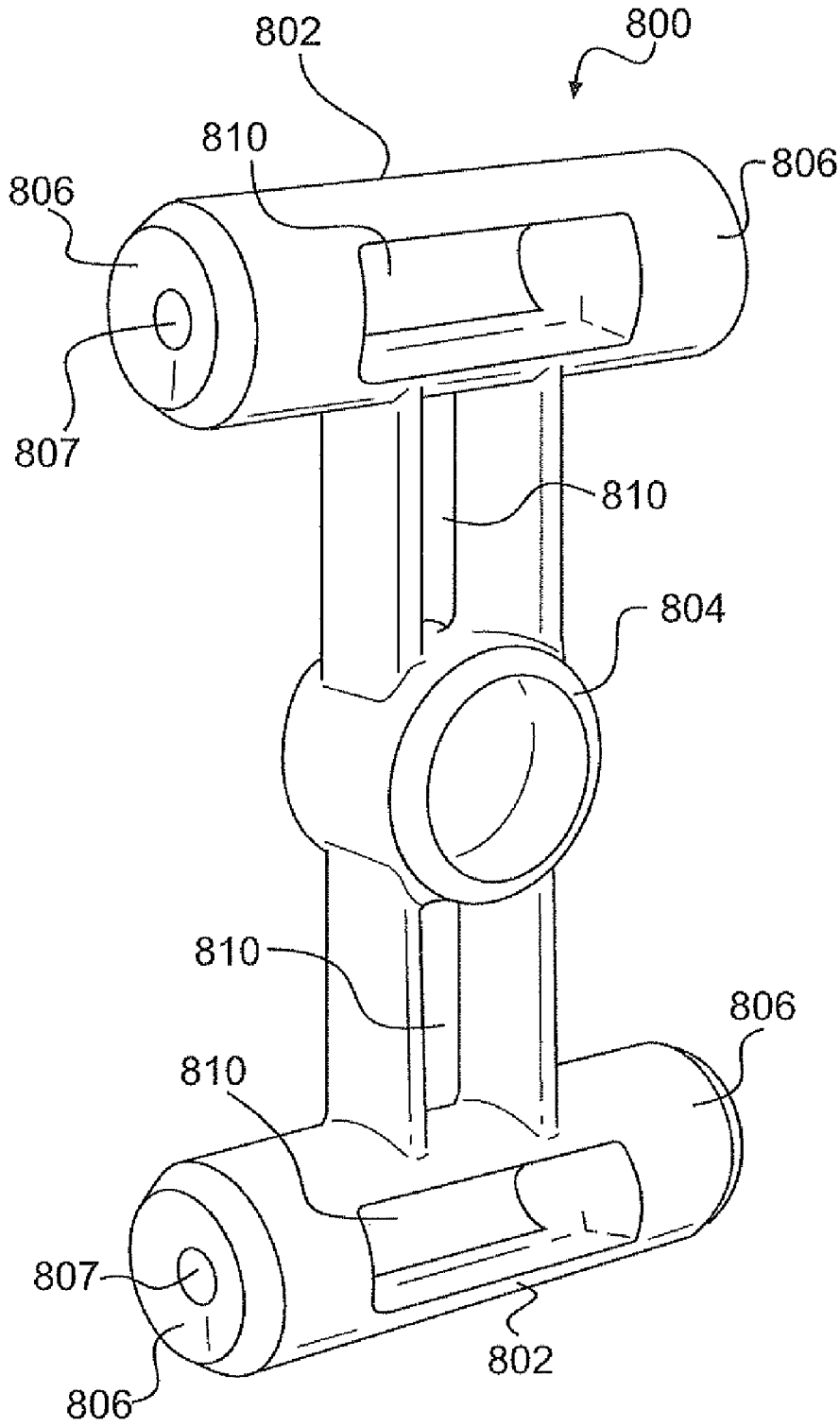

FIG. 8 illustrates an alternative embodiment of an H-shaped element. As shown, the exemplary H-shaped element 800 comprises rods 802, center strut 804, and magnets 806, which are all integrally molded, for example, by placing the magnets in a mold and insert molding around them. Alternatively, rods 802 and center strut 804 can be integrally molded with magnet recesses formed in the rods 802, and in a post-molding process, the magnets 806 can be glued in place in the recesses, perhaps with a cover secured over them. As shown in FIG. 8, the insert molded or glued cover can be concave and include an opening 807 exposing a face of the magnet, to allow a positive secure contact between the magnet and a ferromagnetic ball. This contact enables the completion of magnetic and electrical circuits. The rods 802 and strut 804 can also include openings 810 that reduce the amount of material used in the element 800, to reduce the weight and cost of the part, and that also can provide additional mechanical couplings discussed in more detail below.

Figure 9A:
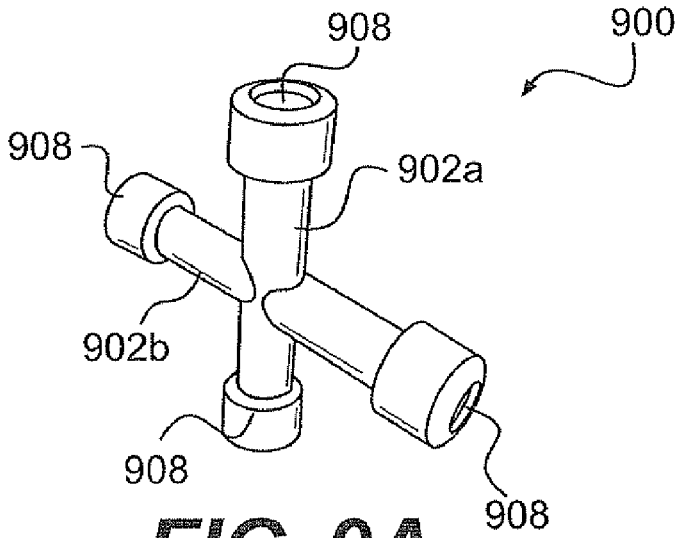
FIGS. 9A and 9B are schematic diagrams of X-shaped elements, according to embodiments of the present invention.
Figure 9B:
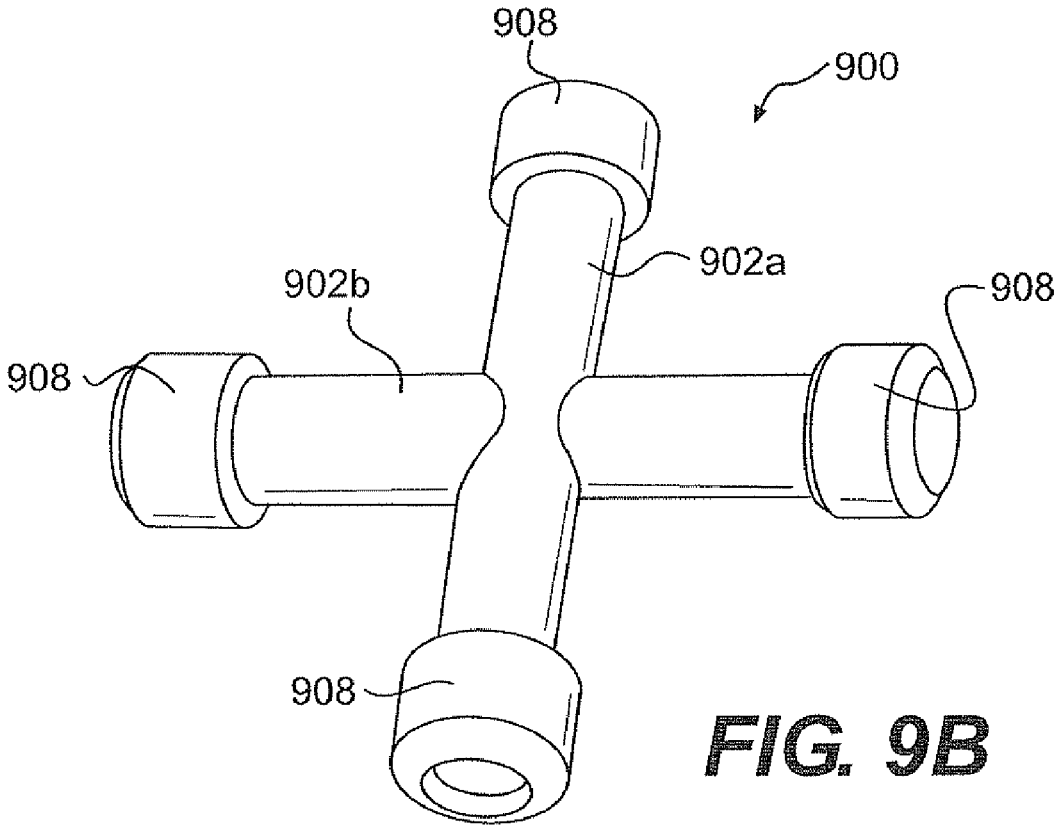

FIGS. 9A and 9B illustrate another embodiment of the present invention, providing an "X" shaped element 900 that, when magnetically coupled with ferromagnetic balls, provides essentially a panel element that extends substantially in an x-y plane. As shown, the X-shaped element includes intersecting rods 902*a* and 902*b*, with magnets 908 disposed at the ends of the rods. With four ferromagnetic balls magnetically coupled to the magnets 908, the X-shaped element can provide a stable foundation on which to build further elements, for example, building a pyramid having a square base.

FIGS. 10-18 illustrate additional embodiments of the present invention, providing elements that further contribute to the stability and/or design flexibility of magnetic constructions.

Figure 10:
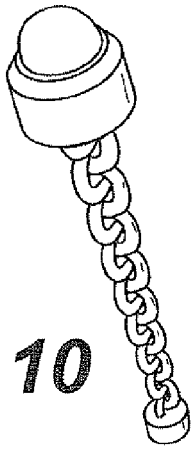
FIG. 10 is a schematic diagram of a chain element, according to an embodiment of the present invention.

FIG. 10 illustrates a chain element comprising a flexible chain having a magnet on one end and a ferromagnetic ball or partial ball (e.g., hemisphere) on the other end.

Figure 11A:
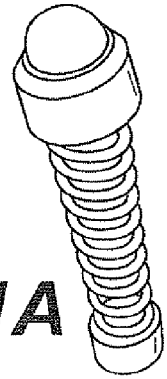
FIG. 11A is a schematic diagram of a spring rod element, according to an embodiment of the present invention.

FIG. 11A illustrates a spring rod element comprising a spring portion having a magnet on one end and a ferromagnetic ball or partial ball (e.g., hemisphere) on the other end. The magnet, spring portion, and ball portion can be made of electrically conducting materials and can be electrically connected to conduct electrical current through the spring rod element. Alternatively, a spring rod element could have ball portions at both ends or magnets at both ends. In either case, the components of the spring rod element can be electrically connected to conduct electrical current through the entire length of the spring rod element.

The spring rod element of FIG. 11A can facilitate a nonlinear connection between the ends of the element. In other words, the spring rod element can flex in a nonlinear configuration to attach to two points. The spring rod element can also be configured to stretch or compress to accommodate attachment points spaced apart at different distances.

Figure 11B:
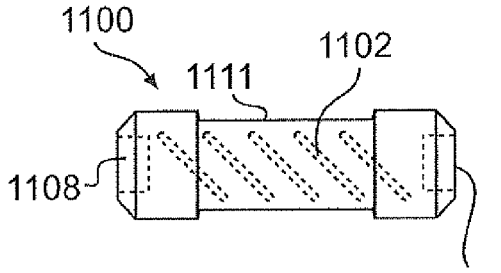
FIG. 11B is a schematic diagram of a rod element having an internal spring, according to an embodiment of the present invention.

FIG. 11B illustrates a rod element 1100 having an internal spring 1102, according to another embodiment of the present invention. As shown, rod element 1100 comprises an outer sheath 1111 having a center spring retaining portion and magnet retaining portions at both ends in which magnets 1108 are disposed. The internal spring 1102 can be made of electrically conductive material and can be compressed within the rod element 1100 so as to maintain contact with the magnets and provide an electrical path through the rod element 1100.

In a further embodiment, the springs of the rods shown in FIGS. 11A and 11B can be magnetically conductive.

Figure 12:
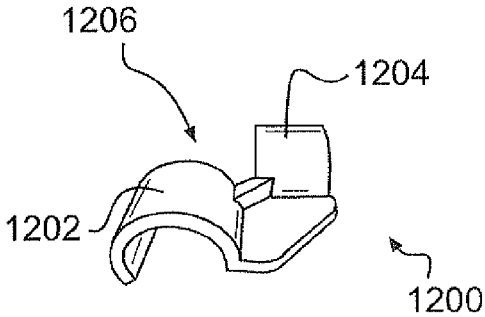
FIG. 12 is a schematic diagram of a square link element, according to an embodiment of the present invention.
Figure 15:
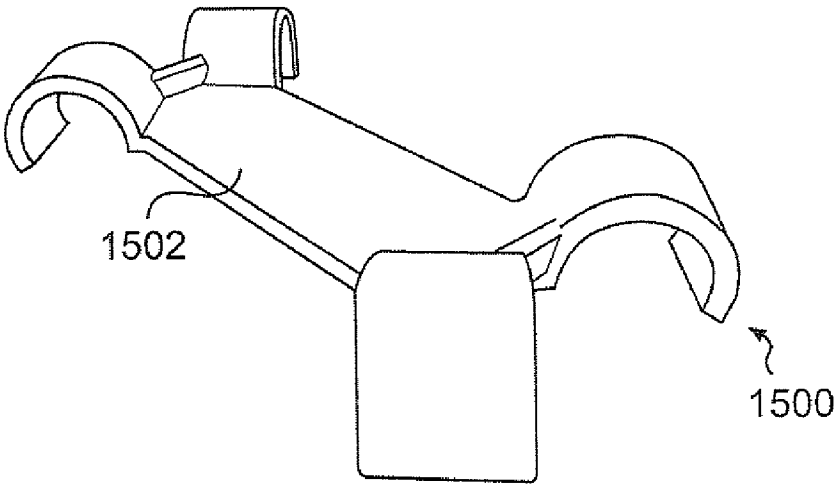
FIG. 15 is a schematic diagram of a dual square link element with connecting strut, according to an embodiment of the present invention.

FIG. 12 illustrates a square link element 1200 configured to attach to the ends of two magnetic rods that are magnetically coupled to a ferromagnetic ball. In this example, a first rod receiving portion 1202 clips around the first rod and a second rod receiving portion 1204 clips around the second rod, with the ferromagnetic ball disposed generally in area 1206. In addition to the C-clip portions 1202 and 1204 shown in FIG. 12, other means of attachment to the rods could be used, such as magnetic couplings. The square link element 1200 holds the rods and ball in sturdy, stable alignment (e.g., with the rods at a right angle) to add to the stability of large constructions. Two square link elements 1200 can be used with four rods and four balls arranged in a square configuration to provide a stable panel extending generally in an x-y plane. As an alternative embodiment, FIG. 15 illustrates another square link element 1500 similar to square element 1200, but adapted to simultaneously connect to four rods in a square configuration, with the center portion 1502 of element 1500 diagonally spanning the square and providing further stability to a panel assembly.

Figure 13:
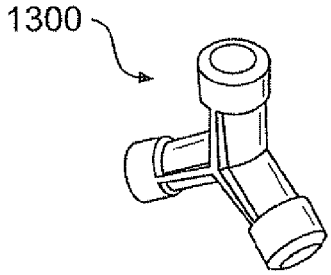
FIG. 13 is a schematic diagram of a triangle rod, according to an embodiment of the present invention.

FIG. 13 illustrates a triangle rod 1300 comprising three rods joined in a triangular configuration with magnets disposed at their ends. The spatial relationship of the magnets relative to one other is fixed. In the embodiment shown, the dipole axes of the magnets are not coplanar, but intersect at a single point.

Figure 14A:
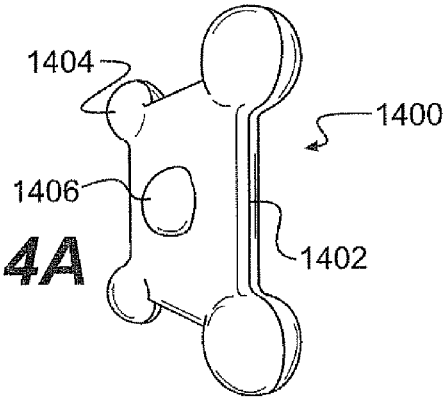
FIGS. 14A-14G are schematic diagrams illustrating integrated ball and panel elements, according to an embodiment of the present invention.

FIG. 14A illustrates an integrated (or monolithic) ball and panel element 1400 comprising a generally square center body 1402 with integrally formed balls (ball portions) 1404 at the corners of the body. The integrated ball and panel element 1400 can be made of a ferromagnetic material, such as tin. The integrated ball and panel element 1400 extends in generally an x-y plane and can also include a ball or partial ball 1406 integrally formed in the center body, for building off of the element in the z-direction. The balls 1404 and 1406 can have a radius of 0.294 inches, for example.

Figure 14B:
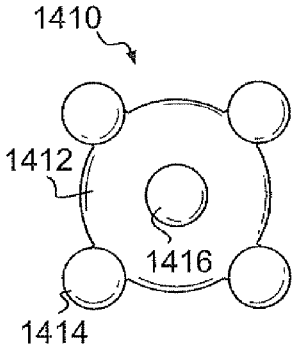
Figure 14C:
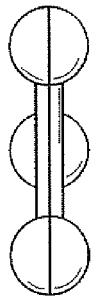
Figure 14D:
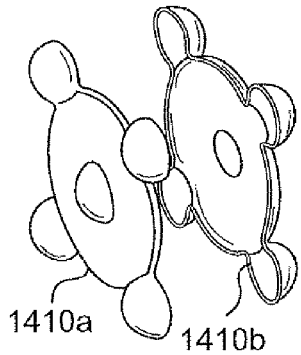

In an alternative embodiment, FIGS. 14B-14D illustrate an integrated ball and panel element 1410 comprising a generally circular center body 1412 with integrally formed ball portions 1414 disposed on the edge of the circular body 1412 and spaced apart equally around the edge of the circular body 1412. In one implementation, the center body 1412 has a radius approximately three times the radius of the ball portions 1414 (e.g., a 0.925-inch center body radius and a 0.294-inch ball portion radius). The integrated ball and panel element 1410 can also include a ball or partial ball 1416 integrally formed in the center body, for building off of the element in a direction away from a face of the center body.

As shown in FIGS. 14C and 14D, the element 1410 can also have a flat edge formed in the ball portions 1414 and the center body 1412, which can improve fit with other elements and minimize gaps between elements. The width of the flat edge can be about 0.200 inches, for example.

FIG. 14D illustrates an exemplary construction of the integrated ball and panel element 1410, in this case being formed from two halves 1410*a* and 1410*b* joined together, resulting in a hollow element. The halves 1410*a* and 1410*b* can be joined, for example, by mechanical fastening means (e.g., snapping interference fits), adhesives, or welding.

Figure 14E:
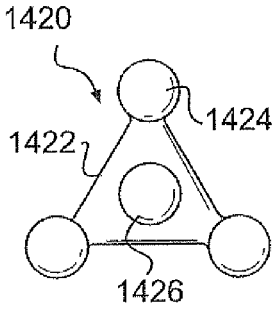
Figure 14F:
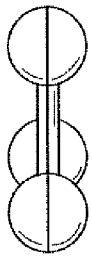
Figure 14G:
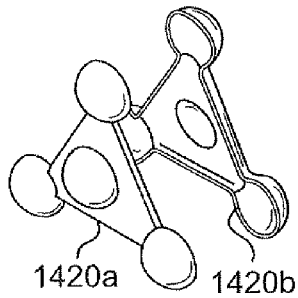

In another alternative embodiment, FIGS. 14E-14G illustrate an integrated ball and panel element 1420 comprising a generally triangular center body 1422 with integrally formed ball portions 1424 disposed at the corners of the triangular body 1422. In one implementation, the triangular shape of the center body 1422 is an equilateral triangle with a height of approximately 1.412 inches, the distance between the center of the ball portions 1424 is about 1.631 inches, and the radius of the ball portions 1414 is about 0.294 inches. The integrated ball and panel element 1420 can also include a ball or partial ball 1426 integrally formed in the center body, for building off of the element in a direction away from a face of the center body.

As shown in FIGS. 14F and 14G, the element 1420 can also have a flat edge formed in the ball portions 1424 and the center body 1422, which can improve fit with other elements and minimize gaps between elements. The width of the flat edge can be about 0.200 inches, for example.

FIG. 14G illustrates an exemplary construction of the integrated ball and panel element 1420, in this case being formed from two halves 1420*a* and 1420*b* joined together, resulting in a hollow element. The halves 1420*a* and 1420*b* can be joined, for example, by mechanical fastening means (e.g., snapping interference fits), adhesives, or welding. The square element 1400 of FIG. 14A could of course have this same two part, hollow construction. In these two-part constructions, each of the elements 1400, 1410, and 1420 could be formed from two embossed tin panels with nickel plated surface coatings.

Figure 16:
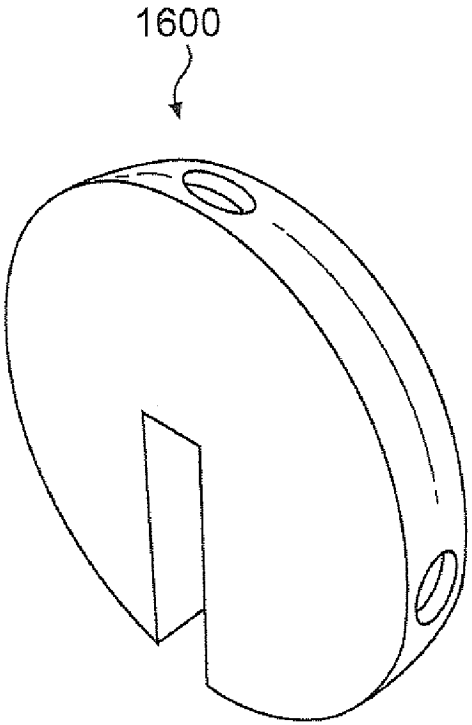
FIG. 16 is a schematic diagram of a circle connector element, according to an embodiment of the present invention.

FIG. 16 illustrates a circle connector element that has three recessed magnets positioned at 90 degree intervals from each other and a slot opening positioned at the fourth 90 degree interval. Two such circle connector elements can be joined together by sliding each into the slot opening of the other, which forms a three dimensional structure having six outwardly facing magnets. The six magnets are arranged such that pairs of magnets along the x-, y-, and z-axes have collinear dipole axes. The spatial position of the magnets relative to one another is fixed and in the embodiment shown, the dipole axes of the magnets are coplanar.

Figure 17:
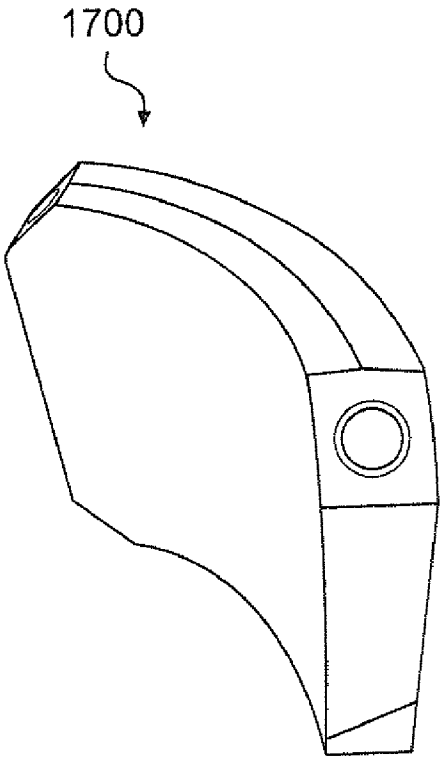
FIG. 17 is a schematic diagram of a curved panel element, according to an embodiment of the present invention.

FIG. 17 illustrates a curved panel element having biased corners with outwardly facing magnets disposed in the biased corners. The element is curved to enable curved three dimensional structures, when joined with ferromagnetic balls and other curved and non-curved elements. The spatial position of the magnets relative to one another is fixed and in the embodiment shown, the dipole axes of the magnets are not coplanar.

Figure 18:
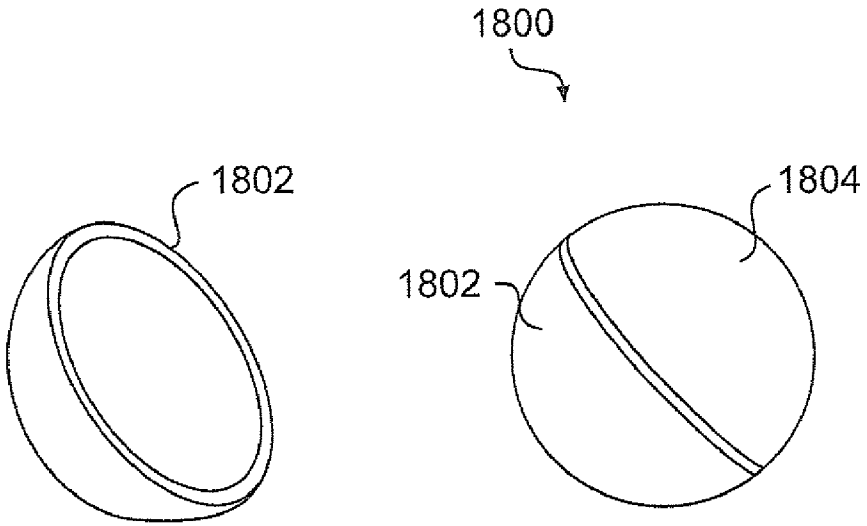
FIG. 18 is a schematic diagram of a hollow ferromagnetic ball, according to an embodiment of the present invention.

FIG. 18 illustrates a hollow ferromagnetic ball, in this case formed from two hollow hemispheres. The two hemispheres can be joined, for example, by mechanical fastening means (e.g., snapping interference fits), adhesives, or welding.

Figure 19B:
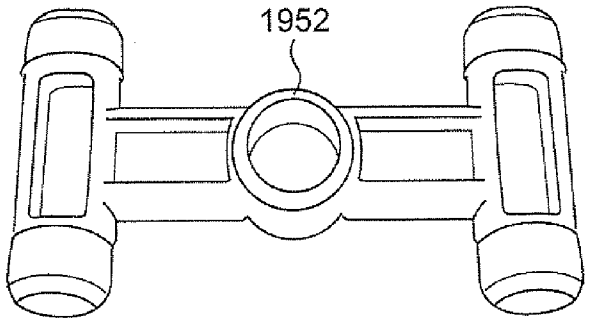
FIGS. 19A-19C are schematic diagrams of construction elements having means for attaching additional parts in a direction generally perpendicular to the plane in which magnets of the element couple with other construction elements, according to an embodiment of the present invention.
Figure 19C:
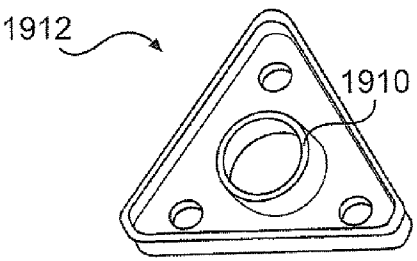
Figure 19A:
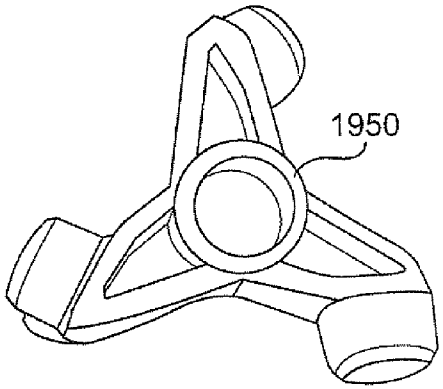

FIGS. 19A-22 illustrate a further aspect of the present invention in which a portion of a construction element (such as a center portion of the element) has means for attaching additional parts in a direction away from the plane in which magnets of the element couple with other construction elements, such as in a direction generally perpendicular to the plane. For example, FIG. 19A illustrates the center body 204 of the triangular panel element 202 of FIG. 2A comprising a female coupling 1950. Similarly, FIG. 19B illustrates the center strut 804 of the exemplary H-shaped element 800 of FIG. 8 comprising a female coupling 1952. In addition, panel element 252 of FIGS. 3E-3I and panel element 352 of FIG. 3E-3I have recesses or openings 264 and 364, respectively, which can serve as female couplings.

Figure 20A:
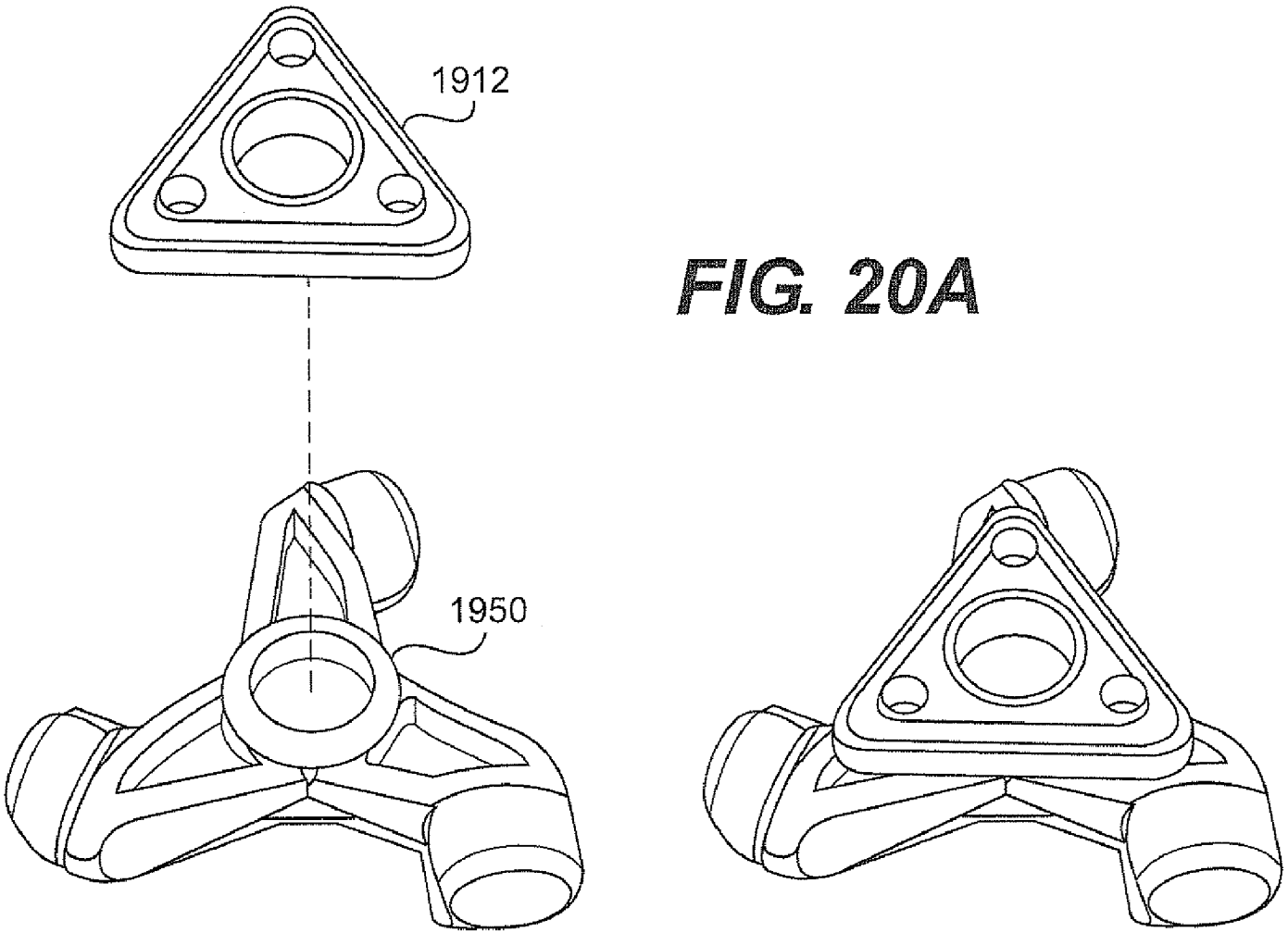
FIG. 20A is a schematic diagram of a triangular element attaching to a triangular panel element via a male-female coupling, according to an embodiment of the present invention.
Figure 20B:
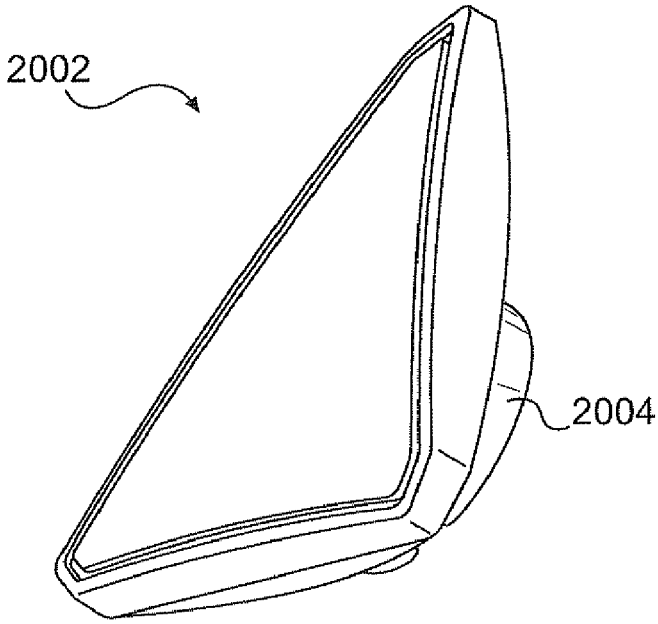
FIG. 20B is a schematic diagram of a front perspective view of an exemplary triangular closure panel adapted to connect to a panel element, according to an embodiment of the present invention.
Figure 20C:
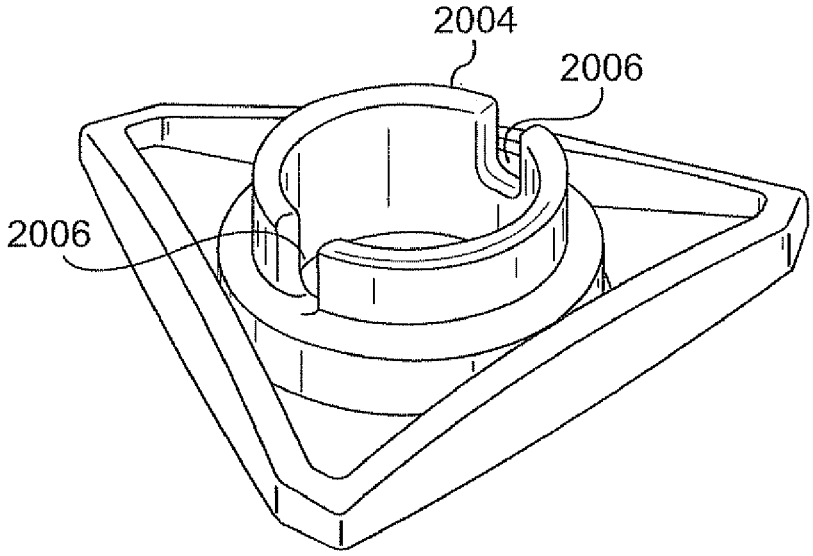
FIG. 20C is a schematic diagram of a back perspective view of the closure panel of FIG. 20B.
Figure 20D:
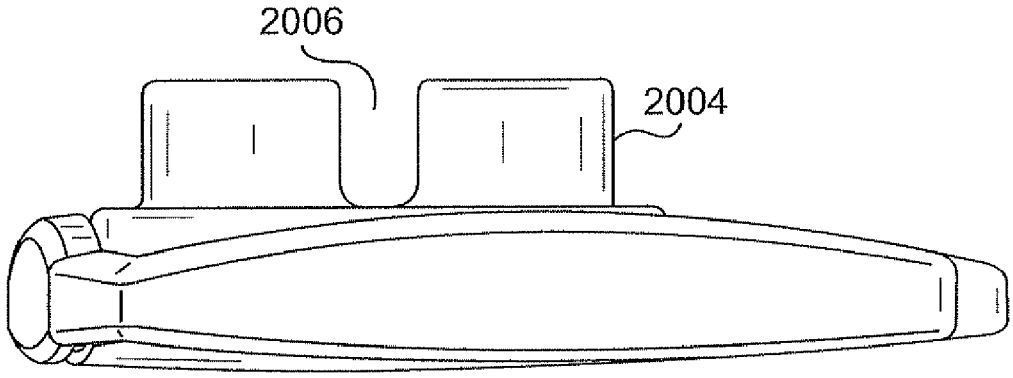
FIGS. 20D and 20E are schematic diagrams of side views of the closure panel of FIG. 20B.
Figure 20E:
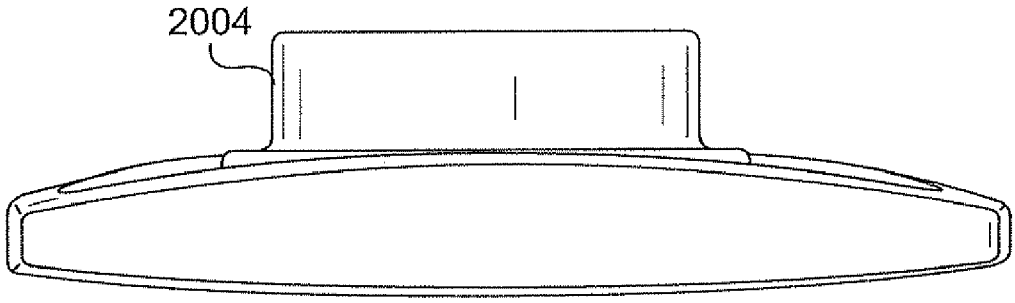
Figure 20F:
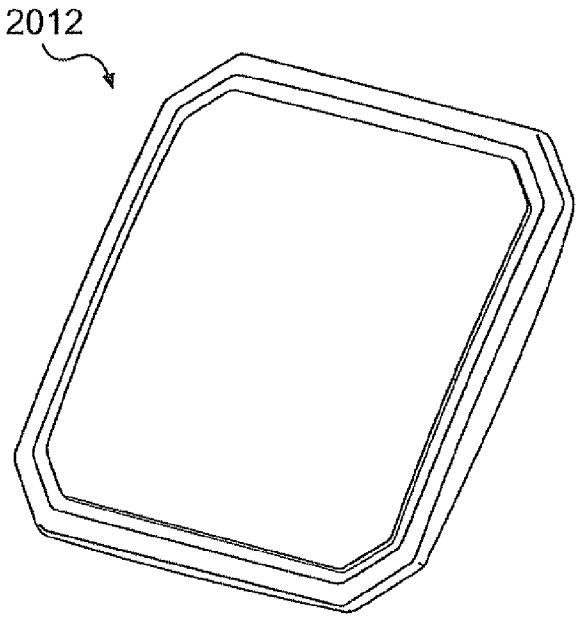
FIG. 20F is a schematic diagram of a front perspective view of an exemplary square closure panel adapted to connect to a panel element, according to an embodiment of the present invention.
Figure 20G:
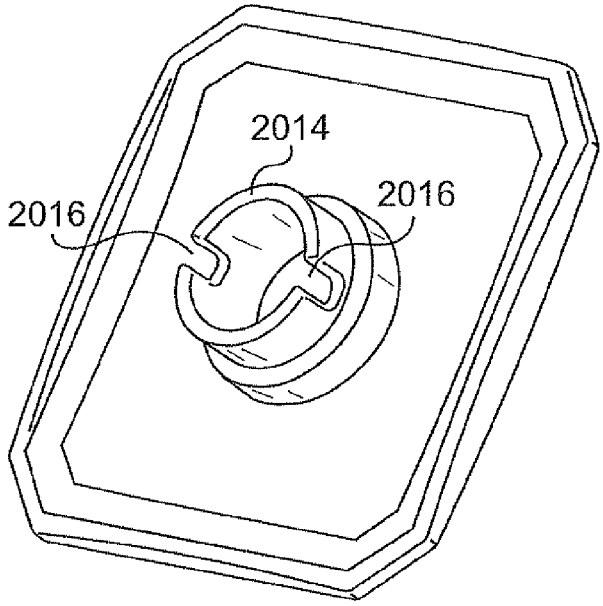
FIG. 20G is a schematic diagram of a back perspective view of the closure panel of FIG. 20F.
Figure 20H:
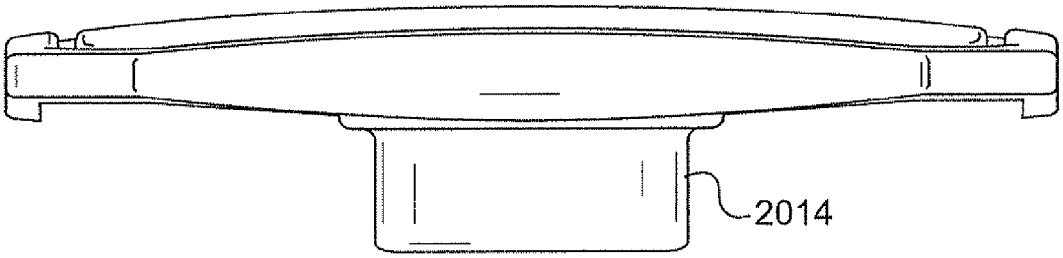
FIGS. 20H and 20I are schematic diagrams of side views of the closure panel of FIG. 20F.
Figure 20I:
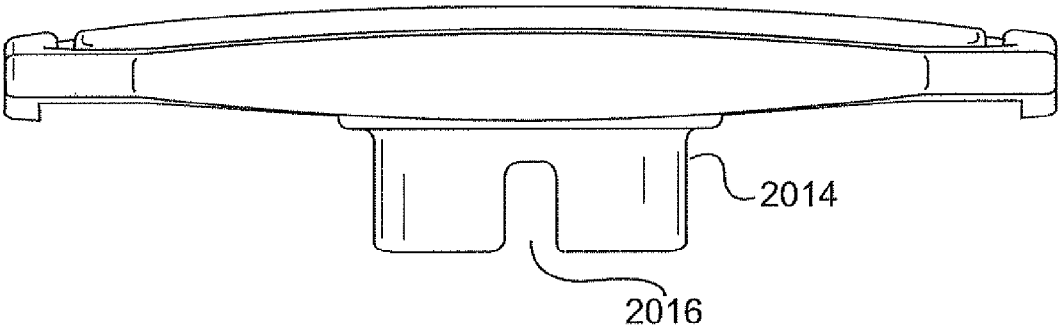
Figure 20J:
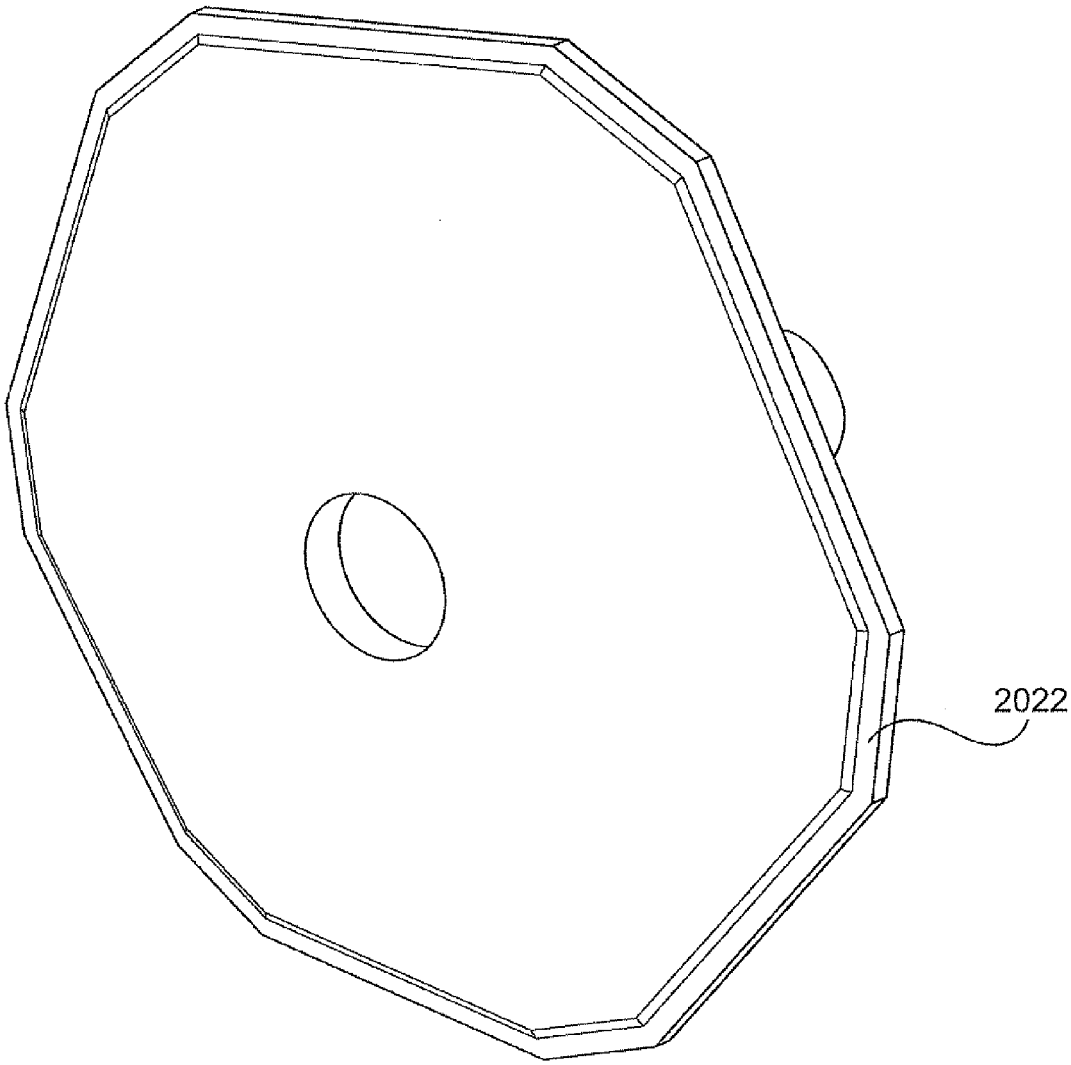
FIGS. 20J-20N are schematic diagrams of an exemplary hexagonal closure panel, according to an embodiment of the present invention.
Figure 21:
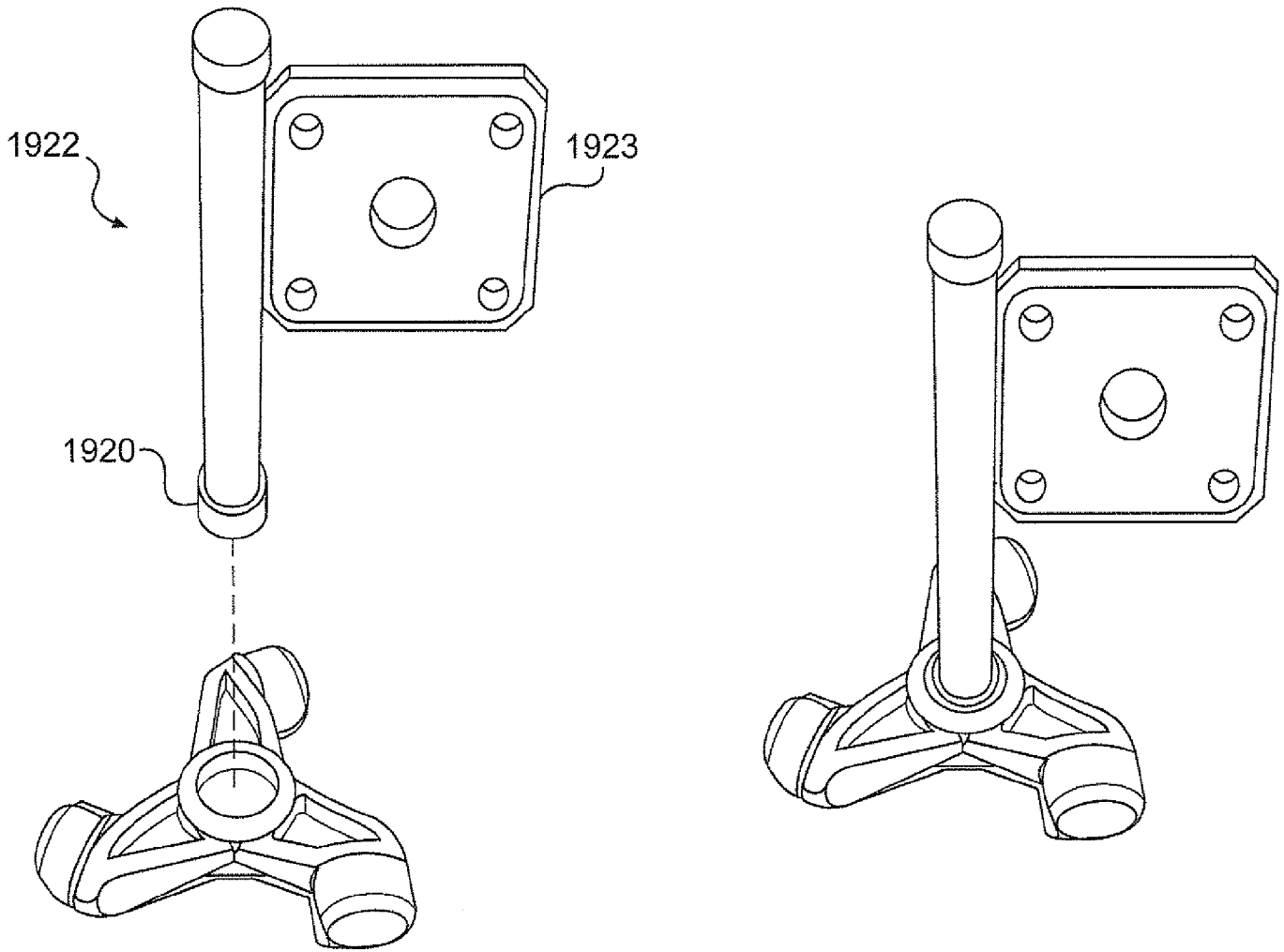
FIG. 21 is a schematic diagram of a rod attaching to a triangular panel element via a male-female coupling, according to an embodiment of the present invention.
Figure 22:
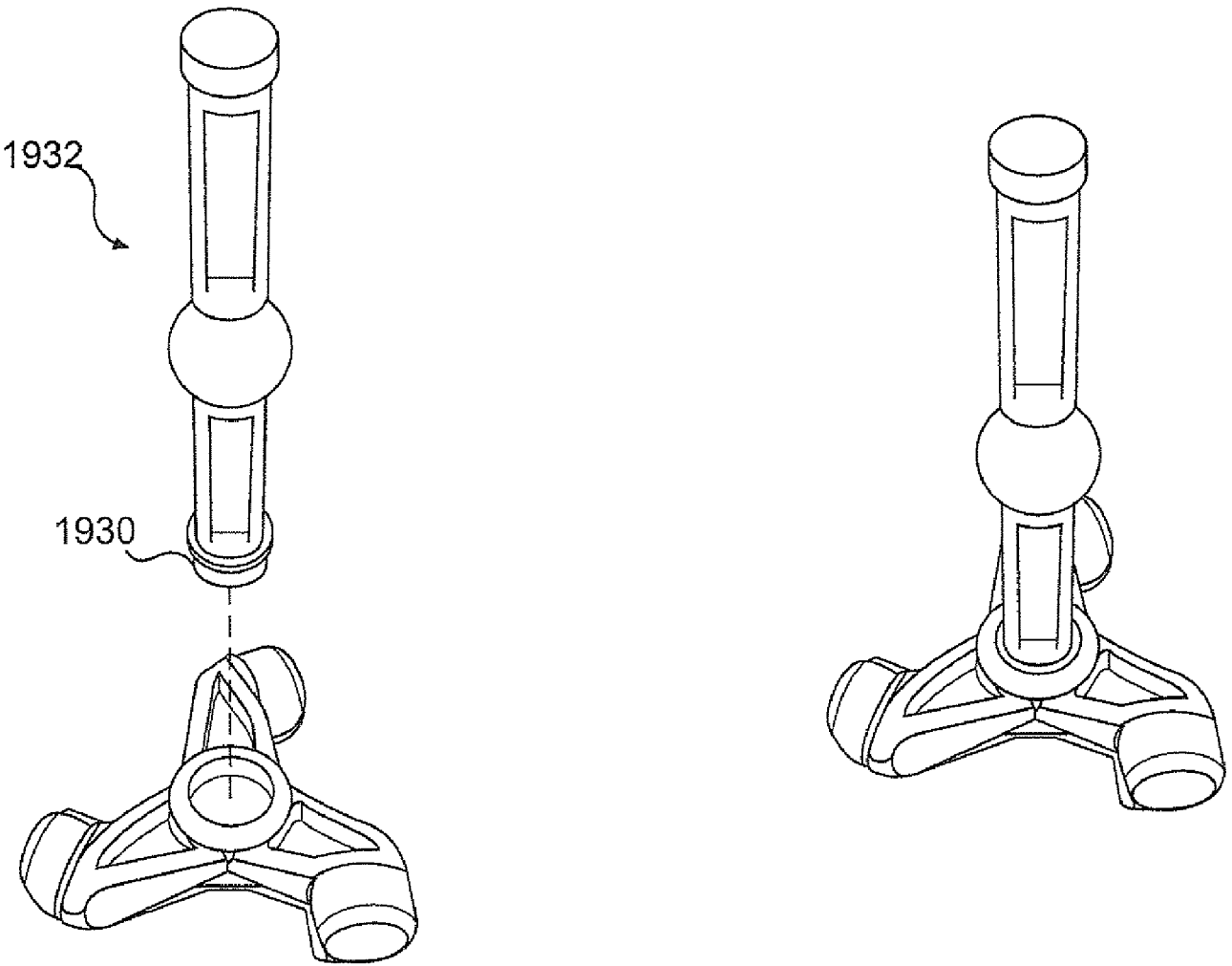
FIG. 22 is a schematic diagram of a large-scale rod element attaching to a triangular panel element via a male-female coupling, according to an embodiment of the present invention.

These female couplings can accept male couplings of other construction elements, such as the male coupling 1910 of the triangular element 1912 of FIG. 19C, the male coupling 1920 of the rod 1922 shown in FIG. 21, and the male coupling 1930 of the large-scale rod element 1932 shown in FIG. 22. FIG. 20A illustrates the triangular element 1912 attaching to triangular panel element 202 via the male-female coupling. FIG. 21 illustrates the rod 1922 (with an attached square element 1923) attaching to triangular panel element 202 via the male-female coupling. FIG. 22 illustrates the large-scale rod element 1932 attaching to triangular panel element 202 via the male-female coupling.

The male-female coupling can also provide means for strengthening a three-dimensional construction. For example, a cube made from six square panel elements 352 of FIGS. 3E-3I (and eight ferromagnetic balls) would have center portions 354 aligned opposite each other, on opposing sides of the cube. An appropriately sized rod could be inserted into or through a pair of these opposing center portions 354 to strengthen the cube construction.

The female couplings shown in FIGS. 19A and 19B can comprise a round sleeve having a diameter slightly larger than the diameter of the male couplings it accepts, so as to provide a tight interference fit that does not require a magnetic coupling. The mechanical female and male couplings can, for example, include cooperative projections and recesses to provide a snap fit. Thus, by press fitting the parts together, the present invention enables a user to build off of elements in new directions, providing the ability to attach special parts such as flags.

In a further embodiment, as shown in FIGS. 2E-2G and FIGS. 3E-3H, a female coupling can include ribs 270 that protrude into an opening or recess to promote an interference fit with a male coupling. In this example, ribs 270 are four ribs spaced equally around the circular opening (e.g., at 90 degree intervals), running longitudinally along the sides of the opening.

In FIGS. 2E-2I and 3E-3I, although some of recesses or openings 264 are non-circular, the recesses or openings 264 could be circular (as is the center opening 264) or any other shape necessary to couple to a cooperative male coupling. For example, referring to FIG. 3E, an opening 264 defined by a center portion 354, an arm 355*a*, a perimeter member 355*b*, and a magnet housing 356 could be shaped as a circle and sized to receive a correspondingly sized rod. As another example, a recess 264 defined in magnet housing 356 could be shaped as a circle and sized to receive a correspondingly shaped sized rod. Thus, notwithstanding the benefits of the particular shapes and sizes of recesses and openings shown in the figures, this feature of the present invention should be considered broadly applicable to any openings or recesses necessary to cooperate with male couplings of complementary sizes and shapes.

In a further embodiment, such complementary male couplings are provided on closure panels that are configured to cover a face of panel elements 252 and 352. For example, FIGS. 20B-20E illustrate a closure panel 2002 adapted to connect to panel element 252. Male coupling 2004 of closure panel 2002 fits inside center portion 254 of panel element 252. Male coupling 2004 can include cutouts 2006 that allow the male coupling to flex slightly when entering the opening of center portion 254, to provide a tight interference fit against the inside walls of center portion 254, in this case against ribs 270. Male coupling 2004 and panel element 252 could also have detents, bumps, flanges, or other complementary structural features that enable the male coupling to snap into place.

FIGS. 20F-20I illustrate another closure panel 2012, this one sized and shaped to connect to panel element 352. Male coupling 2014 of closure panel 2012 fits inside center portion 354 of panel element 352. Male coupling 2014 can include cutouts 2016 that allow the male coupling to flex slightly when entering the opening of center portion 254, to provide a tight interference fit against the inside walls of center portion 354, in this case against ribs 270. Male coupling 2014 and panel element 352 could also have detents, bumps, flanges, or other complementary structural features that enable the male coupling to snap into place.

Figure 20K:
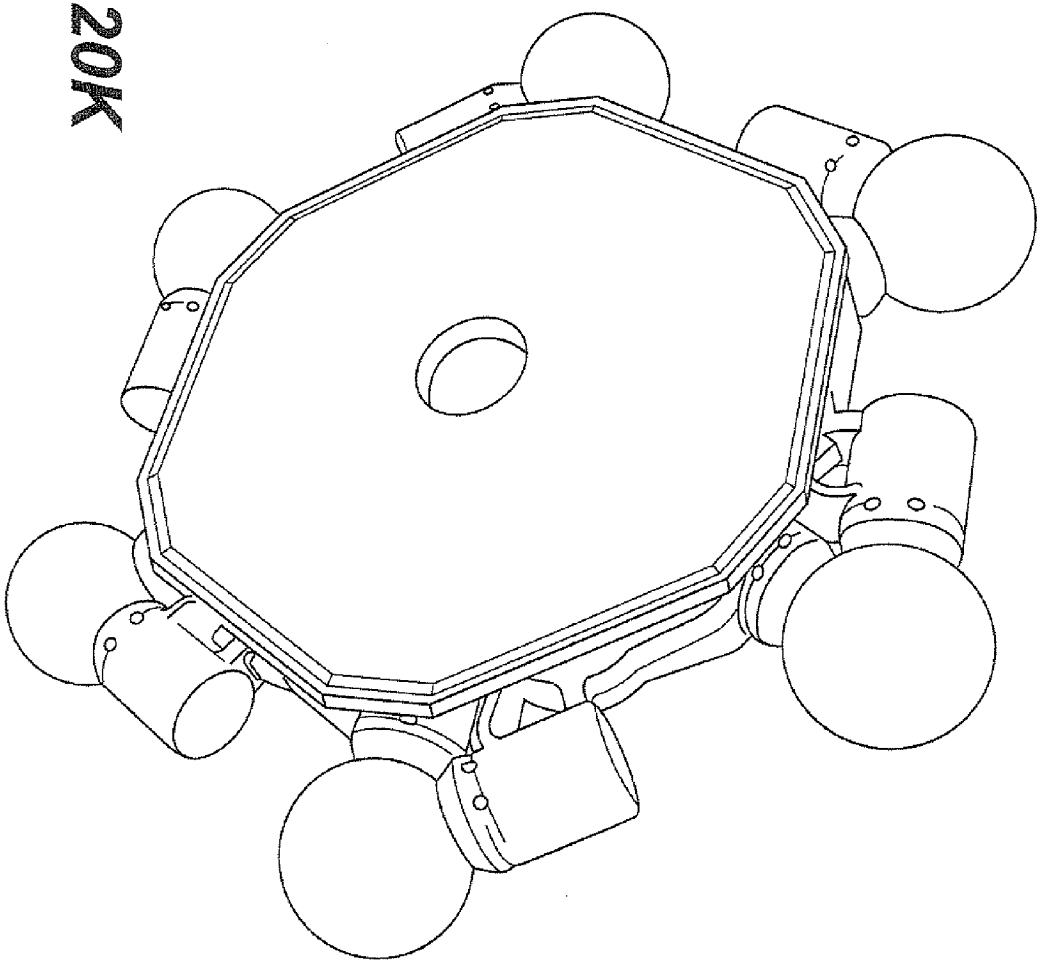
Figure 20L:
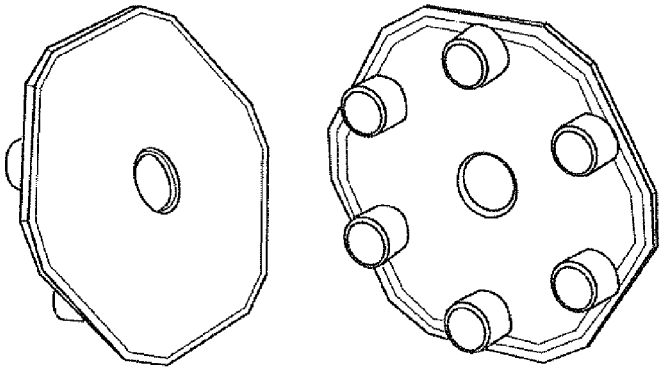
Figure 20M:
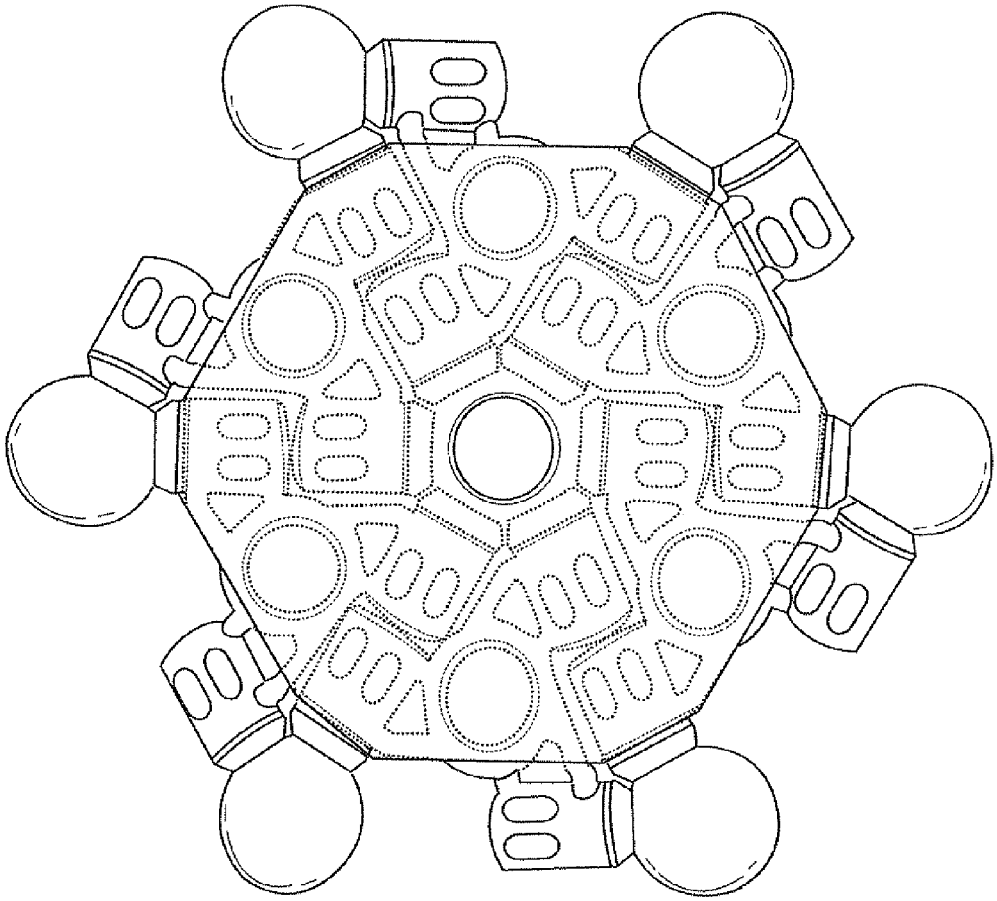
Figure 20N:
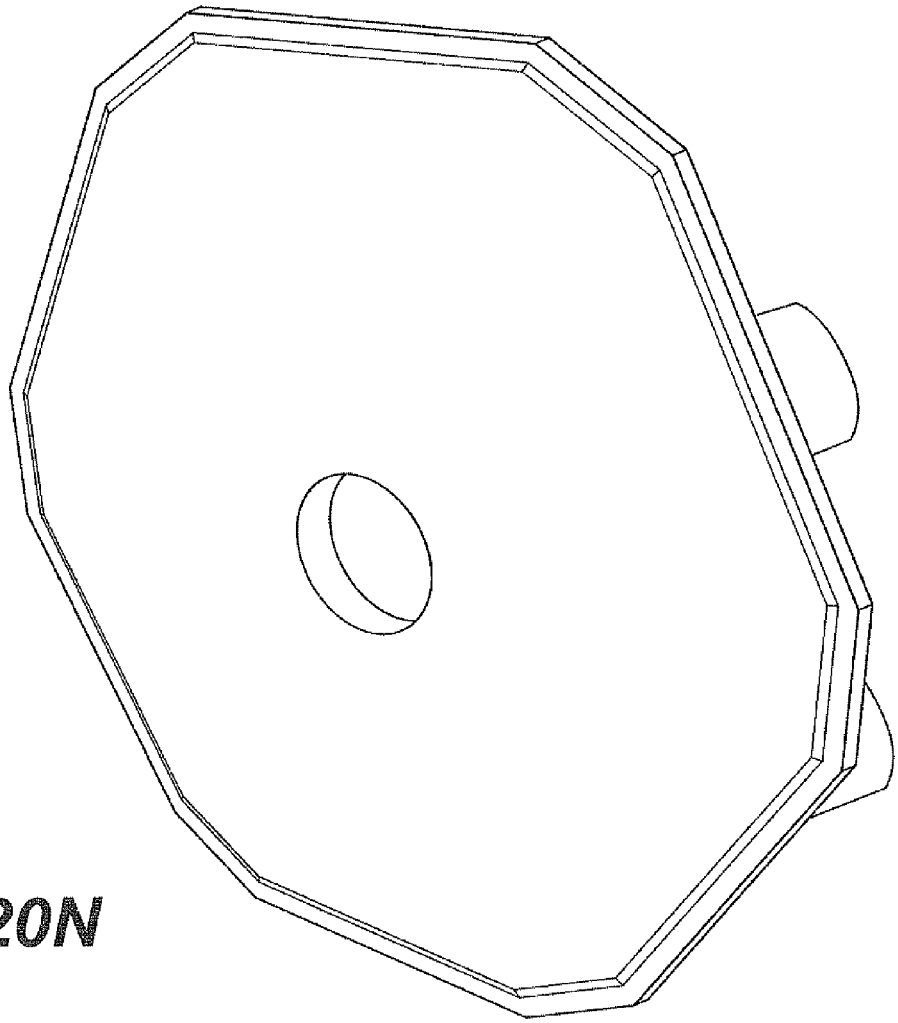

FIGS. 20J-20N illustrate an exemplary hexagonal closure panel 2022, according to an embodiment of the present invention. As shown, hexagonal closure panel 2022 can have six prongs on its underside, which can fit into a six triangular element assembly (FIGS. 20K and 20M). The panel 2022 can be made of 0.06 inch shelled ABS plastic, and can be approximately 2.35×2.25×0.35 inches.

Triangular panel element 1912 and closure panels 2002, 2012, and 2022 can enhance the appearance of a magnetic construction assembly by closing the structure and simulating, for example, solid walls and roofs. These elements can also provide additional surfaces off of which to extend the construction. For example, if the elements are made of a ferromagnetic materials such as tin, then magnetic rods or other magnetic elements could be coupled to the faces of the elements. As another example, the outer faces of closure elements could include studs or projections to which additional construction element could be attached.

In an embodiment of the present invention, a panel element, such as elements 252 and 352, could be convex so that a closure panel attached to the panel element is disposed in the cavity of the convex contour. In this manner, the outer face of the closure panel could be essentially flush with outer perimeter of the panel element, to provide the appearance of a closed, flat wall, for example.

A further embodiment of the present invention provides an electronic magnetic construction kit that includes magnetic construction elements that conduct electricity in addition to magnetically coupling with other construction elements. The conductive magnetic elements can include integral electronic components that enhance the functionality and aesthetic appeal of a toy construction. For example, conductive magnetic elements can include lights, sound or audio modules, or moving parts such as motors, propellers, or gears. In conducting electricity, the conductive magnetic elements can form part of a circuit that is energized by a power source, such as a battery. The electricity from the power source activates the electronic components that are within the conductive magnetic elements of the circuit.

One exemplary electronic magnetic construction kit includes a powered base plate, conductive elements, and conductive electronic elements. The powered base plate includes a power source and a plurality of conductive poles on which a construction assembly can be built. The conductive poles include positive and negative poles. When an assembly is properly connected to a positive and negative pole of the base plate, electricity flows through the assembly and powers the electronic components in the various conductive electronic elements.

Figure 23:
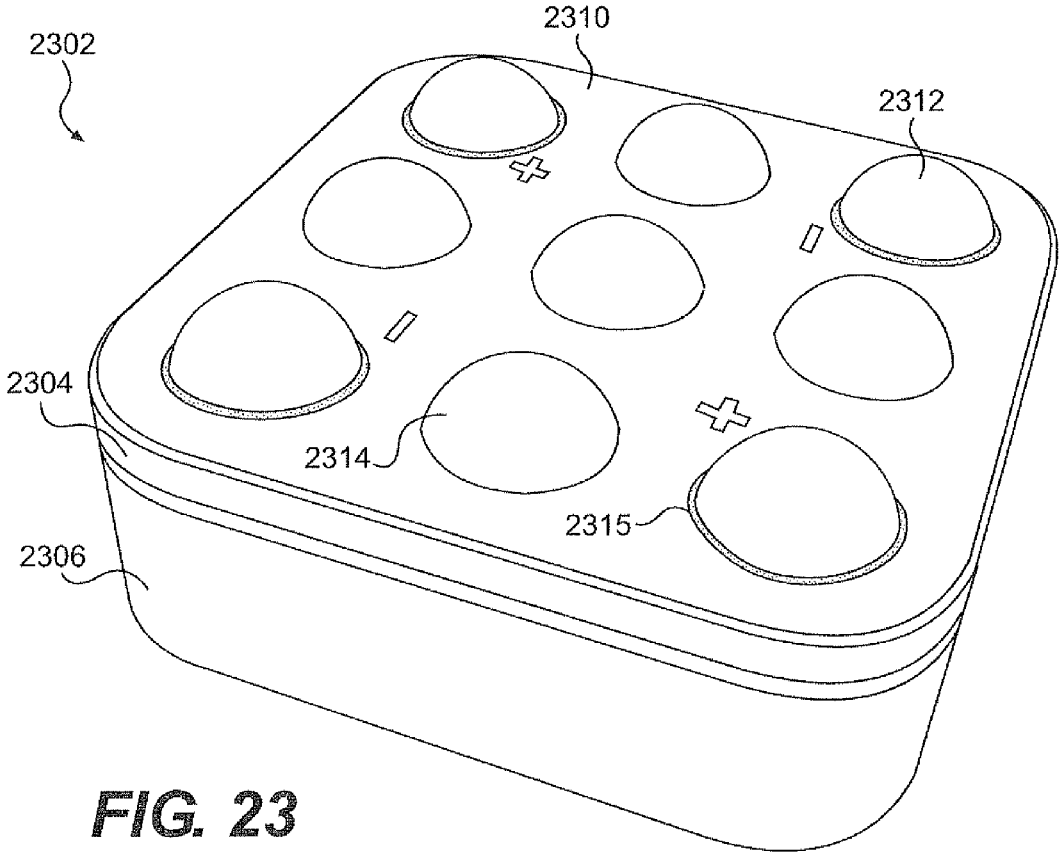
FIG. 23 is a schematic diagram of a perspective view of a powered base plate, according to an embodiment of the present invention.
Figure 24:
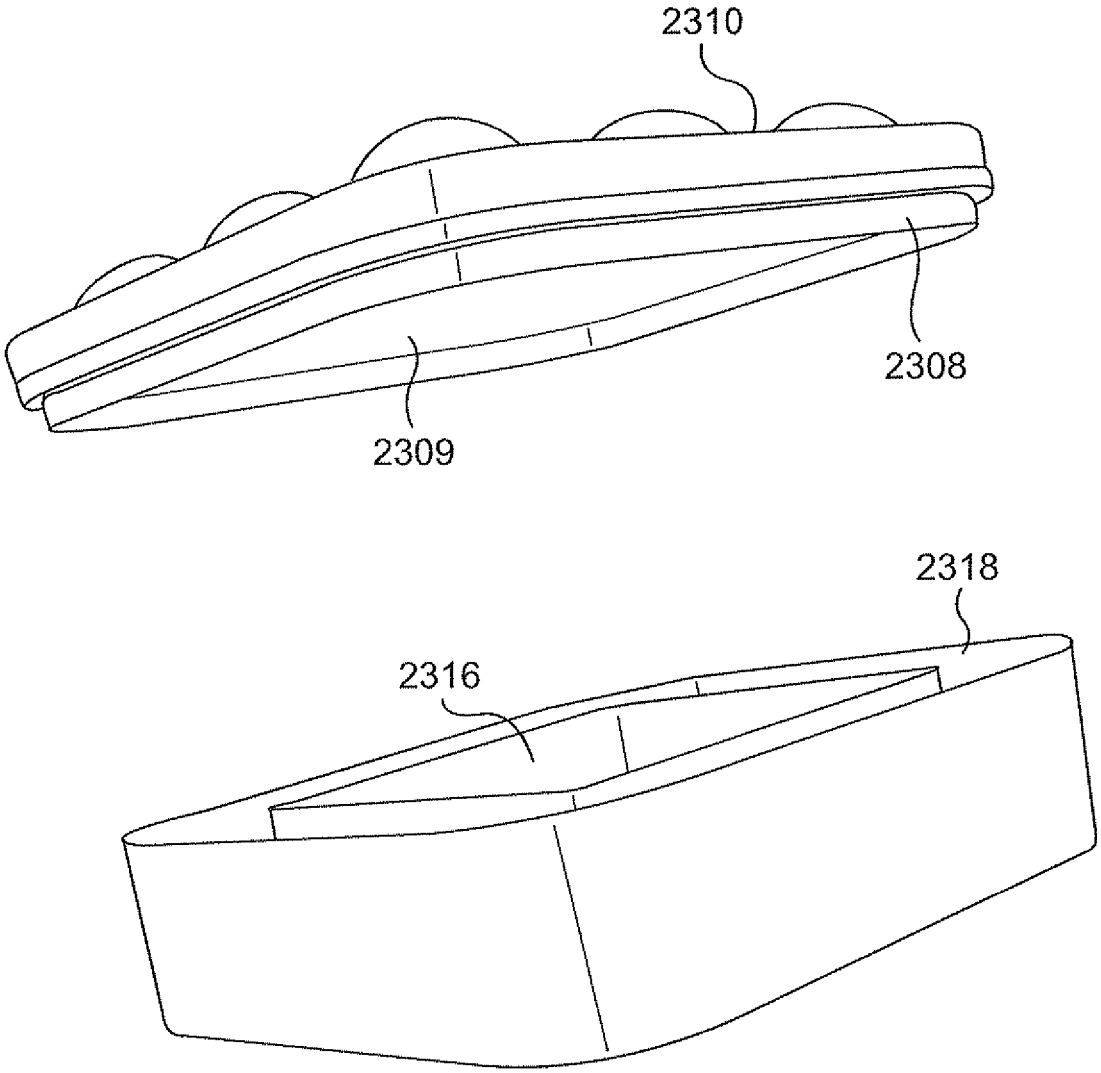
FIG. 24 is a schematic diagram of the powered base plate of FIG. 23, with the storage container removed.

FIGS. 23 and 24 illustrate a powered base plate 2302 according to an embodiment of the present invention. As shown, powered base plate 2302 comprises a powered building platform 2304 and a storage container 2306. Powered building platform 2304 includes an inner wall 2308 on one side and a conductive ferromagnetic surface 2310 on its opposite side. The inner wall 2308 can be made of plastic (e.g., ABS) and include a battery compartment 2309. The conductive ferromagnetic surface 2310 can include positive and negative poles to which a magnetic construction assembly can be magnetically coupled and powered. The conductive ferromagnetic surface 2310 can be, for example, an embossed tin plate with electrically isolated conductive metal ball portions 2312 and nonconductive metal ball portions 2314. In this example, two conductive metal ball portions 2312 are negative poles and two are positive poles, with the five remaining metal ball portions being nonconductive. The conductive ferromagnetic surface 2310 can also have indicia 2315 (e.g., a colored line around a ball portion) to indicate which ball portions are conductive and which of the conductive ball portions are positive (indicated by a "+") or negative (indicated by a "−").

The powered building platform 2304 can serve as a lid to the storage container 2306. Storage container 2306 can include partitioned compartments for holding construction elements in segregated groups of like elements. For example, a center compartment 2316 can hold ferromagnetic balls and an outer compartment 2318 can hold magnetic rods.

Figure 25:
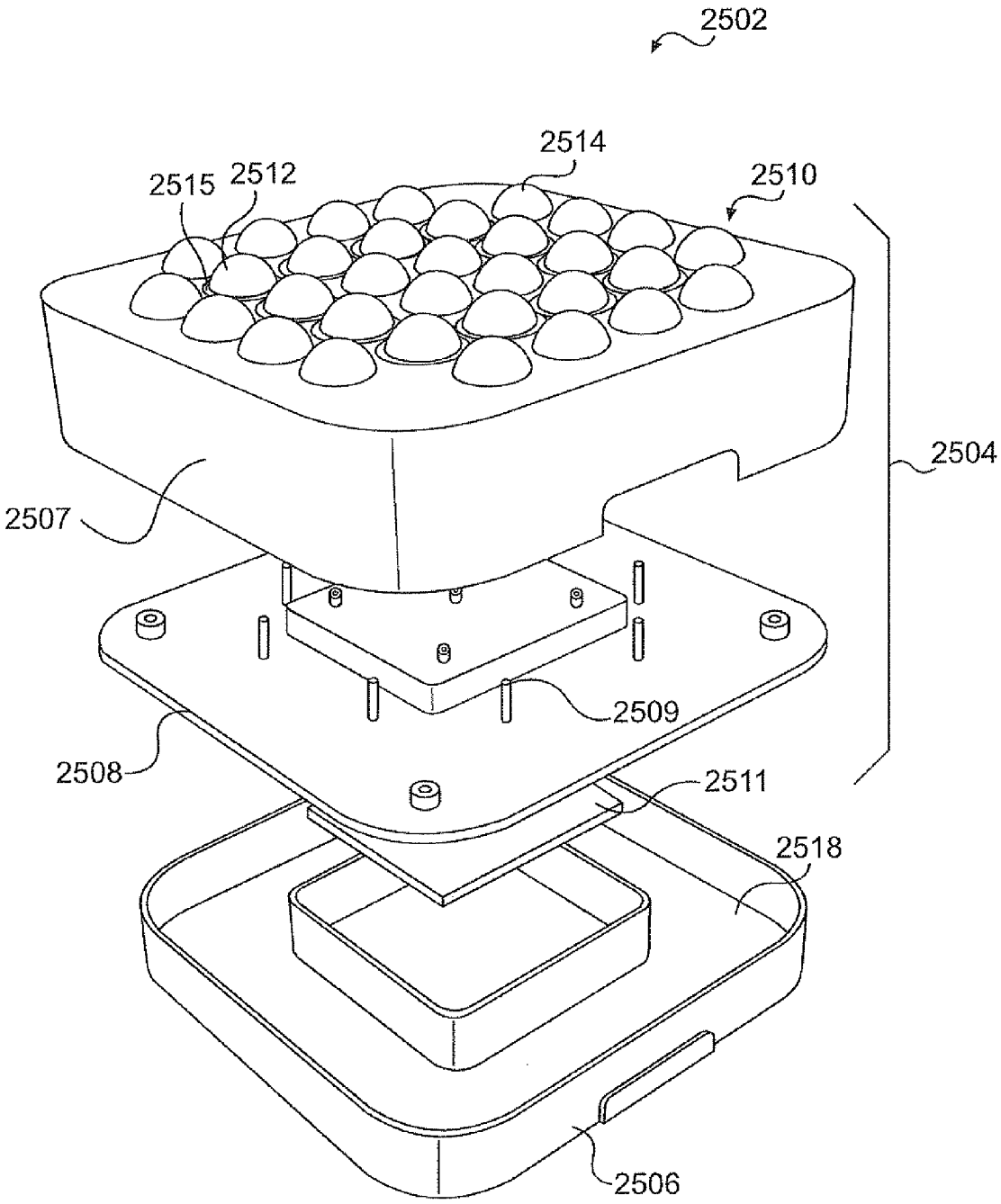
FIG. 25 is a schematic diagram of an exploded perspective view of a powered base plate, according to another embodiment of the present invention.

FIG. 25 illustrates an exploded view of a powered base plate 2502 according to another embodiment of the present invention. Compared to the powered base plate 2302 of FIGS. 23 and 24, powered base plate 2502 provides a larger building surface area and more ball portions on which to build electronic magnetic assemblies. As shown, powered base plate 2502 comprises a powered building platform 2504 and a storage container 2506. Powered building platform 2504 includes an inner wall 2508 on one side and a conductive ferromagnetic building surface 2510 on its opposite side. In this example, building surface 2510 comprises a housing 2507 (e.g., made of ABS plastic) having openings through which ferromagnetic ball portions and conductive ferromagnetic ball portions project. The ball portions could be formed as separate metal half balls or could be formed together as a monolithic piece, for example, an embossed tin panel, provided the conductive poles (described below) are electrically isolated from each other. The inner wall 2508 can be made of plastic (e.g., ABS) and include a battery compartment 2509 with a battery door 2511.

The conductive ferromagnetic building surface 2510 can include positive and negative poles to which a magnetic construction assembly can be magnetically coupled and powered. The conductive ferromagnetic building surface 2510 can be, for example, an embossed tin plate having openings through which conductive metal ball portions 2512 and nonconductive metal ball portions 2514 project. The conductive ferromagnetic building surface 2510 can also have indicia 2515 (e.g., a colored line around a ball portion) to indicate which ball portions are conductive and which of the conductive ball portions are positive (indicated by a "+") or negative (indicated by a "–").

The powered building platform 2504 can serve as a lid to the storage container 2506. Storage container 2506 can include partitioned compartments for holding construction elements in segregated groups of like elements. For example, a center compartment 2516 can hold ferromagnetic balls and an outer compartment 2518 can hold magnetic rods. Storage container 2506 can be made of translucent ABS.

Figure 26:
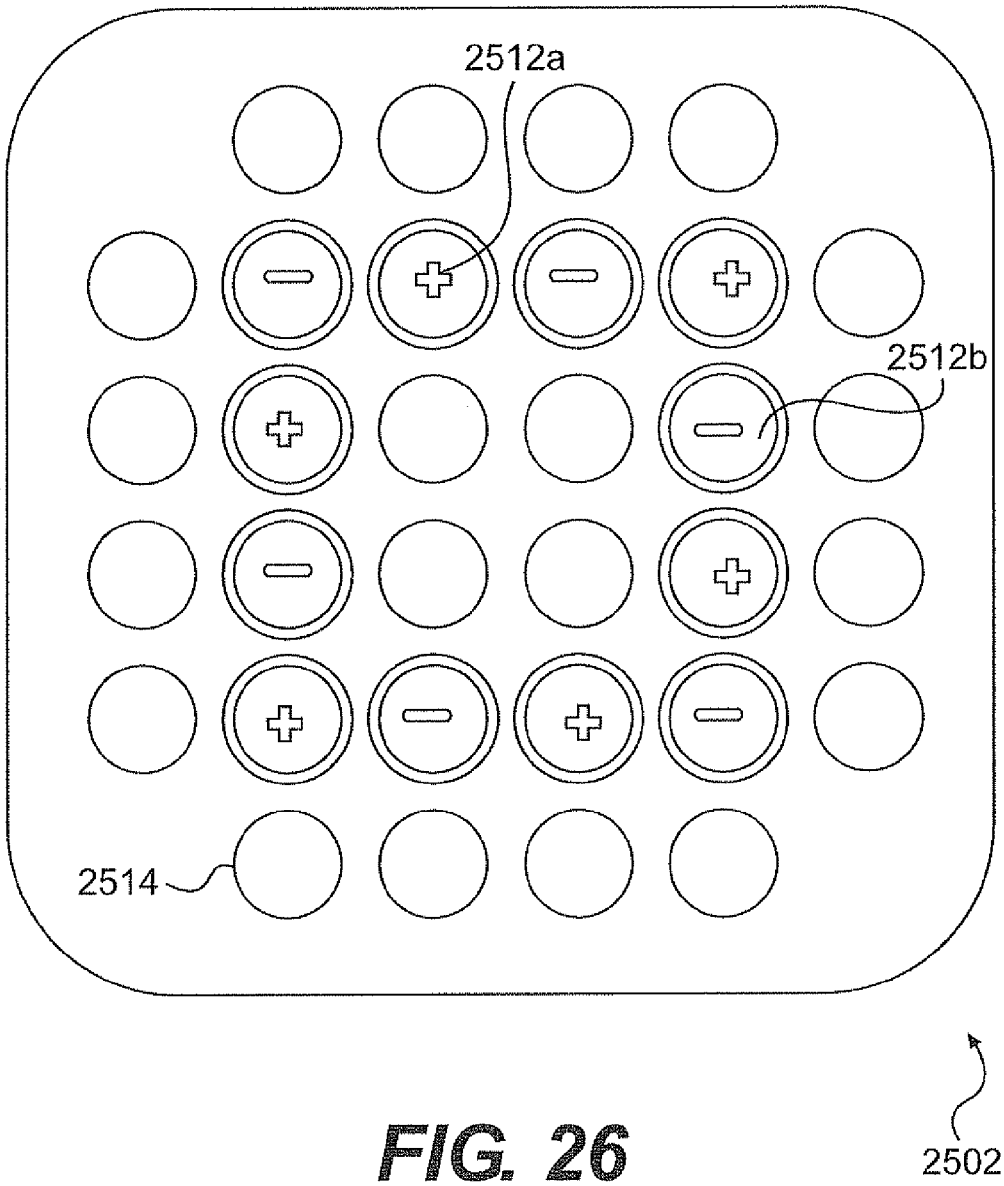
FIG. 26 is a schematic diagram of a plan view of a conductive ferromagnetic building surface, according to an embodiment of the present invention.

FIG. 26 illustrates a plan view of the conductive ferromagnetic building surface 2510 according to an embodiment of the present invention. In this example, surface 2510 includes six positive pole conductive ferromagnetic ball portions 2512*a* and six negative conductive ferromagnetic ball portions 2512*b*, all of which are connected to a power source (not shown), such as a battery. The remaining ball portions are nonconductive metal ball portions 2514, which are not connected to a power source, but which can magnetically couple to magnetic parts. In one embodiment, the ball portions 2512*a*, 2512*b*, and 2514 have a satin chrome finish.

Figure 27:
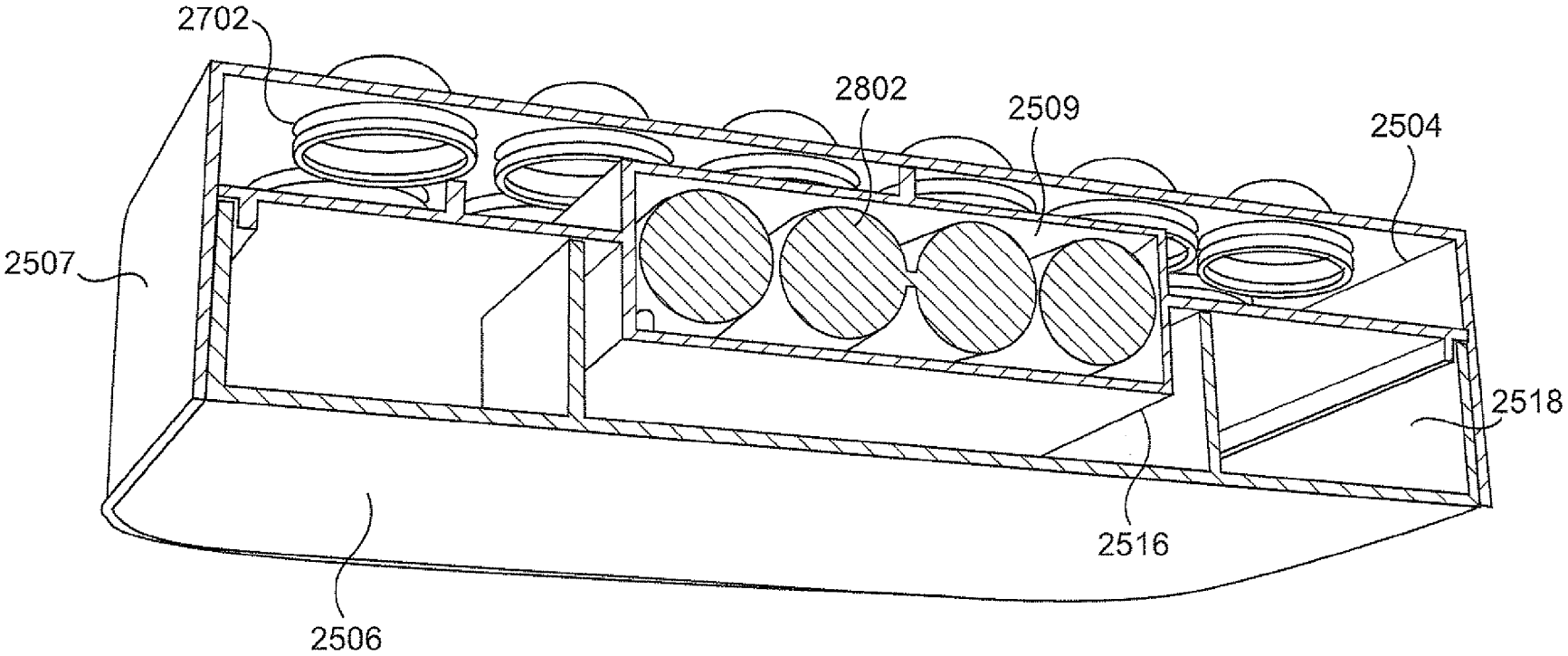
FIG. 27 is a schematic diagram of a cross sectional view of a powered base plate, according to an embodiment of the present invention.
Figure 28:
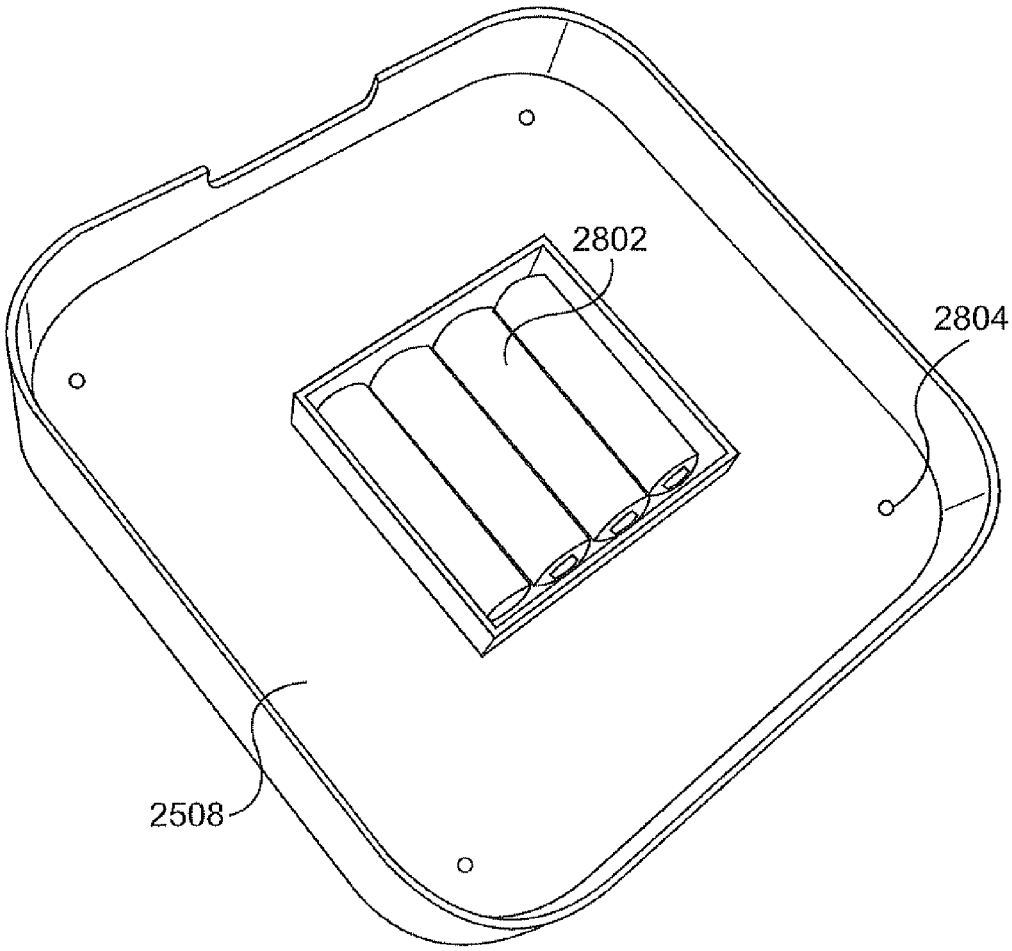
FIG. 28 is a schematic diagram of a perspective view of the inner wall of a powered building platform, according to an embodiment of the present invention.

FIG. 27 illustrates a cross-section of powered base plate 2502, according to an embodiment of the present invention. As shown, the storage container 2506 nests inside of powered building platform 2504, with the platform 2504 acting as lid over compartments 2516 and 2518. The cross-section of FIG. 27 also shows an example of how the metal half balls can be fastened to the housing 2507, in this case using flanges 2702 to adhere to the inside of the housing 2507, with balls projecting through the openings in the housing 2507. In addition, in one embodiment, the battery compartment 2509 accommodates four AA batteries 2802, as shown in FIGS. 27 and 28. The inner wall 2508 can include screw holes 2804 to affix the inner wall 2508 to housing 2507, as shown in FIG. 28.

Figure 29:
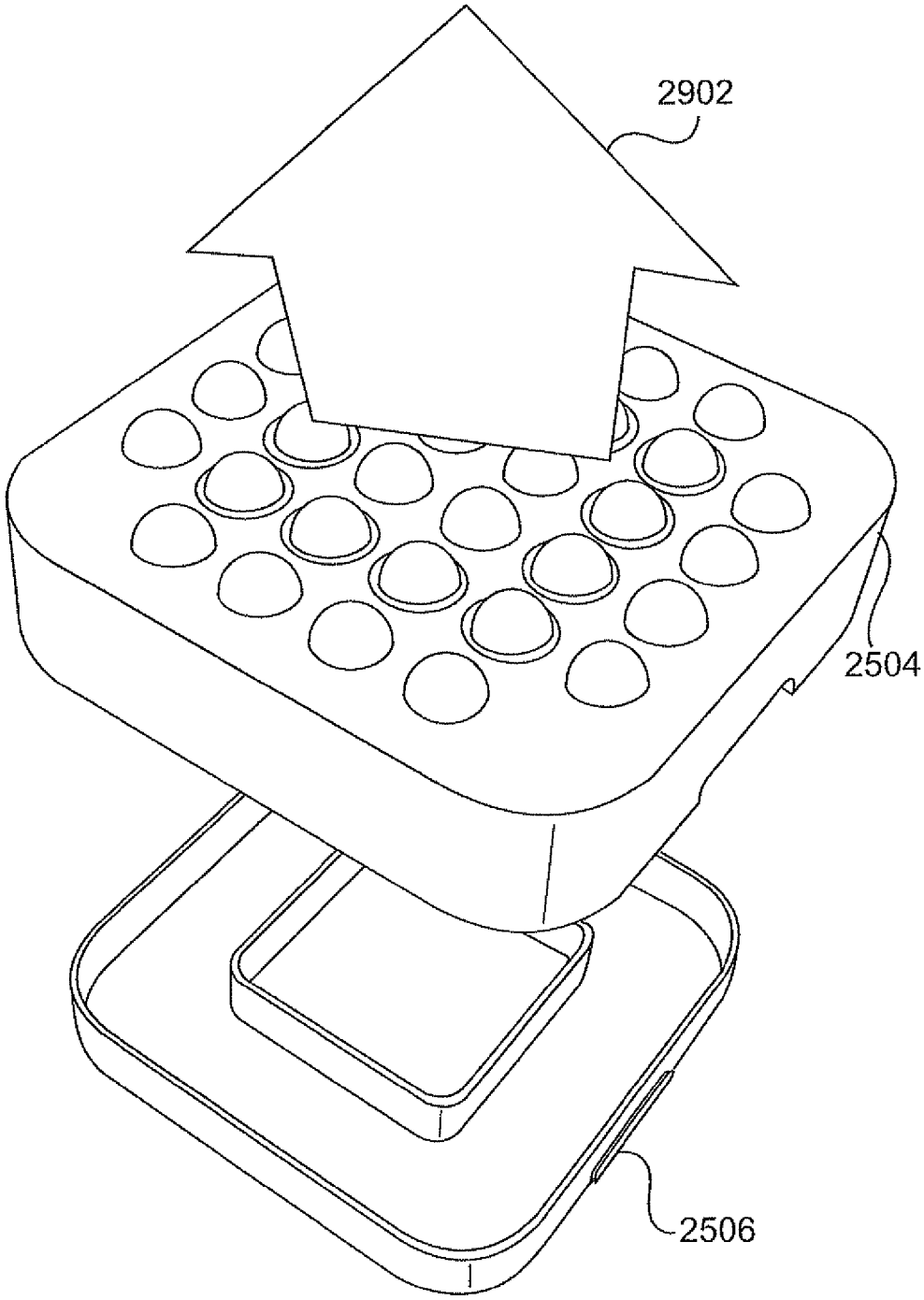
FIG. 29 is a schematic diagram illustrating an exemplary operation of the powered base plate, according to an embodiment of the present invention.

FIG. 29 illustrates an exemplary operation of the powered base plate 2502, according to an embodiment of the present invention. In one implementation, when the storage container 2506 is attached to the powered building platform 2504, the circuit power is off and no electricity is conducted to the conductive ferromagnetic ball portions. As represented by the arrow 2902, when the powered building platform 2504 is separated from the storage container 2506, the circuit power is on, with power available to the positive and negative poles of the conductive ferromagnetic ball portions.

Figure 30:
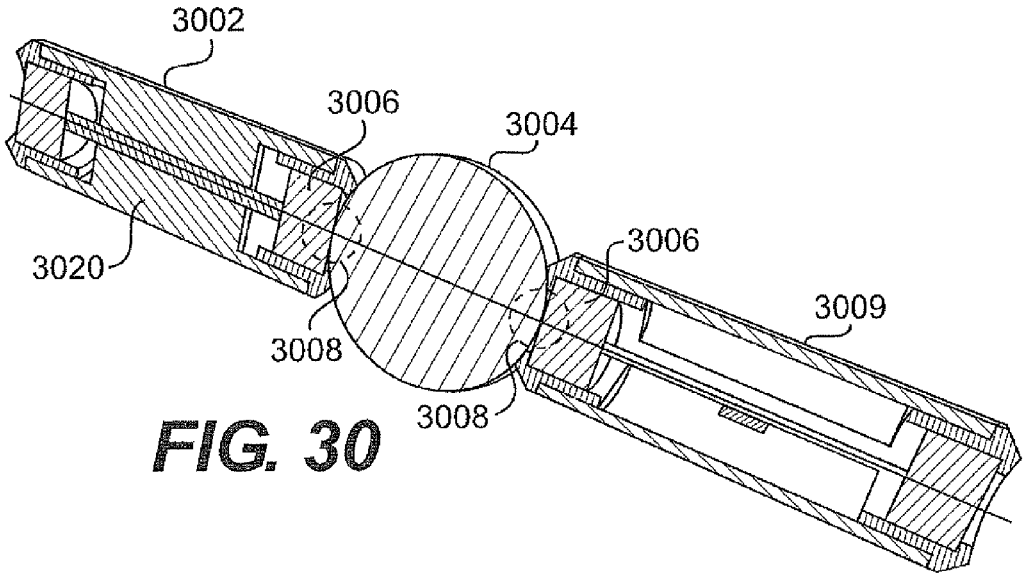
FIG. 30 is a schematic diagram illustrating exemplary conductive and conductive-electronic elements joined together to conduct electricity and form part of a construction assembly attached to and powered by a powered base plate, according to an embodiment of the present invention.

As described above, a powered base plate, such as plate 2302 and plate 2502 of FIGS. 23 and 25, respectively, can power construction assemblies made of conductive elements and conductive electronic elements, when the elements are properly connected to the poles of the powered base plate. FIG. 30 illustrates exemplary conductive and conductive-electronic elements joined together to conduct electricity and form part of a construction assembly attached to and powered by a powered base plate. In this example, electricity flows through conductive magnetic rod 3002, conductive ferromagnetic ball 3004, and conductive electronic magnetic rod 3009. Rods 3002 and 3004 include magnets 3006 that magnetically couple the rods to the ball 3004 and ensure contact between the elements (as represented by the circles 3008) to provide a continuous electrical path. Attaching the ends of the rods opposite the ball 3004 to a positive and negative pole of a powered base plate (either directly or through other conductive elements) provides a powered continuous electrical circuit that activates the connected electronic components.

Figure 31A:
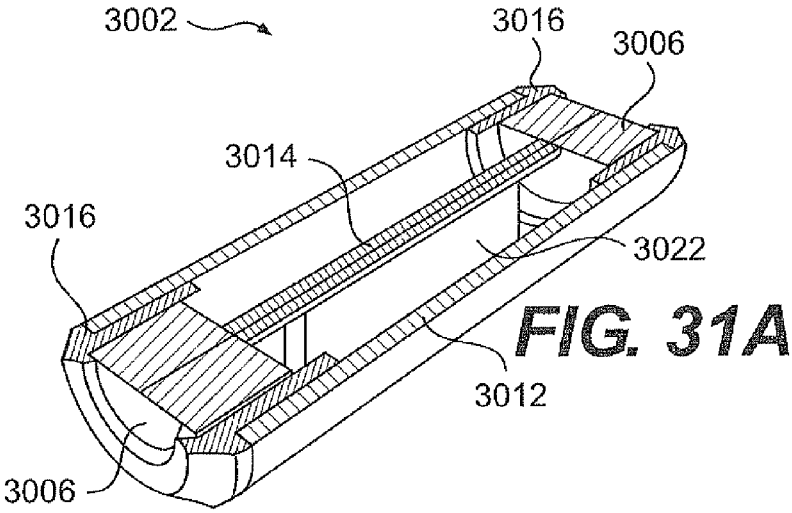
FIGS. 31A-31C are schematic diagrams that illustrate the construction of a conductive magnetic rod, according to an embodiment of the present invention.
Figure 31C:
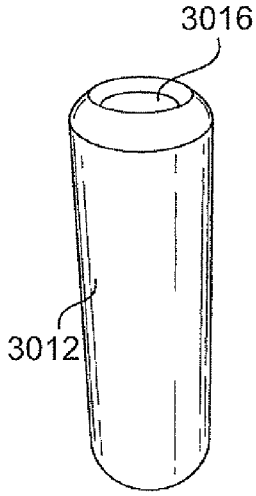
Figure 31B:
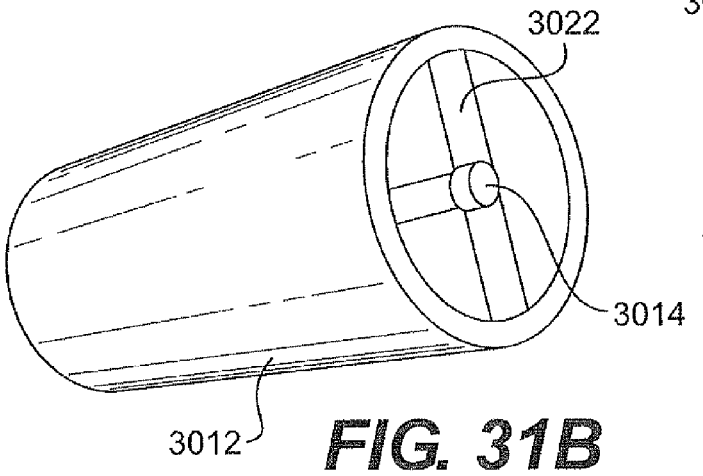

FIGS. 31A-31C illustrate the construction of a conductive magnetic rod 3002, according to an embodiment of the present invention. As shown, conductive magnetic rod 3002 includes a housing 3012, a conductor 3014, magnets 3006, and magnet caps 3016. Conductor 3014 is disposed in an intermediate portion of housing 3012 and is held in place, for example, by insert molding the conductor within a solid intermediate portion 3020 of housing 3012 (as shown in FIG. 30) or by positioning the conductor between fins 3022 formed on the interior of housing 3012 (as shown in FIGS. 31A and 31B). Conductor 3014 contacts magnets 3006 disposed proximate to the ends of housing 3012 so as to provide a continuous electrical path through the rod 3002. Magnet caps 3016 hold the magnets 3006 within the rod 3002 and help ensure contact between magnets 3006 and conductor 3014. Magnet caps 3016 can be glued to housing 3012, for example. In addition to conducting electricity, conductor 3014 may or may not also be magnetically conducting. For example, conductor 3014 could be made of copper or aluminum, which conduct electricity but are not magnetically conductive.

Figure 32A:
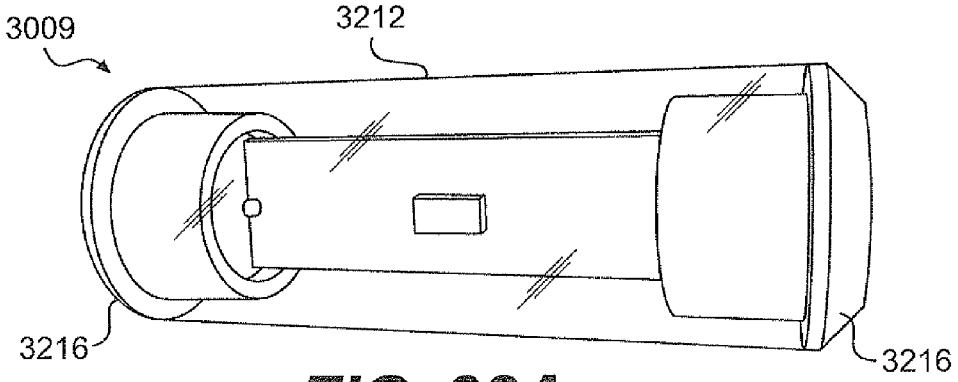
FIGS. 32A-32C are schematic diagrams that illustrate the construction of a conductive electronic magnetic rod having electronic components such as a light module, according to an embodiment of the present invention.
Figure 32B:
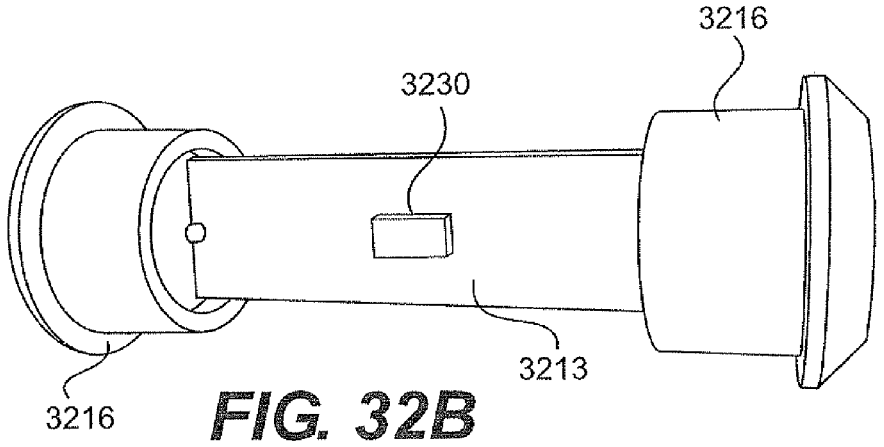
Figure 32C:
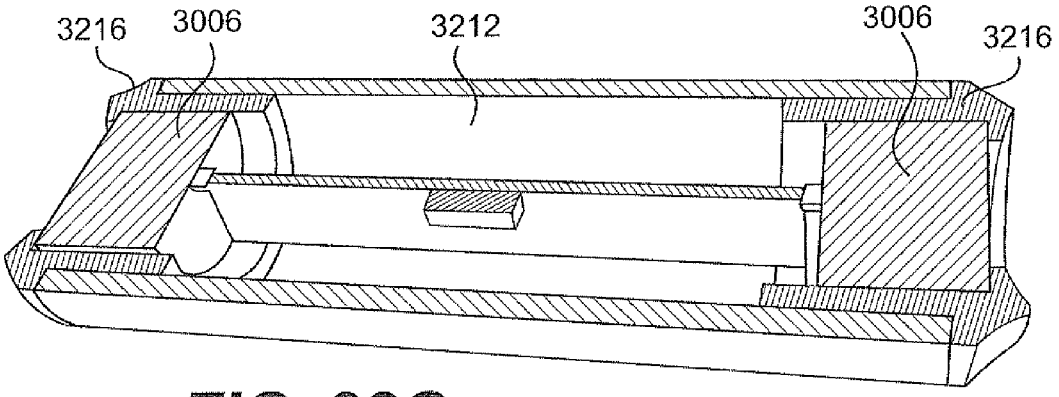

FIGS. 32A-32C illustrate the construction of a conductive electronic magnetic rod 3009 having electronic components, according to an embodiment of the present invention. As shown, conductive magnetic rod 3009 includes a housing 3212, a printed circuit board (PCB) 3213, magnets 3006, and magnet caps 3216. PCB 3213 is disposed in an intermediate portion of housing 3212 and is held in place, for example, by gluing it to the housing 3212 or mounting it on supports in the interior of the housing 3212. PCB 3213 is electrically coupled to magnets 3006 disposed proximate to the ends of housing 3212 so as to provide a continuous electrical path through the rod 3009. The PCB 3213 and magnets 3006 can be electrically coupled, for example, by soldering them together or by inserting an electrically conductive compressed spring in between the components. Magnet caps 3216 hold the magnets 3006 within the rod 3009 and can help ensure contact between magnets 3006 and PCB 3213. Magnet caps 3216 can be glued to housing 3212, for example. In addition to conducting electricity, PCB 3213 may or may not also be magnetically conducting.

PCB 3213 can include electronic components that activate when the rod 3009 is powered. For example, as shown in FIG.

32B, PCB 3213 can have a light emitting diode (LED) 3230 that continuously lights when powered. Alternatively, PCB 3213 could include other types of lights, sound or audio modules, or moving parts such as motors, propellers, or gears.

Figure 33A:
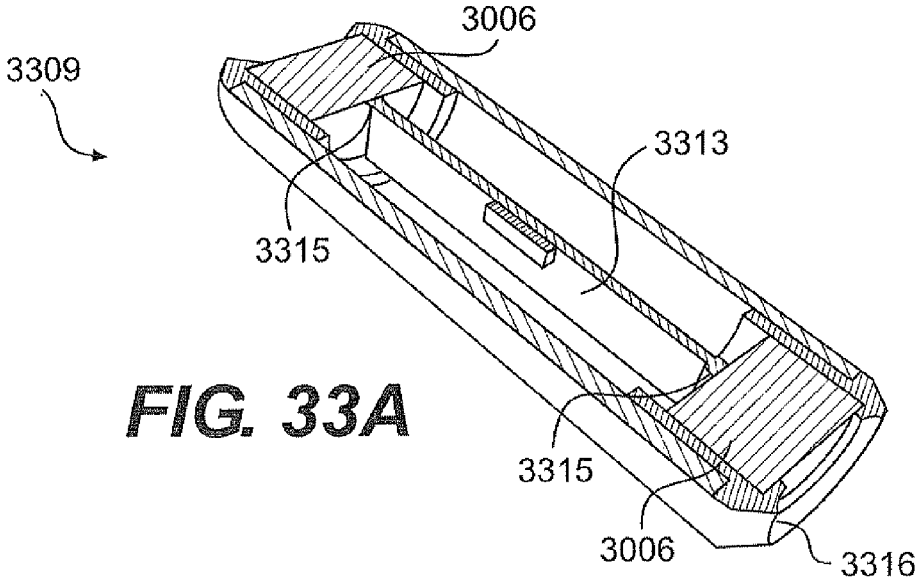
FIGS. 33A-33C are schematic diagrams that illustrate a conductive electronic magnetic rod having electronic control components, according to another embodiment of the present.
Figure 33B:
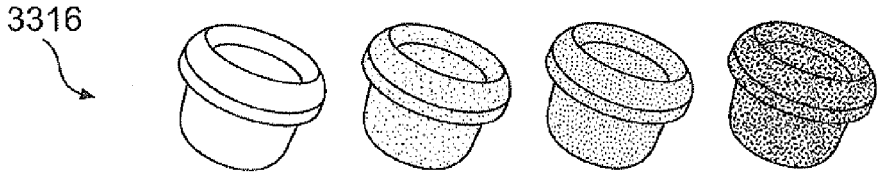
Figure 33C:
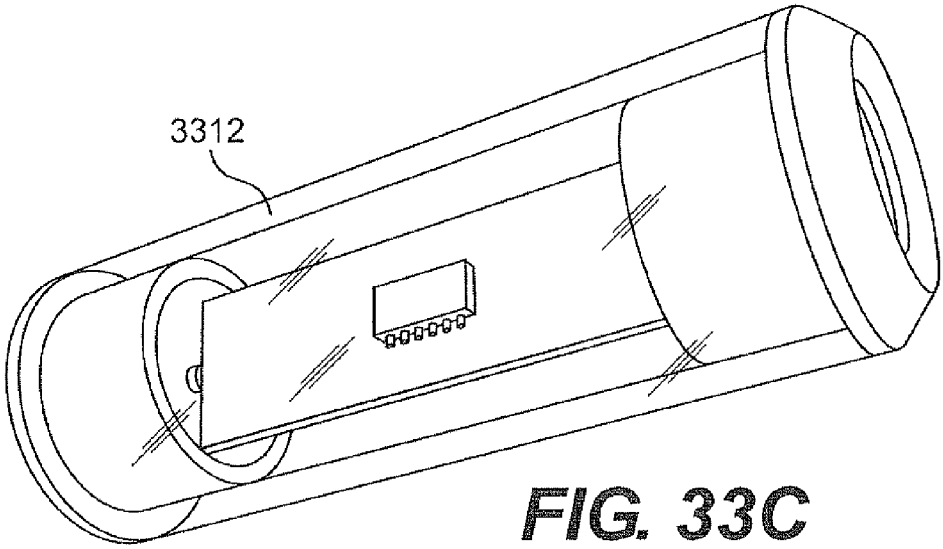

FIGS. 33A-33C illustrate a conductive electronic magnetic rod 3309 having electronic control components, according to another embodiment of the present invention. As shown, rod 3309 includes a housing 3312 in which a PCB 3313 and magnets 3006 are disposed and electrically coupled at points 3315. Magnet caps 3316 hold the magnets 3006 inside the rod 3309. Rod 3309 includes a PCB 3313 having electronic components that can control the flow of electricity and thereby control other conductive electronic elements to produce interesting special effects. As represented by the magnet caps 3316 of varying shades in FIG. 33B, the rod 3309 can have magnet caps 3316 that indicate (e.g., by coloring or indicia) what the special effect is. Such special effects can include, for example, a light flashing, a light glowing, or a random light pattern. In this manner, rod 3309 can be inserted into an electronically conducting construction assembly that includes another conductive electronic rod, such as rod 3009 of FIG. 32A. The control PCB 3313 of rod 3309 would then activate the LED 3230 of rod 3009 to produce the special effect, for example, causing the LED 3230 to flash. If rod 3309 is then removed from the assembly such that the circuit is continuously powered, the LED 3230 of rod 3009 would stop flashing and instead continuously light. Optionally, rod 3009 could itself include a desired control of the LED 3230, for example, providing an LED that flashes instead of being continuously illuminated.

The housings of the conductive electronic magnetic rods can be configured to accommodate the particular effect that the electronic component of a rod produces. For example, in the case of an electronic light component, the housing is preferably translucent or transparent. As another example, in the case of an audio electronic component, the housing preferably has openings through which sound can be emitted.

Figure 34A:
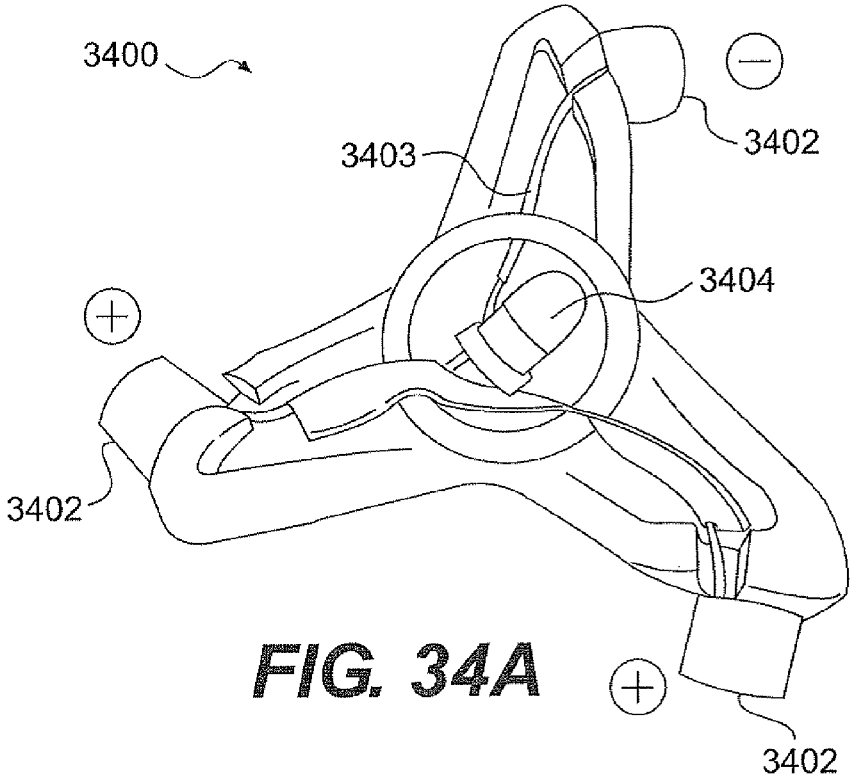
FIGS. 34A and 34B are schematic diagrams that illustrate a conductive electronic magnetic panel element, according to another embodiment of the present invention.
Figure 34B:
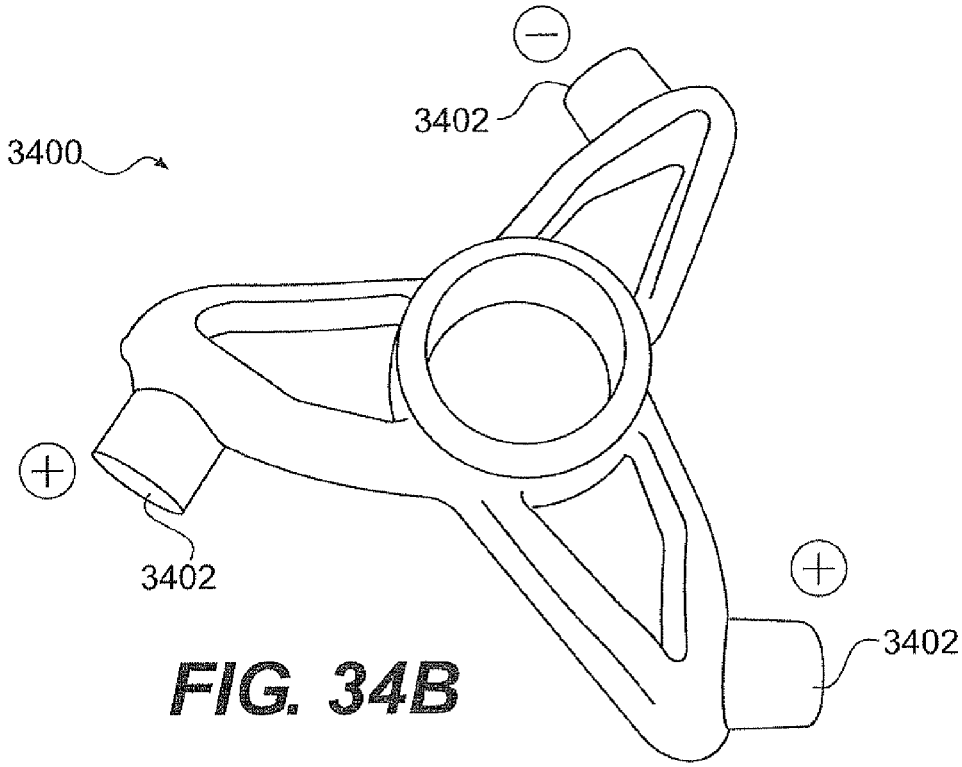

FIGS. 34A-34B illustrate a conductive electronic magnetic panel element 3400, according to another embodiment of the present invention. As shown, panel element 3400 includes three magnets 3402, with two providing a positive pole and one providing a negative pole. The three poles of magnets 3402 are connected together through wiring 3403 to conduct electricity. The three poles of magnets 3402 are also in electrical communication with an LED 3404 disposed at the center of the element 3400. The LED 3404 can be a flashing LED, for example. In an alternative embodiment, panel element 3400 can include only wiring (with no LED) and can simply conduct electricity to other components.

Figure 35C:
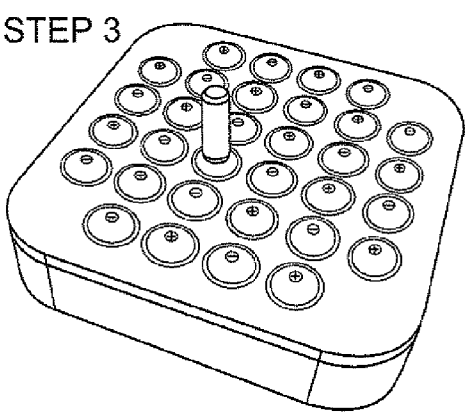
FIGS. 35A-35D are schematic diagrams that illustrate an exemplary method for assembling exemplary components of an electrically conductive magnetic construction assembly, according to an embodiment of the present invention.
Figure 35B:
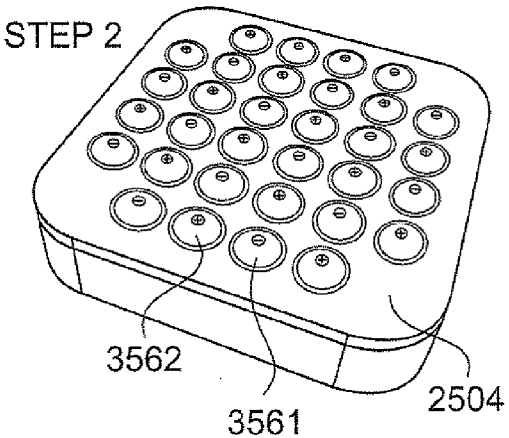
Figure 35A:
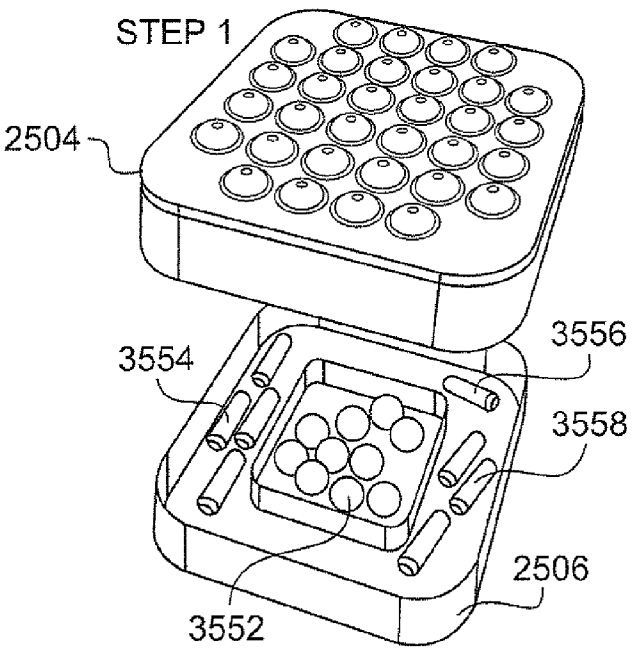

Having described exemplary components of an electrically conductive magnetic construction assembly, FIGS. 35A-35D illustrate an exemplary method for assembling such components. As shown in FIG. 35A, in step 1, a powered base plate 2502 is provided, which includes a powered building platform 2504 and a storage container 2506. The platform 2504 is removed from the storage container 2506 to enable access to the stored electrically conductive magnetic construction elements. In this example, the stored components include metal balls 3552, electrically conductive magnetic rods 3554 (also referred to as connect rods), electrically conductive magnetic rods having electronic light components 3556 (also referred to as light rods), and electrically conductive magnetic rods having electronic control components 3558 (also referred to as effects rods).

As shown in FIG. 35B, in step 2, powered building platform 2504 is activated, with its power on. Power can be supplied, for example, by batteries (e.g., four AA batteries) or by an AC power source. The powered building platform 2504 can be turned on using a manual switch (not shown) or automatically when the storage container 2506 is separated from the platform 2504. When turned on, powered building platform 2504 provides electricity to positive metal ball connectors 3560 and negative metal ball connectors 3561, as shown.

As shown in FIG. 35C, in step 3, electrically conductive magnetic construction elements are magnetically coupled to the powered building platform 2504. Initial elements are coupled directly to the platform 2504, with subsequent elements stacked on top of and magnetically and electrically coupled to the initial elements. The elements can include metal balls 3552, connect rods 3554, light rods 3556, and effects rods 3558.

Figure 35E:
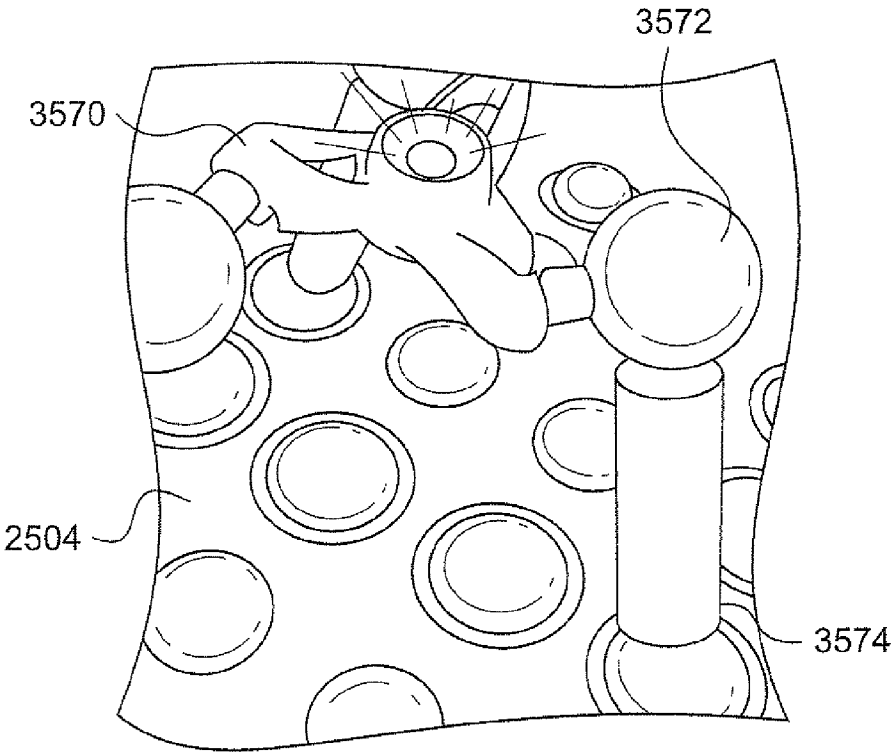
FIG. 35E is a schematic diagram that illustrates an electrically conductive magnetic construction using a conductive triangular panel element, according to an embodiment of the present invention.
Figure 35D:
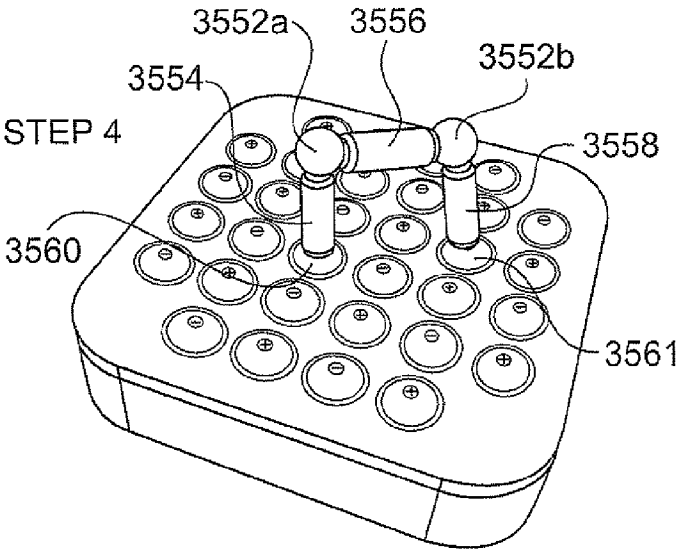

As shown in FIG. 35D, in step 4, an electrically conductive magnetic construction is assembled such that a closed circuit is established between the powered building platform 2504 and the electrically conductive magnetic construction elements. With the circuit closed, electricity flows from the power source (e.g., batteries) of the platform 2504, through metal ball connectors 3560 and 3561, and through the electrically conductive magnetic construction elements. In this example, a positive pole metal ball 3560 of the powered building platform 2504 is coupled to a connect rod 3554, the connect rod 3554 is coupled to a metal ball 3552*a*, the metal ball 3552*a* is coupled to a light rod 3556, the light rod 3556 is coupled to a second metal ball 3552*b*, the second metal ball 3552*b* is coupled to an effects rod 3558, and the effects rod 3558 is coupled to a negative pole metal ball 3561 of the powered building platform 2504. With the circuit complete, the light rod 3556 is powered and thereby illuminates. Depending on the type of the effects rod 3558, the light rod 3556 may, for example, flash, glow, or illuminate in a random pattern (e.g., with multiple multicolored LEDs). Adding more light rods can modify the light pattern.

FIG. 35E illustrates another electrically conductive magnetic construction, according to an embodiment of the present invention. In this example, a conductive electronic magnetic panel element 3570 (akin to element 3400 shown in FIGS. 34A-34B) is magnetically coupled to a powered building platform 2504 through metal balls 3572 and electrically conductive magnetic rods 3574. With the circuit complete, the LED of element 3570 illuminates.

As described above, an embodiment of the present invention provides conductive magnetic components and conductive electronic magnetic components that can be used to build a wide variety of electrically conductive construction assemblies. One skilled in the art would appreciate that the constructions could be assembled in any number of different circuit configurations to produce varying special effects. The skilled artisan would also appreciate that to effect the desired magnetic and electrical circuits, the positive and negative poles (both in terms of electricity and magnetism) need to be properly aligned. Properly sequenced poles enable the flow of electricity as well as maximum magnetic force and structural rigidity. In addition, in building assemblies and experimenting with different configurations, users can learn the principles of electricity and magnetism based on the feedback of the electronic components. In other words, when a construction assembly is properly coupled, the construction is sturdy by virtue of the magnetic couplings, and electrically conductive, as indicated by the activated electronic components (e.g., illuminated LEDs). In this manner, the components and construction kits of the present invention have broad applicability to construction toys, games, puzzles, and educational devices.

Figure 36C:
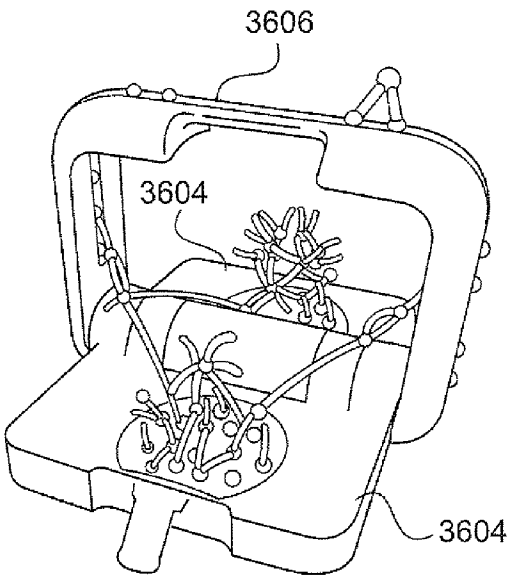
FIGS. 36A-36C are schematic diagrams that illustrate an exemplary travel case, according to an embodiment of the present invention.
Figure 36A:
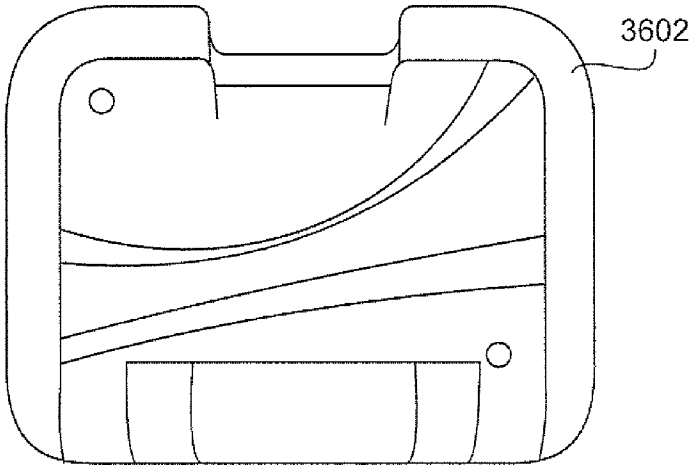
Figure 36B:
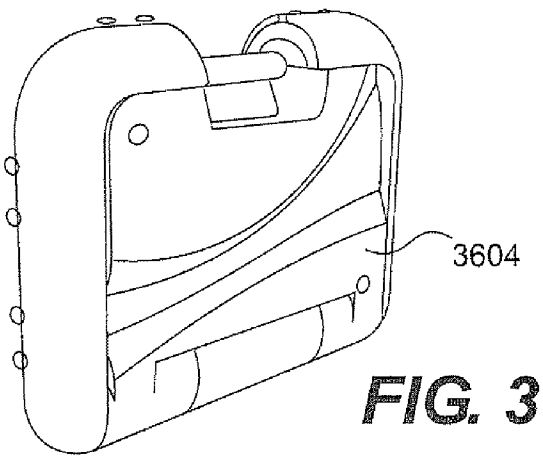

Further embodiments of the present invention provide alternative platforms on which to build magnetic construction assemblies. For example, FIGS. 36A-36C illustrate a travel case 3602 that opens up to provide a wide building platform. Each side panel 3604 of the case is pivotably mounted to a frame member 3606. The side panels pivot away from each other and lay in generally a single plane under the frame, as shown in FIG. 36C. The insides of the side panels provide building surfaces on which magnetic construction elements can be place. The frame member 3606 also includes building surfaces (e.g., metal balls) so that magnetic construction assemblies can span the entire area of the side panels and under the frame, as shown in FIG. 36C.

Figure 37A:
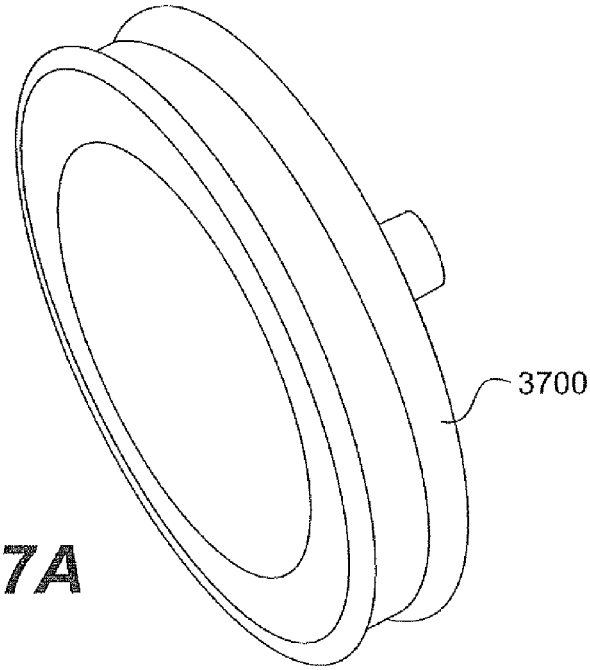
FIG. 37A is a schematic diagram that illustrates an exemplary wheel element, according to an embodiment of the present invention

FIG. 37A illustrates an exemplary wheel element 3700, according to an embodiment of the present invention. As shown, the wheel element 3700 is generally circular in shape and has an axle projection at its center. The axle projection can be shaped and sized to fit within a magnetic panel element, such as opening 364 of skeletal square panel element 352 (FIG. 3E). The axle projection can, for examples have a distal end that compresses to slide through an opening and expands to snap in place.

Figure 37B:
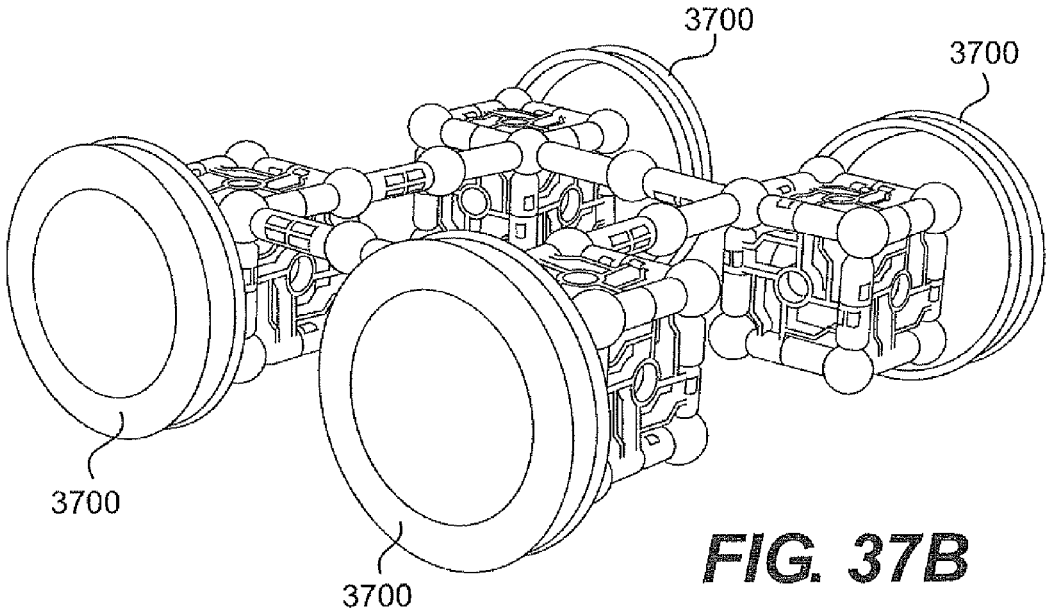
FIG. 37B is a schematic diagram illustrating an assembly of magnetic construction elements and wheel elements, according to an embodiment of the present invention.

FIG. 37B illustrates an assembly of magnetic construction elements and wheel elements (such as element 3700), according to an embodiment of the present invention. As shown, the assembly resembles a chassis and wheels of a vehicle.

Figure 38A:
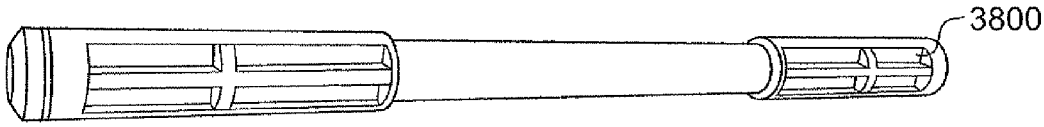
FIGS. 38A-38E are schematic diagrams illustrating a double axis construction element, according to an embodiment of the present invention.
Figure 38B:
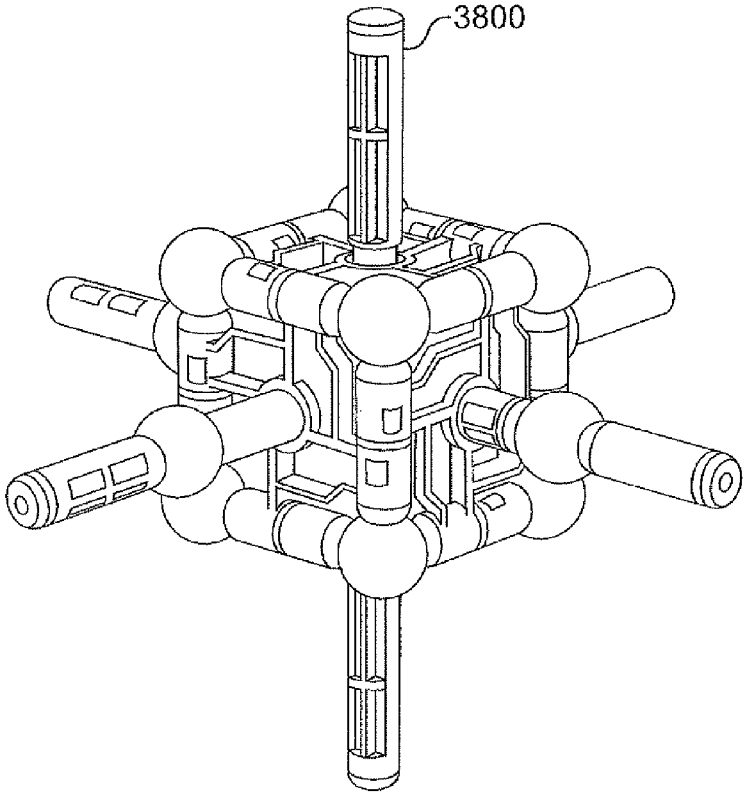
Figure 38C:
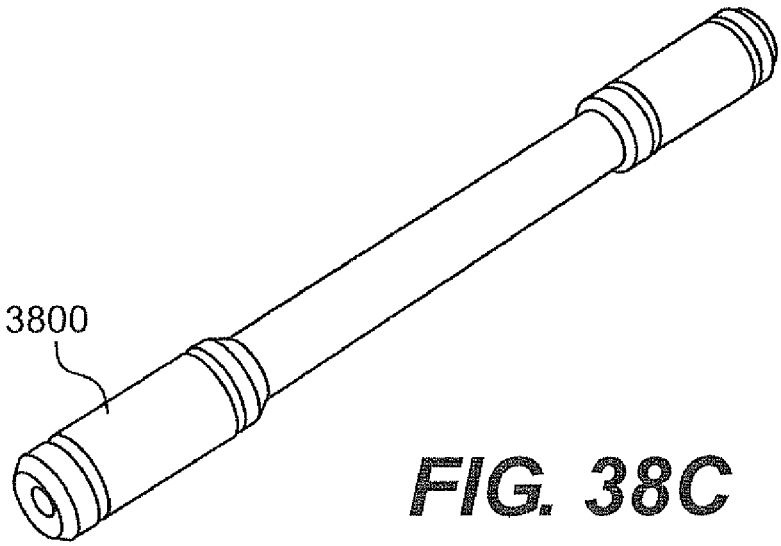
Figure 38D:
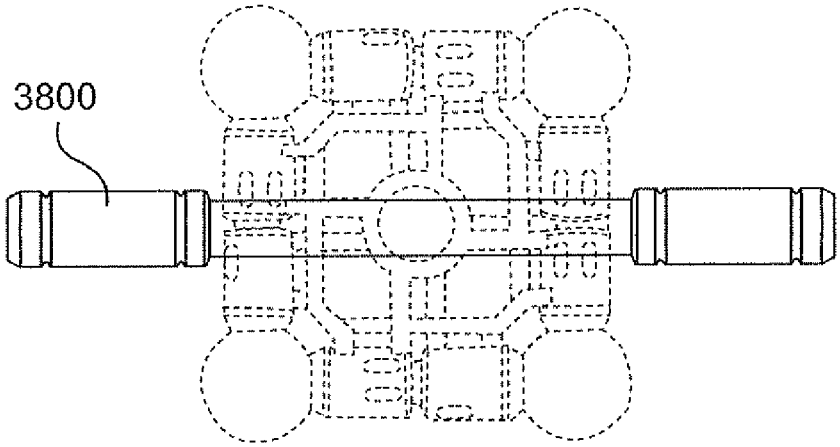
Figure 38E:
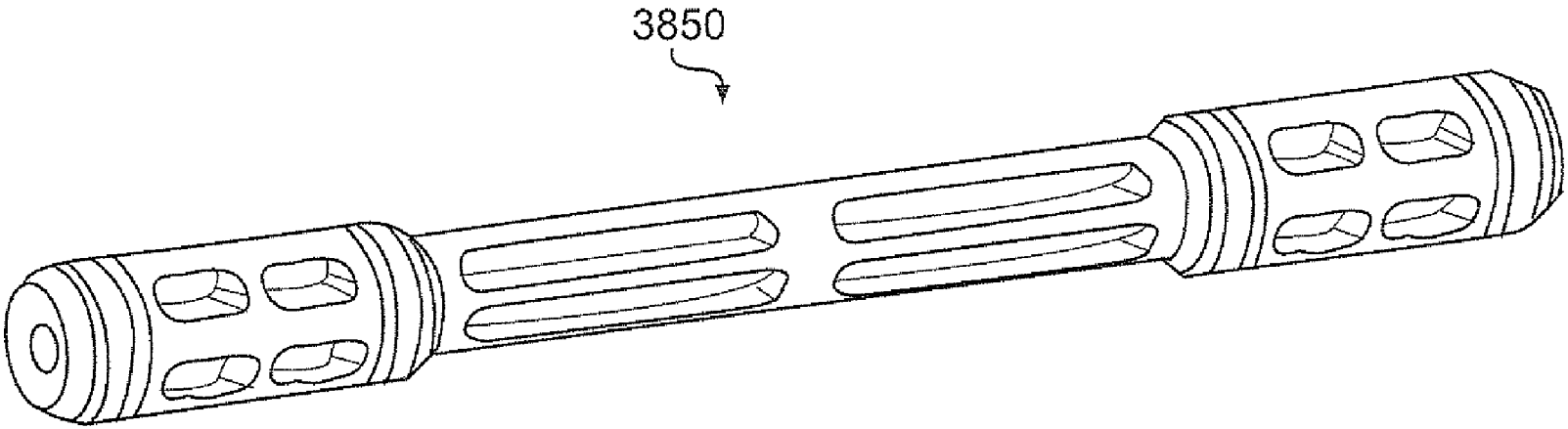

FIGS. 38A-38E are schematic diagrams illustrating a double axis construction element 3800, according to another embodiment of the present invention. The double axis element 3800 enables relative rotational movement between components of a construction assembly. The double axis element 3800 can be sized and shaped to provide a soft fit through the openings in a square panel element as shown in FIGS. 38B and 38D. This fit enables the attached panel element to spin freely around the double axis element. In this manner, three-dimensional assemblies such as the cubic assemblies shown in FIGS. 38B and 38D can rotate relative to the double axis element. The double axis element can have magnets disposed in its distal ends, can be made of 0.06 inch overmolded ABS, and can be approximately 3.88×0.364×0.364 inches.

Figure 39A:
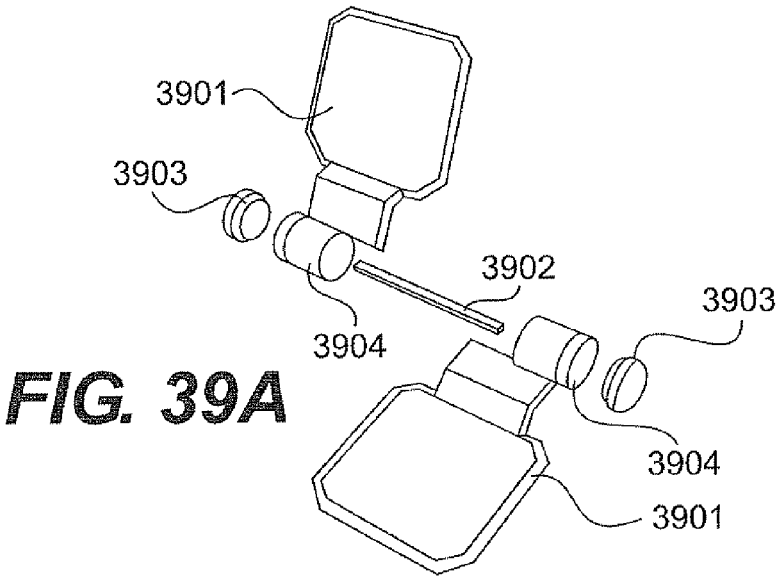
FIGS. 39A-39D are schematic diagrams illustrating a square panel hinge element, according to an embodiment of the present invention.
Figure 39B:
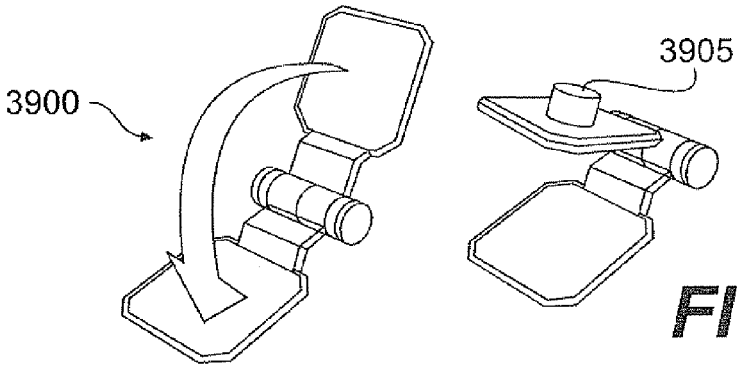
Figure 39C:
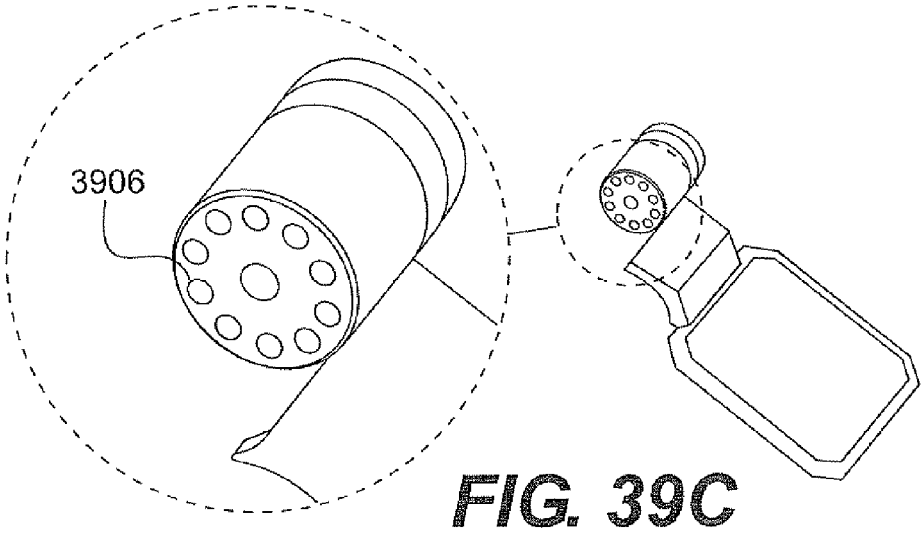
Figure 39D:
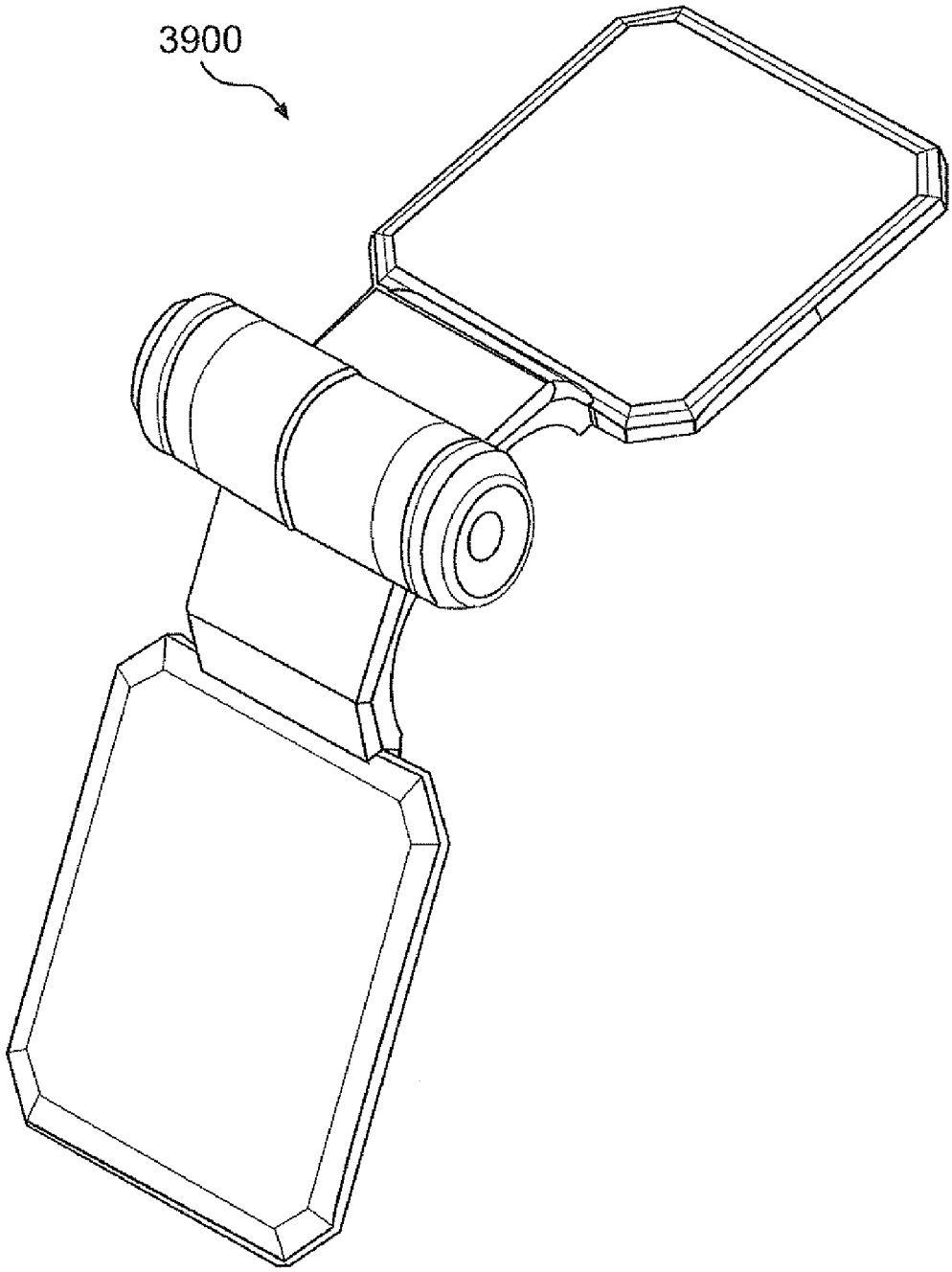

FIGS. 39A-39D illustrate a square panel hinge element 3900, according to another embodiment of the present invention. As shown in the exploded view of FIG. 39A, the square panel hinge element 3900 comprises two square panel portions 3901 connected by a metal pin 3902. The metal pin 3902 is disposed in axially aligned holes of the projecting hinge portions 3904 of the two square panel portions 3901. End caps 3903 are attached over the ends of the projecting hinge portions 3904 to retain the metal pin 3902. As shown in FIG. 39C, the opposing hinge portions 3901 can have incremental projections 3906 to provide a user with feedback at each angle increment as the panel portions 3901 are rotated with respect to each other. The incremental projections 3906 can also aid to hold the square panel hinge element 3900 in a desired position. The square panel hinge element 3900 can be made of 0.06 inch shelled ABS plastic and the panel portions 3901 can each be approximately 1.84×0.97×0.6 inches. In addition to the square shape shown, other shaped hinges are possible.

Figure 40A:
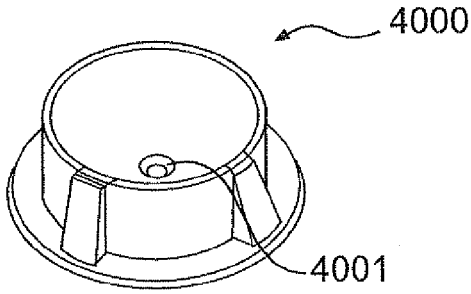
FIGS. 40A-40D are schematic diagrams illustrating a construction support, according to an embodiment of the present invention.
Figure 40B:
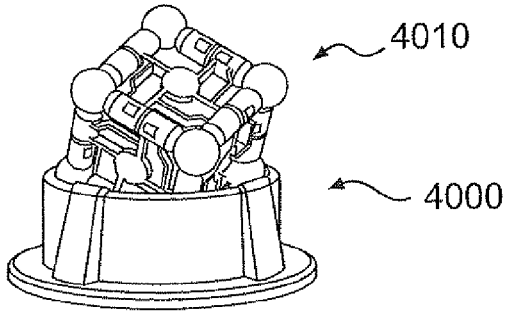
Figure 40C:
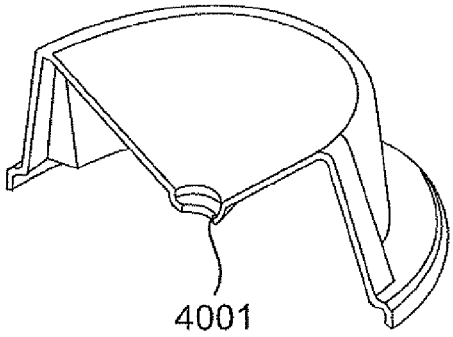
Figure 40D:
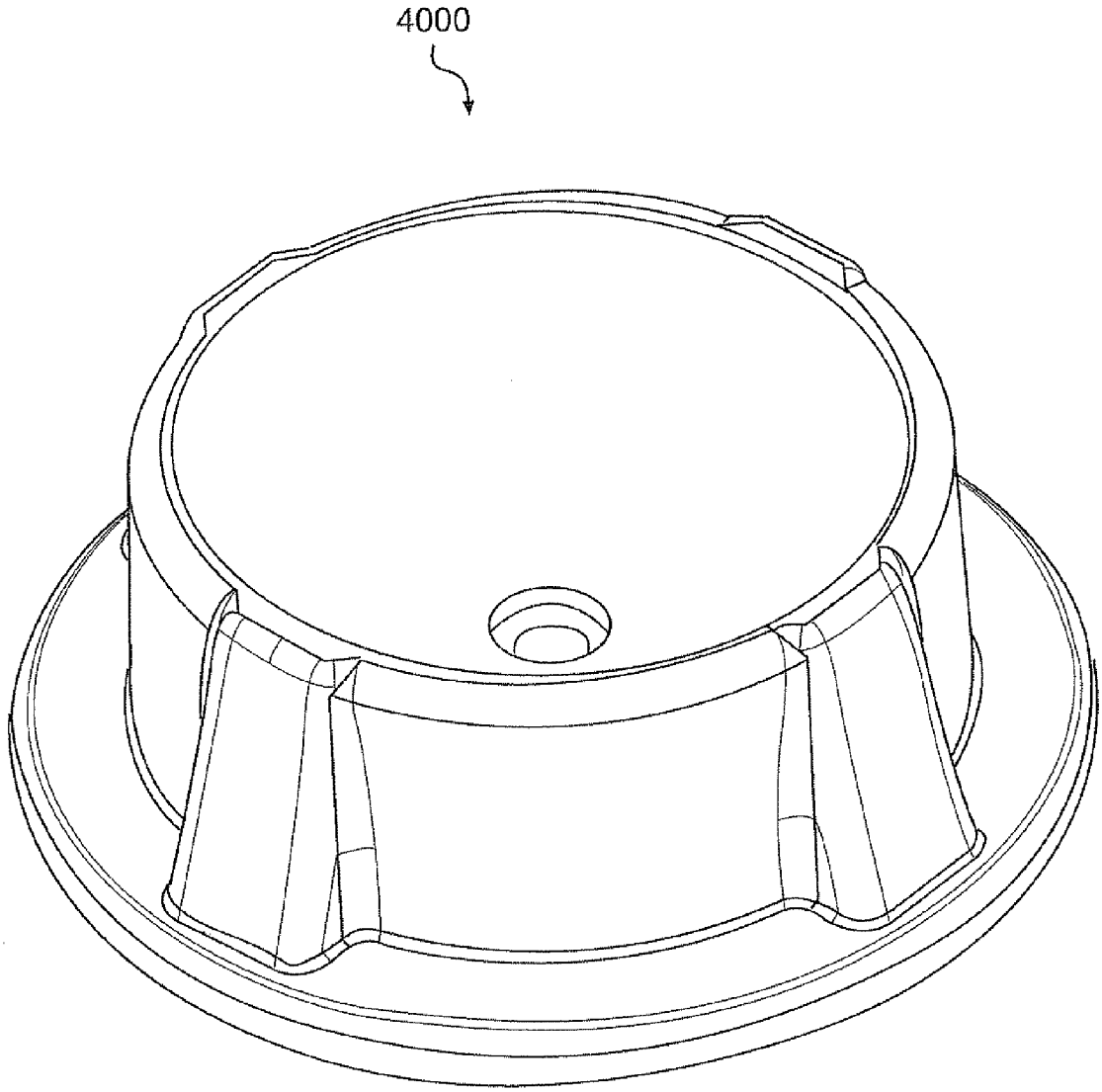

FIGS. 40A-40D are schematic diagrams illustrating a construction support 4000, according to an embodiment of the present invention. The support 4000 is configured to fit, for example, a cubic assembly 4010 (e.g., comprised of square magnetic panel elements and ferromagnetic balls) and to allow the cubic assembly 4010 to spin freely, as represented in FIG. 40B. To enable this spinning, the construction support 4000 can have a half-ball contour 4001 at its center, as shown in FIG. 40C, for example. The construction support 4000 can be made of 0.06 inch shelled ABS plastic and can be approximately 3.85×3.85×1.39 inches.

Figure 41A:
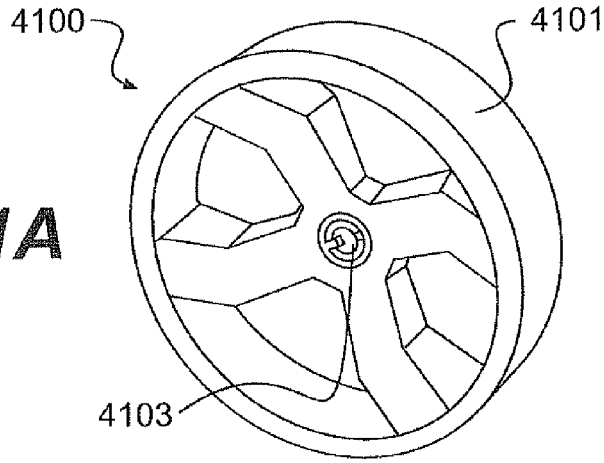
FIGS. 41A-41E are schematic diagrams illustrating a wheel assembly, according to an embodiment of the present invention.
Figure 41B:
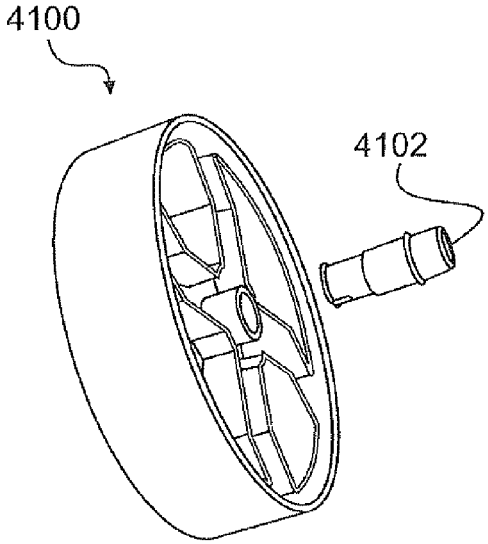
Figure 41C:
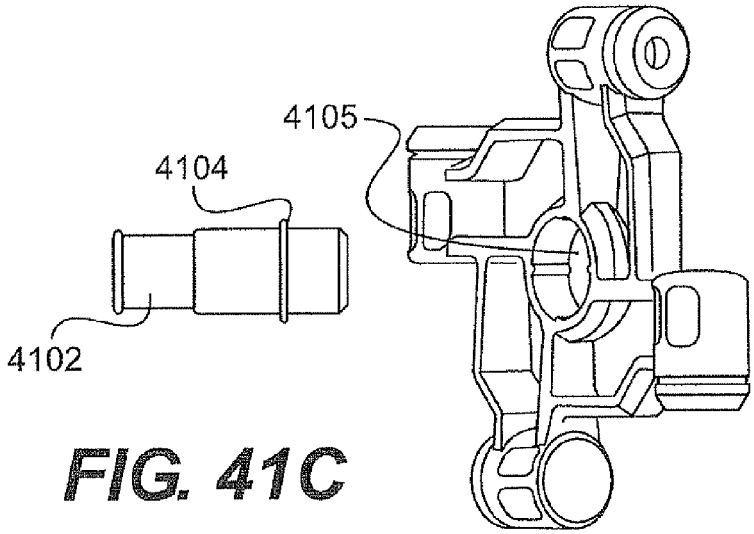
Figure 41D:
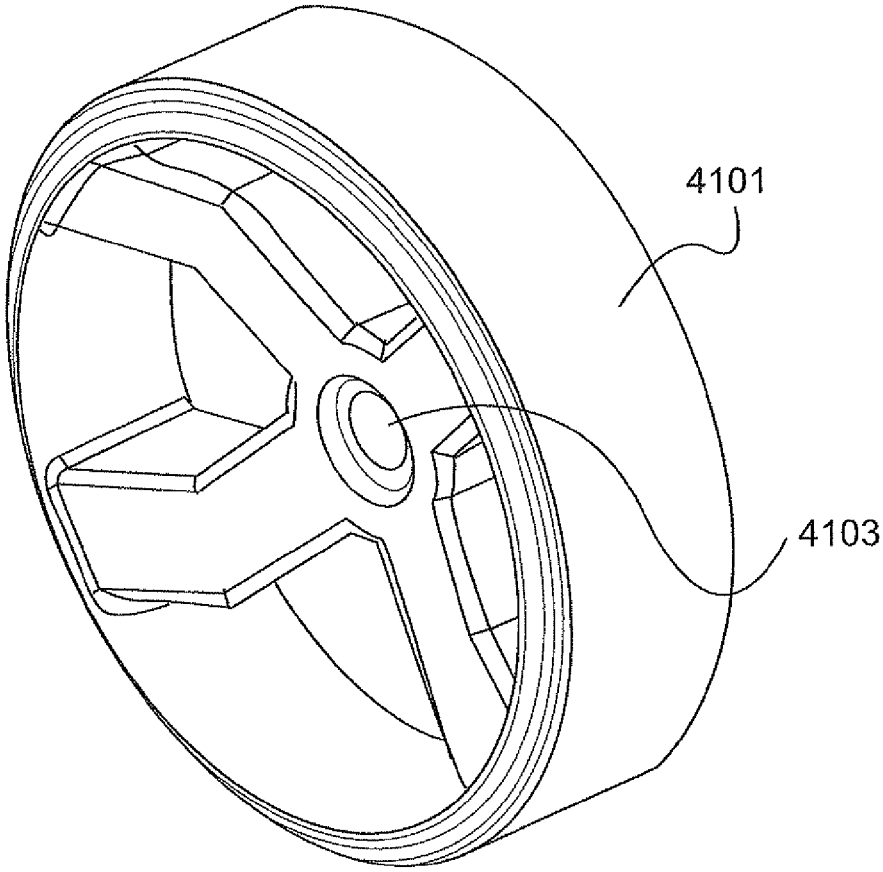
Figure 41E:
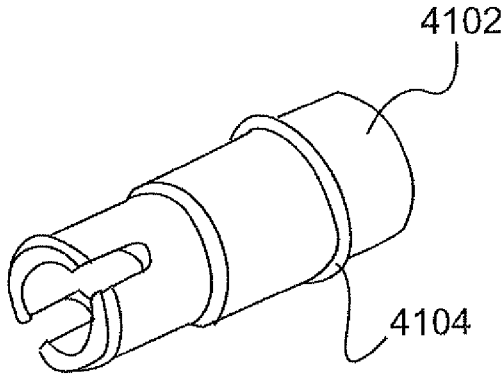

FIGS. 41A-41E are schematic diagrams illustrating a wheel assembly 4100, according to an embodiment of the present invention. As shown, the wheel assembly 4100 includes a wheel 4101 (FIGS. 41A and 41D) and a shaft 4102 (FIG. 41E). The shaft 4102 clicks into the wheel axis opening 4103, for example, by compressing to fit through the opening and then expanding on the other side of the opening 4103. The wheel 4101 turns around the shaft 4102. When assembled together, the shaft 4102 protrudes from the wheel 4101. As best shown in FIG. 41C, the shaft 4102 can have a protruding rib 4104 that prevents the wheel 4101 from sliding to the portion of the shaft 4102 on the right side of the rib 4104 in FIG. 41C. As shown in FIG. 41C, the shaft 4102 can be sized and shaped to fit snugly within a panel element opening, such as opening 364 of skeletal square panel element 352 (FIG. 3E). In this manner, the shaft 4102 and panel element do not move with respect to each other, and the wheel 4101 spins around the stationary shaft 4102. The wheel 4101 can be made of 0.06 inch ABS plastic and can be approximately 3.25×3.25×0.91 inches. The shaft can be made of 0.05 shelled ABS plastic and can be approximately 1.0×0.42×0.42 inches.

Figure 42A:
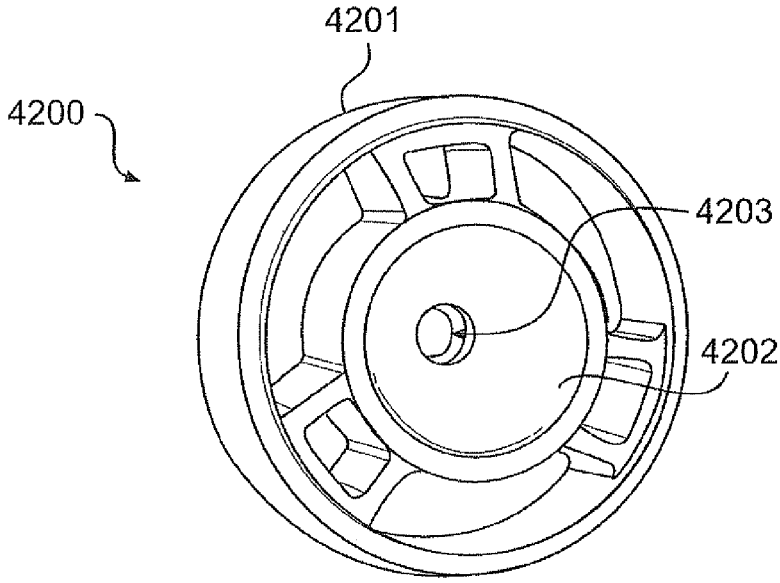
FIGS. 42A-42D are schematic diagrams illustrating a further wheel assembly, according to another embodiment of the present invention.
Figure 42B:
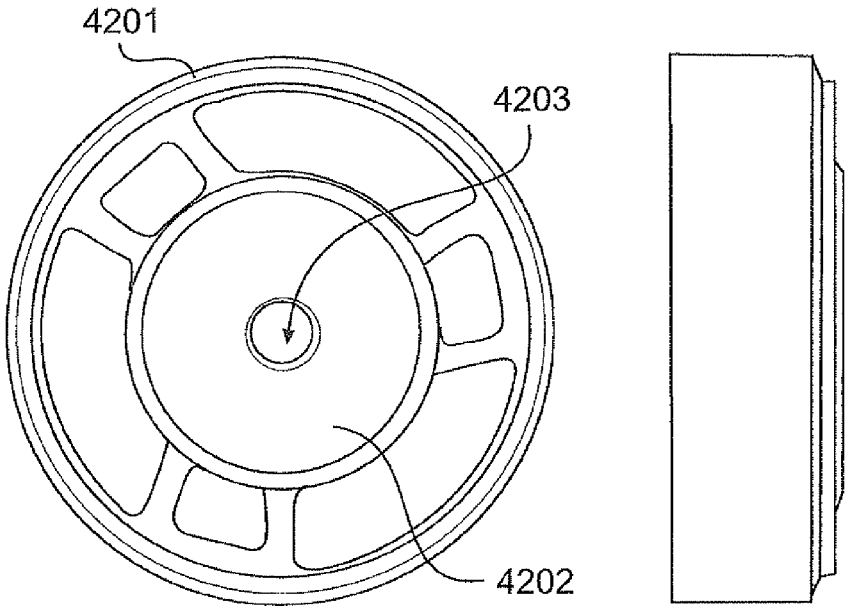
Figure 42C:
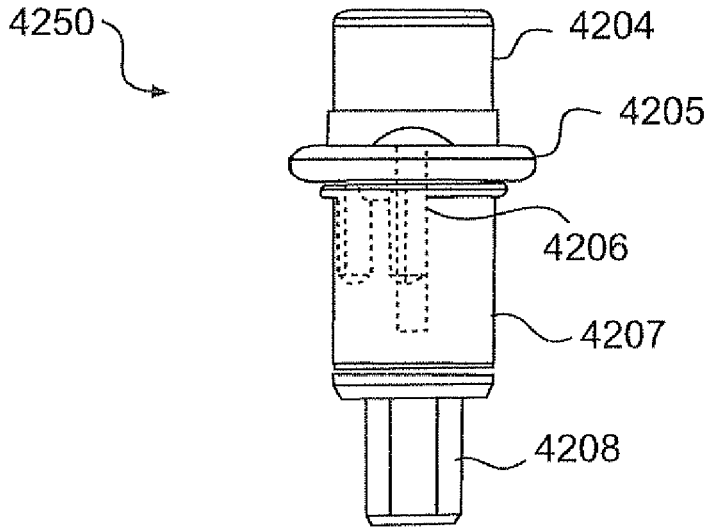
Figure 42D:
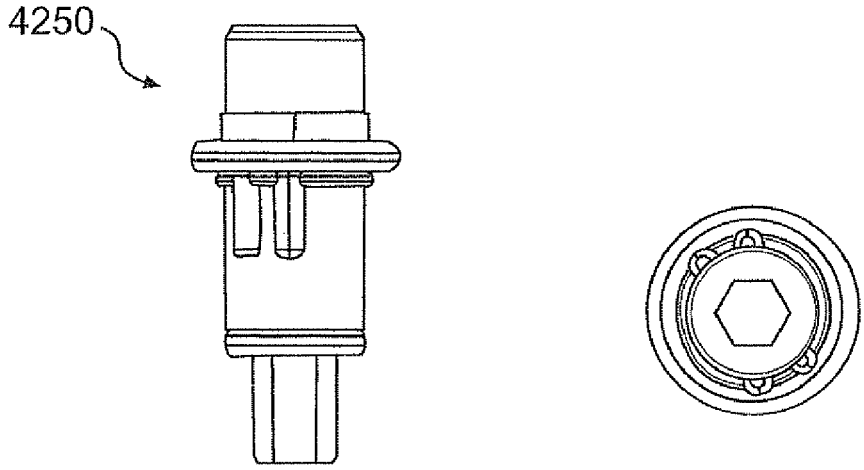

FIGS. 42A-42D are schematic diagrams illustrating an alternative wheel and shaft assembly according to a further embodiment of the present invention. As shown in FIGS. 42A-B, a wheel 4200 comprises an outer contacting surface 4201 and all inner support circle 4202. The inner support circle 4202 may be configured to support a cube (for example, as shown in FIG. 40B), which cube may be spun in the inner support circle 4202. The wheel 4200 may further include a hole 4203 for insertion of a shaft, such as the shaft 4250 as shown in FIGS. 42C-42D.

The shaft 4250 may include an attachment portion 4204 for insertion into the hole 4203, an abutment portion 4205 for positioning the shaft in the hole 4203, a spinning portion 4207 configured to spin freely relative to the attachment portion 4204, and a lower portion 4208 configured to be attached to other elements of the construction system. A screw 4206 may be used to assemble the shaft 4250 and allow for spinning portion 4207 to spin freely.

Figure 43A:
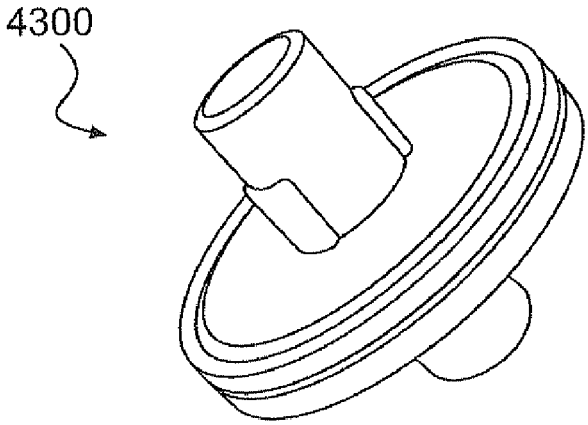
FIGS. 43A-43C are schematic diagrams illustrating a spinner element, according to an embodiment of the present invention.
Figure 43B:
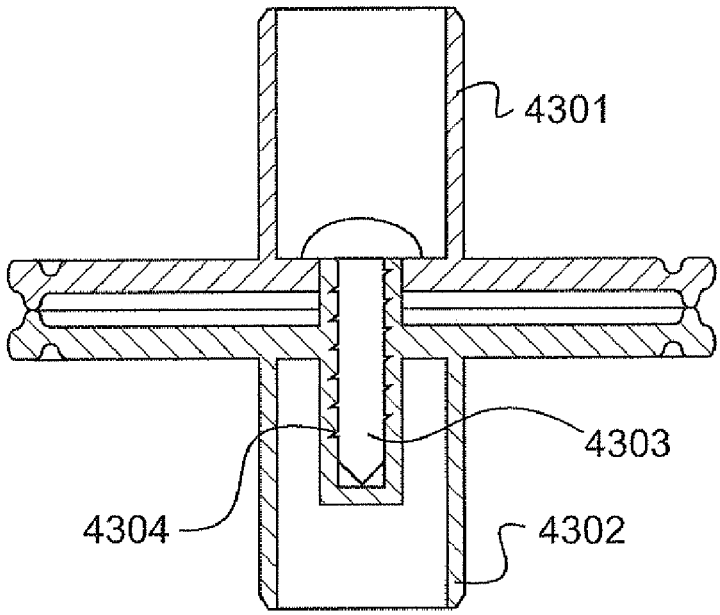
Figure 43C:
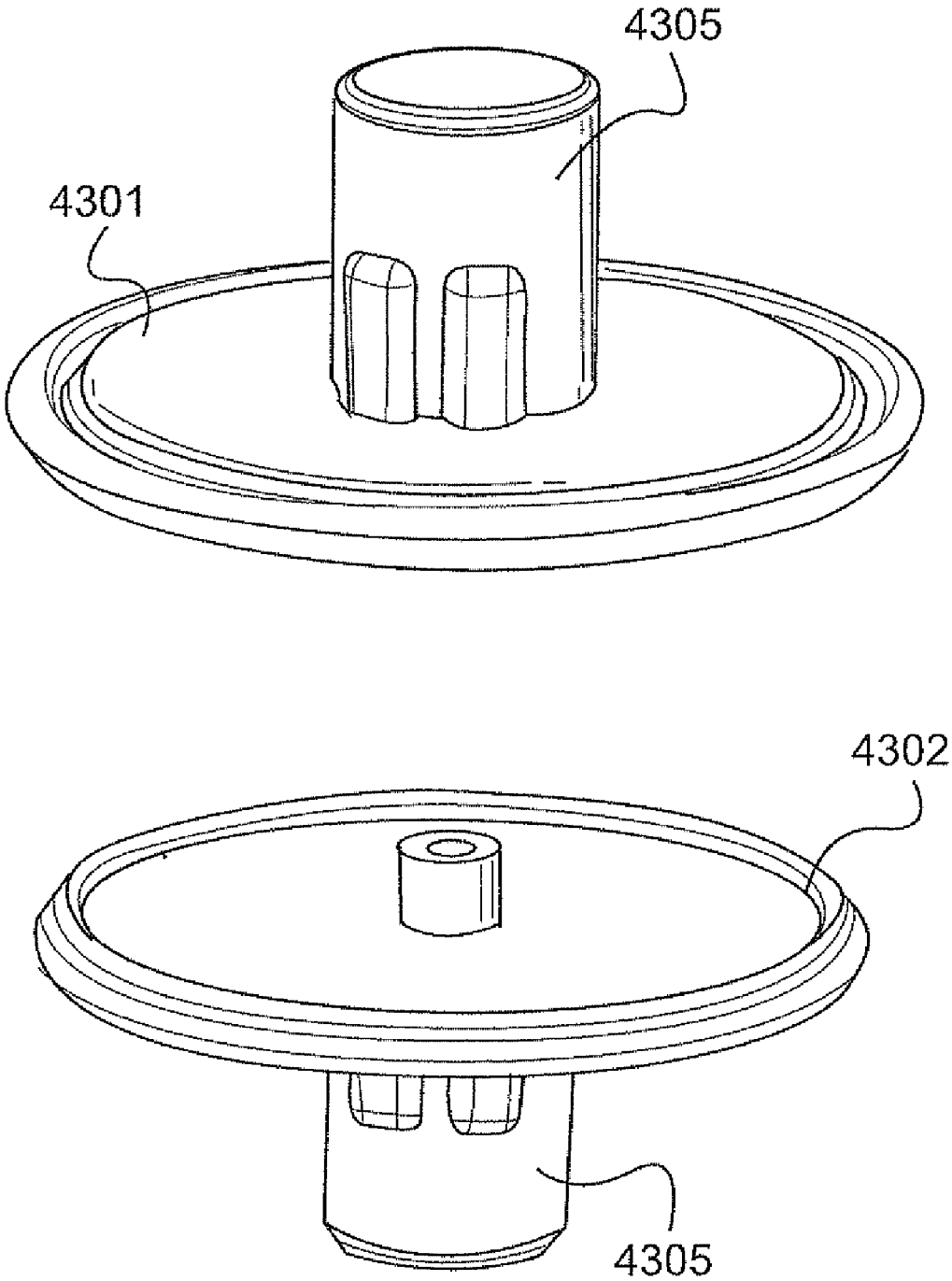

FIGS. 43A-43C are schematic diagrams illustrating a spinner element 4300, according to an embodiment of the present invention. The spinner element 4300 can be used to join two construction elements or assemblies, and to enable relative rotational movement between the connected elements or assemblies. As shown in FIGS. 43B and 43C, the spinner element 4300 comprises a spinner top 4301 and spinner base 4302 attached by a fastener 4303, such as a triangular head mechanical screw. The fastener 4303 is inserted into the channel 4304 shown in the cross-sectional view of FIG. 43B. The spinner top 4301 and base 4302 can rotate without becoming unfastened to each other. The fastener 4303 preferably does not cause too much friction between the components so that the top 4301 and base 4302 can spin freely. The projections 4305 of the spinner top 4301 and base 4302 can be sized and shaped to fit snugly within opening of other construction elements, such as opening 364 of element 352 (FIG. 3E). The spinner top 4301 and base 4302 can each be made of 0.06 inch thick ABS plastic, with a 0.03 inch shelled ABS sleeve, and can be approximately 1.25×1.25×0.53 inches.

Figure 44B:
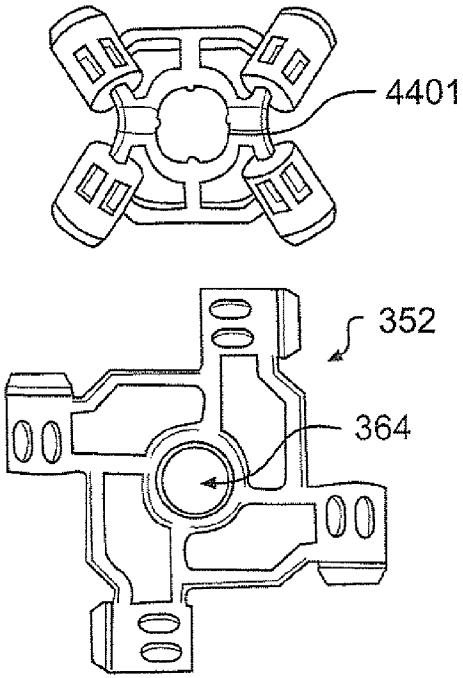
FIGS. 44A-44E are schematic diagrams illustrating an X-quad bar element, according to an embodiment of the present invention.
Figure 44C:
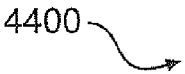
Figure 44C:
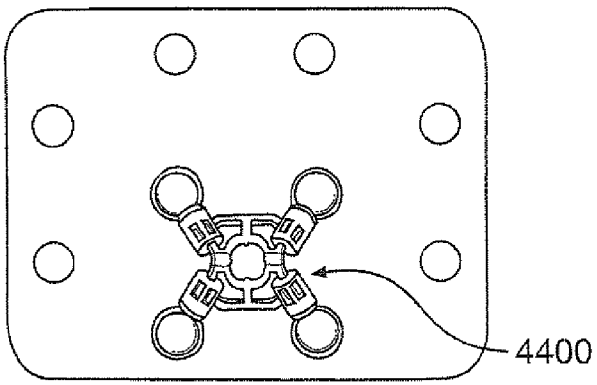
Figure 44A:
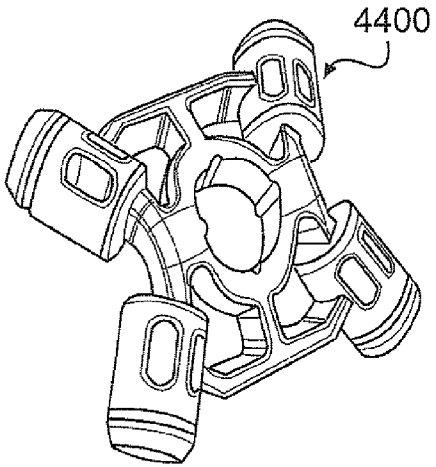
Figure 44D:
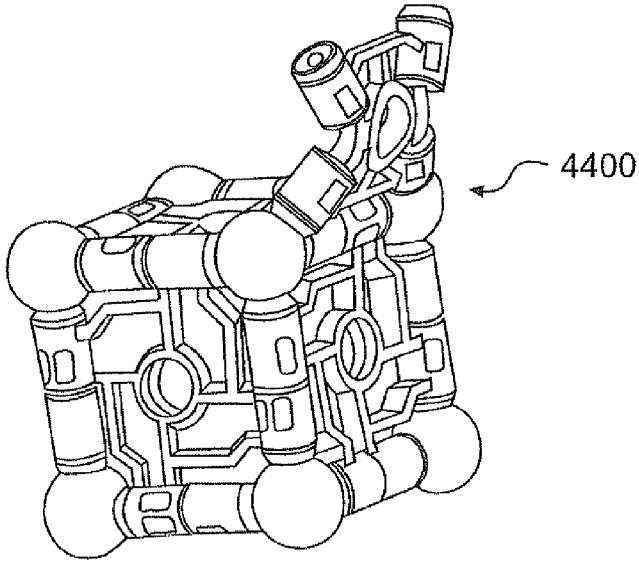
Figure 44E:
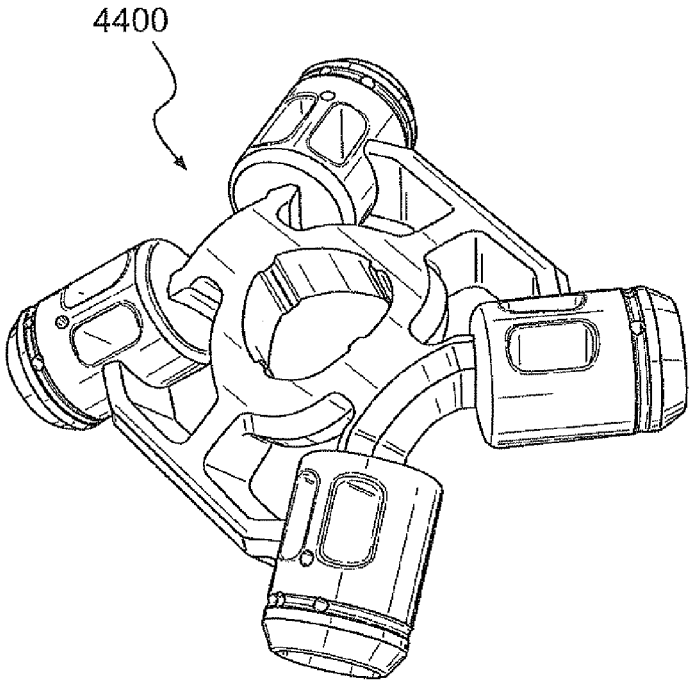

FIGS. 44A-44E are schematic diagrams illustrating an X-quad bar element 4400, according to an embodiment of the present invention. As shown in FIGS. 44A and 44E, the X-quad bar element 4400 has four magnets overmolded into the corners of the element, with the faces of the magnets facing the corners. The X-quad bar element 4400 has a non-planar configuration such that the magnets face in a direction away from the general plane of the center of the element 4400 (e.g., downward in FIGS. 44A and 44E). This non-planar configuration enables the X-quad bar element 4400 to magnetically couple to constructions that appear closed (FIG. 44D) or to trams that have projecting hemispheres on a planar surface (FIG. 44C). As shown in FIG. 44B, the X-quad bar element 4400 can have a center opening 4401 that matches the respective center openings of other panel elements, such as the square panel element 352 of FIG. 3E (also shown in FIG. 44B). The X-quad bar element 4400 can be made of ABS overmolding and can be approximately 1.53×0.97×0.3 inches.

Figure 45A:
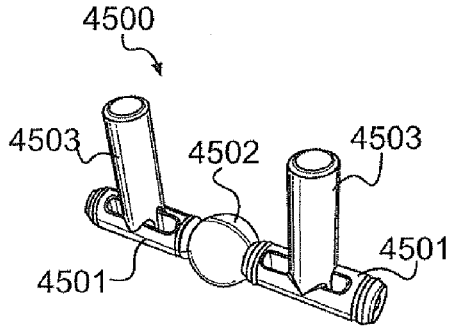
FIGS. 45A-45C are schematic diagrams illustrating a connector element, according to an embodiment of the present invention.
Figure 45B:
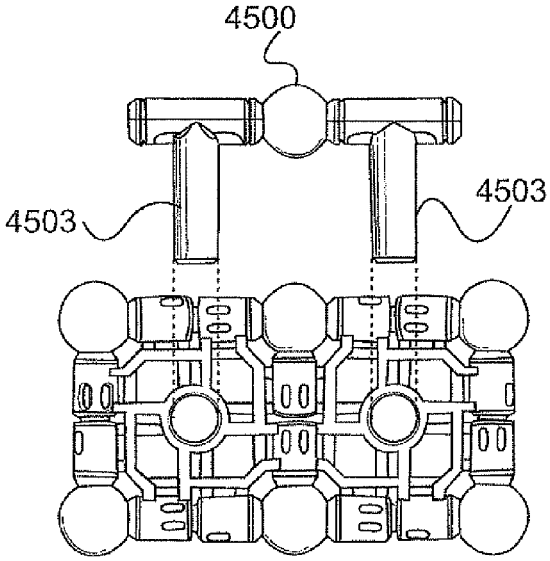
Figure 45C:
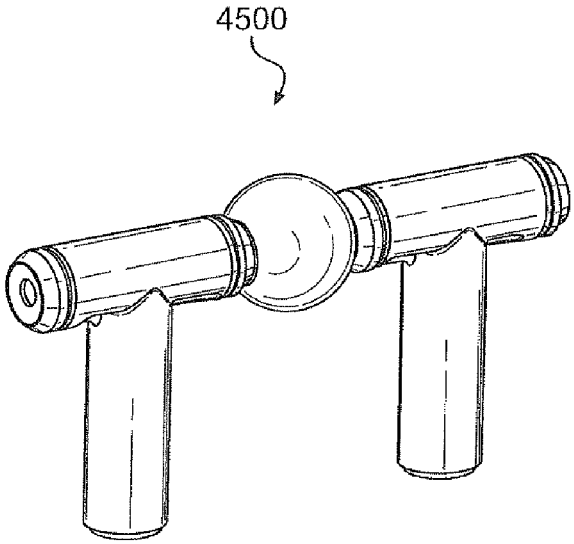

FIGS. 45A-45C are schematic diagrams illustrating a connector element 4500, according to an embodiment of the present invention. As shown in FIGS. 45A and 45C, the connector element 4500 comprises two rod portions 4501 and a center ball portion 4502 in between the rod portions 4501. The rod portions 4501 each have a prong 4503 protruding perpendicularly from the rod portions 4501, and have magnets disposed at their ends opposite to the center ball portion 4502. The two rod portions 4501 can be separately attached to the center ball portion 4502. Or, the two rod portions 4501 can be integral with each other, with metal half-balls glued over a central spherical portion integrally joining the two rod portions 4501 (which creates the appearance that there are three separate parts, i.e., two "T" shaped parts and a ball part). The protruding prongs 4503 can be sized, shaped, and spaced apart to fit into two cubic assemblies (e.g., comprised of square magnetic panel elements and ferromagnetic balls) as shown in FIG. 45B. As a single integral piece, the dual rod 4500 with prongs 4503 can be made of ABS overmolding, 0.05 inch wall thickness, and can be approximately 2.71×1.45×0.36 inches. The metal half domes can be 15 mm×0.5 mm×0.04 inches.

Figure 46C:
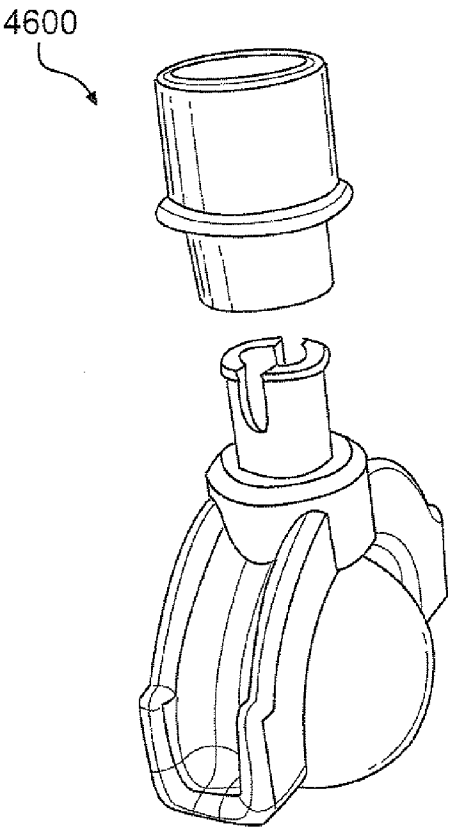
FIGS. 46A-46D are schematic diagrams illustrating a small wheel assembly, according to an embodiment of the present invention
Figure 46B:
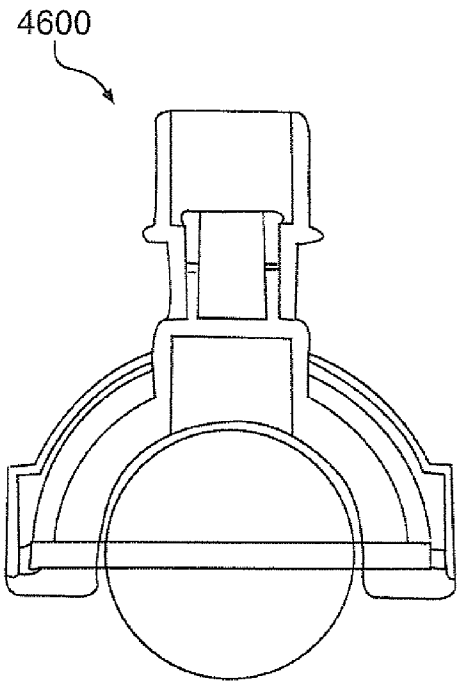
Figure 46A:
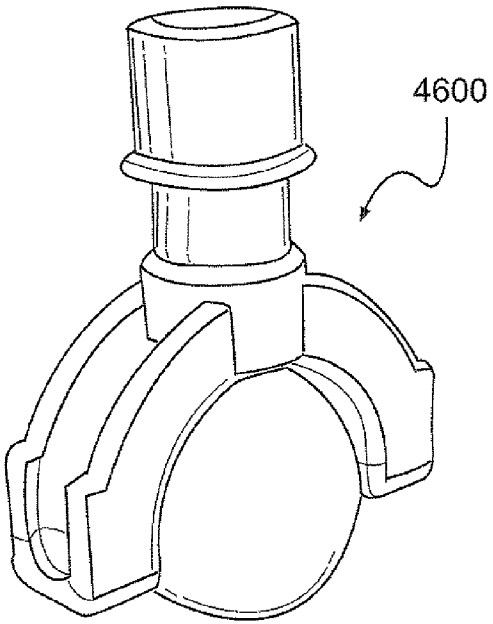
Figure 46D:
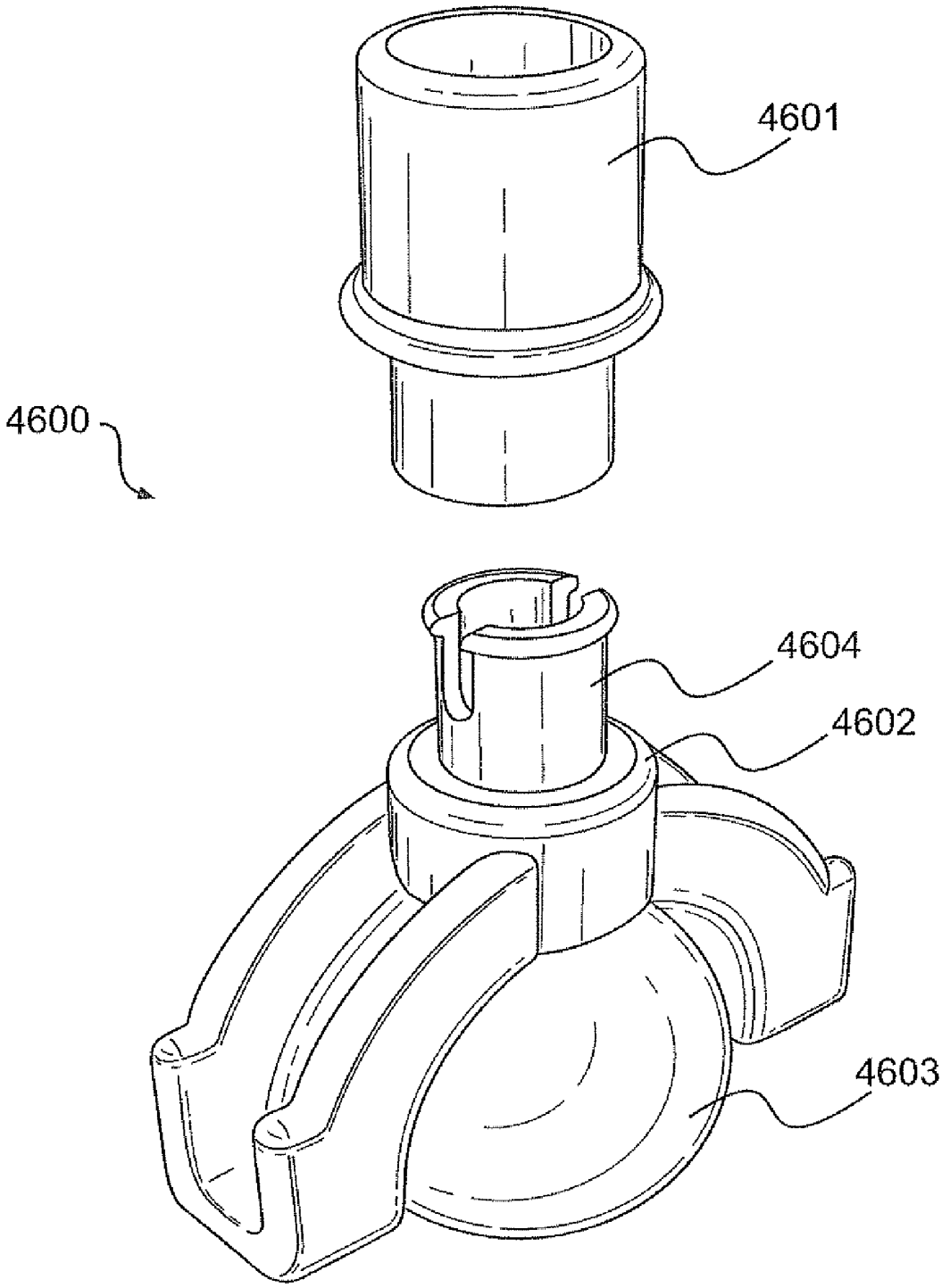

FIGS. 46A-46D are schematic diagrams illustrating a small wheel assembly 4600, according to an embodiment of the present invention. As shown in the exploded view of FIG. 46D, the small wheel assembly 4600 includes a shaft 4601, a wheel base 4602, and a sphere 4603. The shaft 4601 snaps onto the wheel base 4602 as shown in FIG. 46C, for example, using an end fitting 4604 that compresses and expands to snap in place. The wheel base 4602 can spin freely on the shaft 4601. As shown in FIG. 46B, the sphere 4803 can be attached to the wheel base 4602 by press fitting a metal pin through aligned openings in the wheel base 4602 and sphere 4603. The sphere 4603 can spin around the metal pin. The shaft 4601 can be made of 0.04 inch shelled ABS and can be approximately 0.42×0.42×0.49 inches. The wheel base 4602 can be made of 0.06 inch shelled ABS and can be approximately 0.9×1.06×0.3 inches. The sphere 4603 can be shelled with a thickness of 0.04 inches.

Figure 47B:
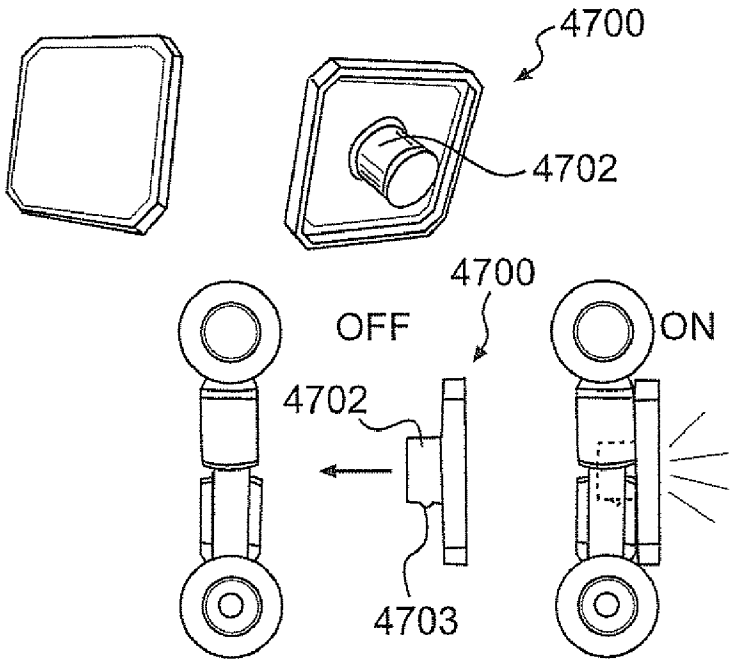
FIGS. 47A-47E are schematic diagrams illustrating an illuminated closure panel, according to an embodiment of the present invention.
Figure 47A:
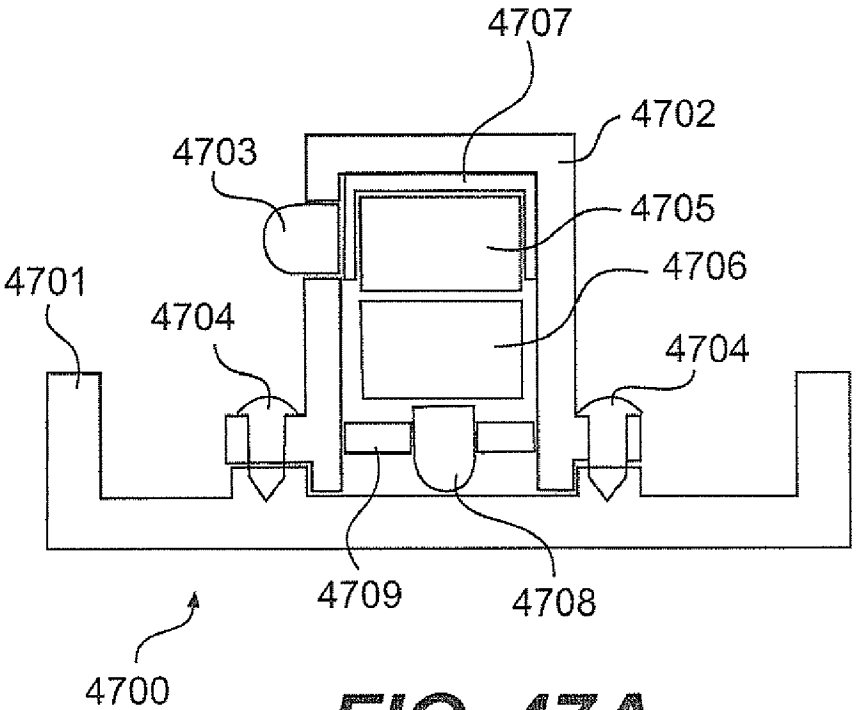
Figure 47D:
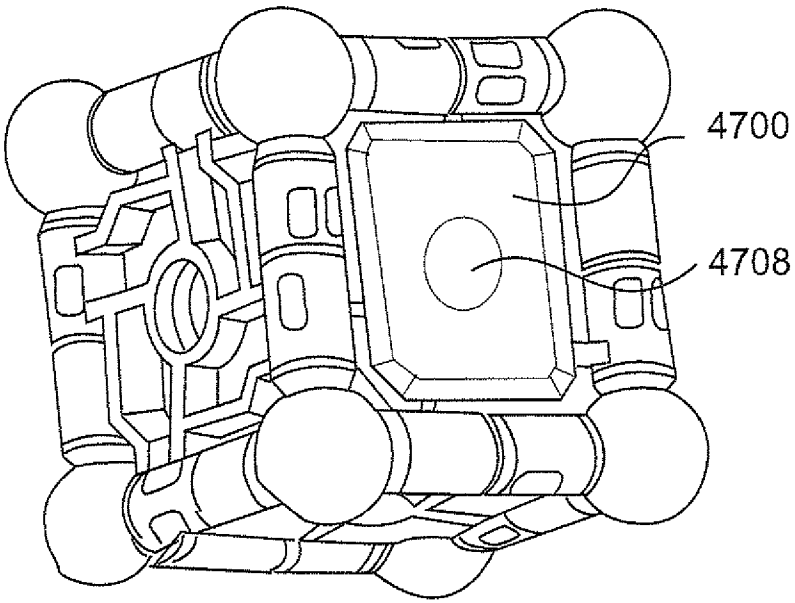
Figure 47C:
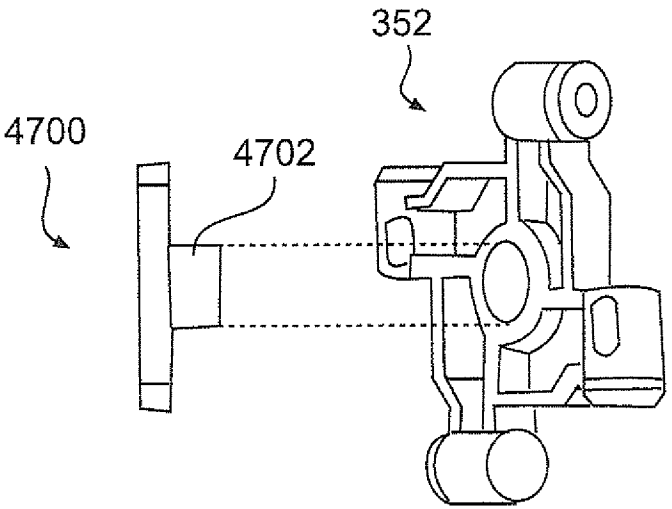
Figure 47E:
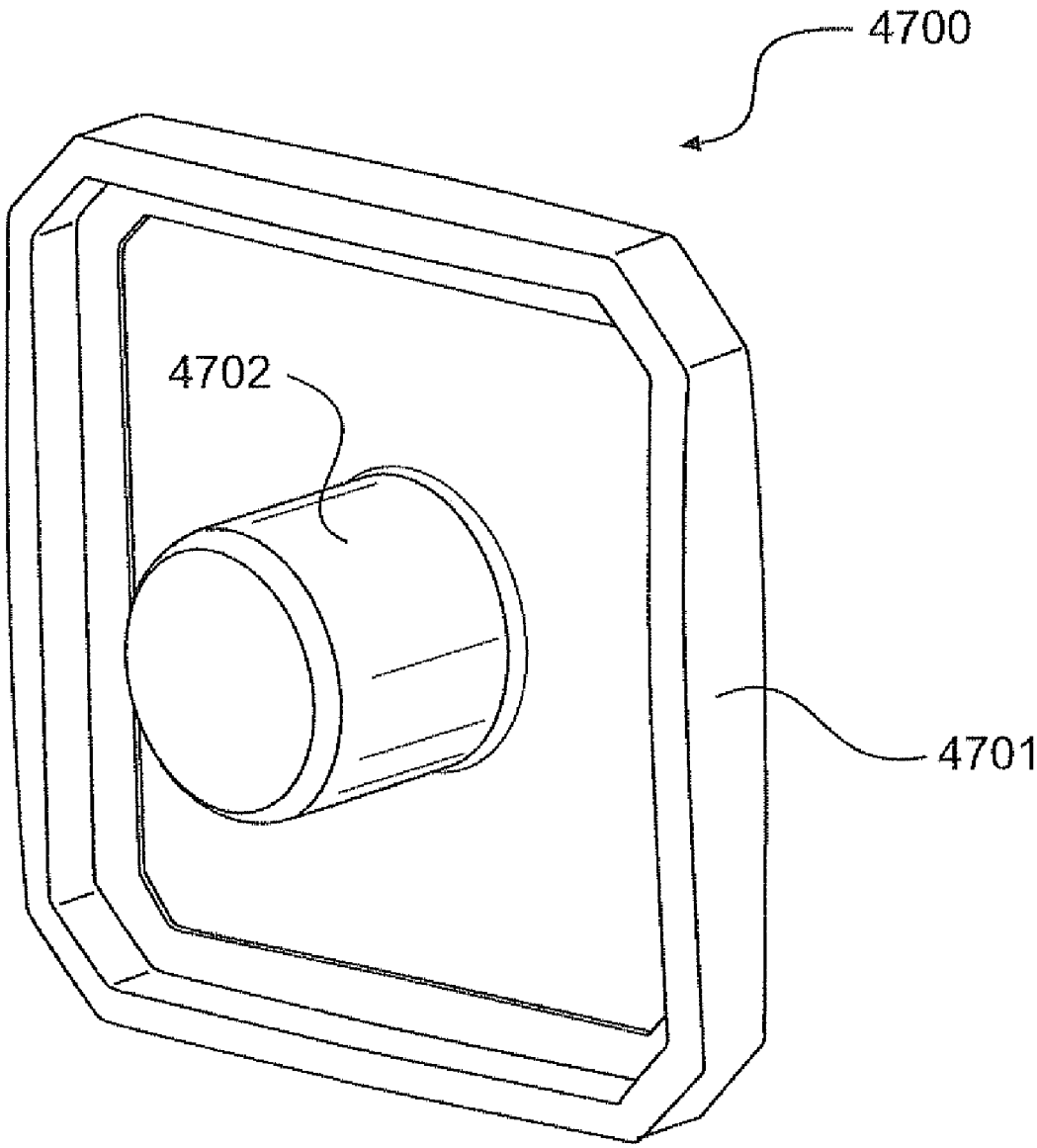

FIGS. 47A-47E are schematic diagrams illustrating an illuminated closure panel 4700, according to an embodiment of the present invention. As shown in FIGS. 47B-47D, the illuminated closure panel 4700 can be sized and shaped to connect to a square panel element, such as element 352 of FIG. 3E, to add interesting visual effects to a construction assembly. As shown in FIG. 47A, the illuminated closure panel 4700 comprises a transparent or translucent light panel 4701 attached to a light panel cap 4702. The light panel cap 4702 has a compartment that houses an LED bulb 4708 disposed adjacent the light panel 4701, via LED holder 4709, as well as batteries 4705, 4706 that power the bulb 4708 in conjunction with battery contact 4707. The light panel cap 4702 may be secured to a portion of the light panel 4701 by screws 4704. A push button switch 4703 protrudes from the light panel cap 4702, which activates and deactivates the light 4708. As shown in FIG. 47B, the illuminated closure panel 4700 can be configured such that when it is inserted into a panel element, the button 4703 is pressed and the light 4708 is activated. When the illuminated closure panel 4700 is removed, the button 4703 is released and the light is deactivated 4708. The button 4708, light panel 4701, and light panel cap 4702 can be made of shelled ABS plastic.

Figure 48A:
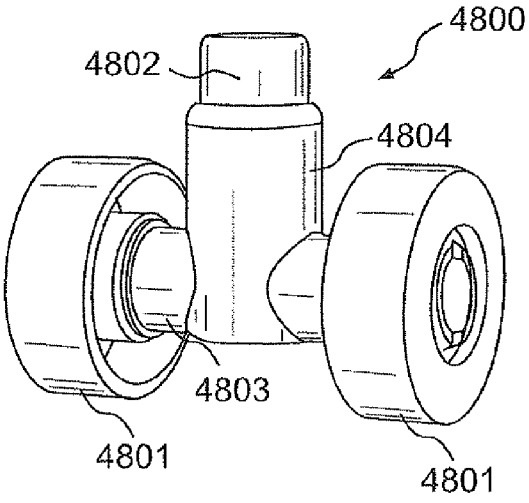
FIGS. 48A-48C are schematic diagrams illustrating a small wheel base, according to an embodiment of the present invention.
Figure 48B:
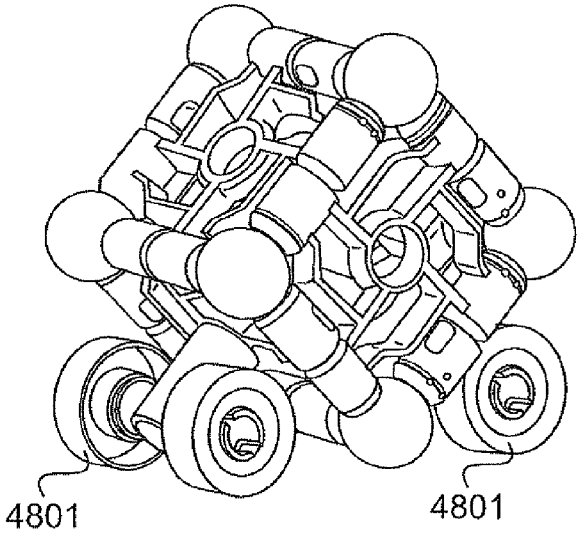
Figure 48C:
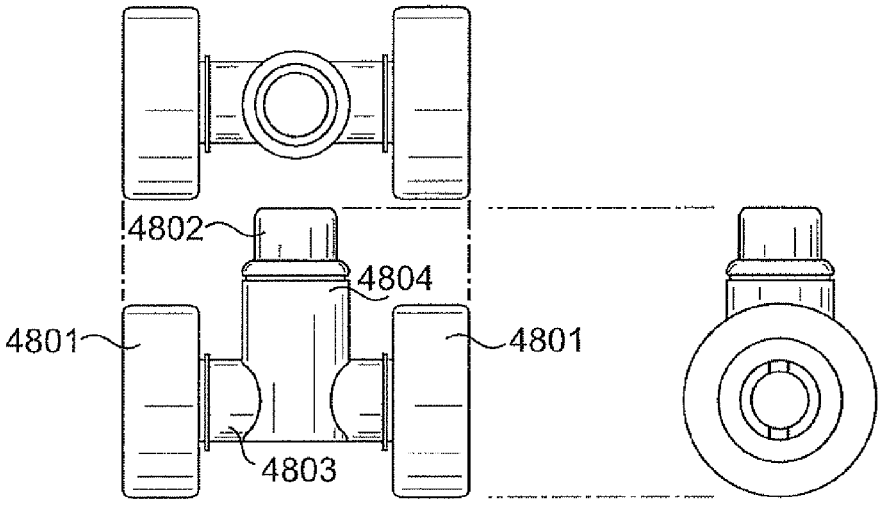

FIGS. 48A-48C are schematic diagrams illustrating a small wheel base assembly 4800, according to an embodiment of the present invention. The small wheel base 4800 may include a pair of wheels 4801, an attachment shaft 4802, an axle 4803, and body shaft 4804. In use, the small wheel base 4800 may attach to holes in other construction elements (such as a cubic construction as shown in FIG. 48B) in order to permit the elements to roll.

Figure 49A:
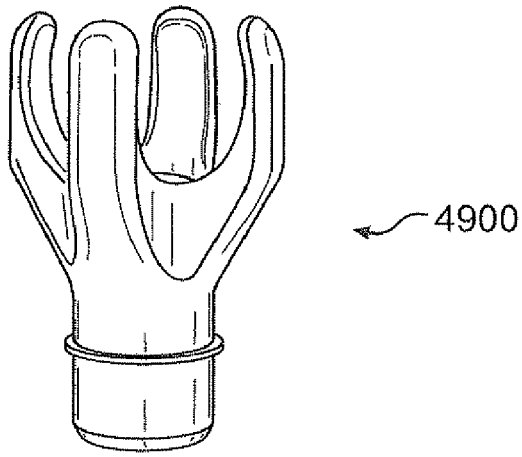
FIGS. 49A-49B are schematic diagrams illustrating a half tram shaft, according to an embodiment of the present invention.
Figure 49B:
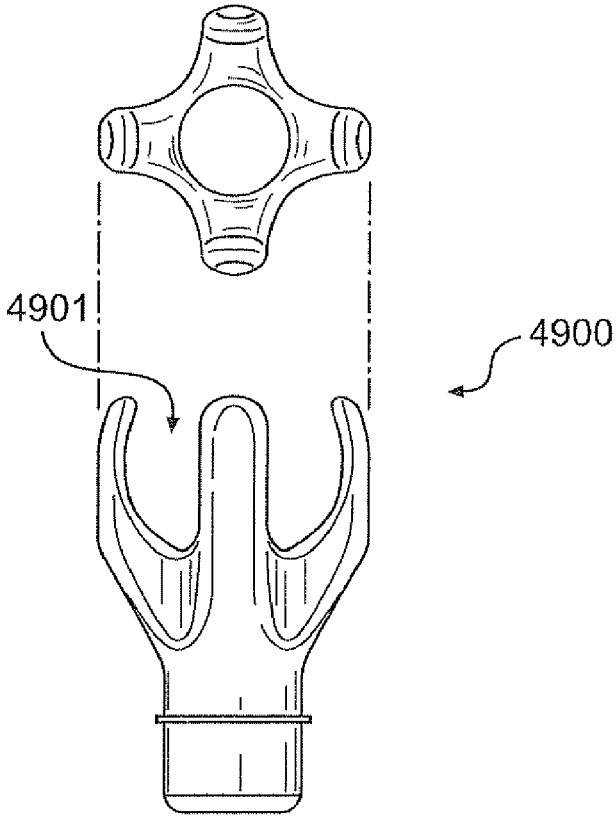

FIGS. 49A-49B are schematic diagrams illustrating a half tram shaft 4900, according to an embodiment of the present invention. The half tram shaft includes a base for insertion into holes of other construction elements and an engagement portion 4901 that is configured to hold, for example, a ferromagnetic sphere. The engagement portion may be configured as a snapping cup that allows a sphere to be easily inserted and removed by virtue of the shape and flexibility of the snapping cup 4901.

Figure 50A:
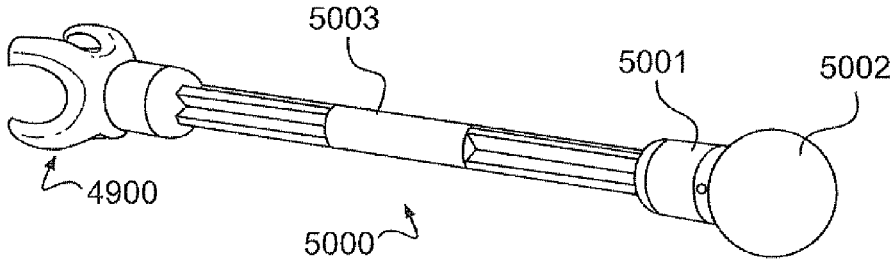
FIGS. 50A-50B are schematic diagrams illustrating a sphere shaft, according to an embodiment of the present invention.
Figure 50B:
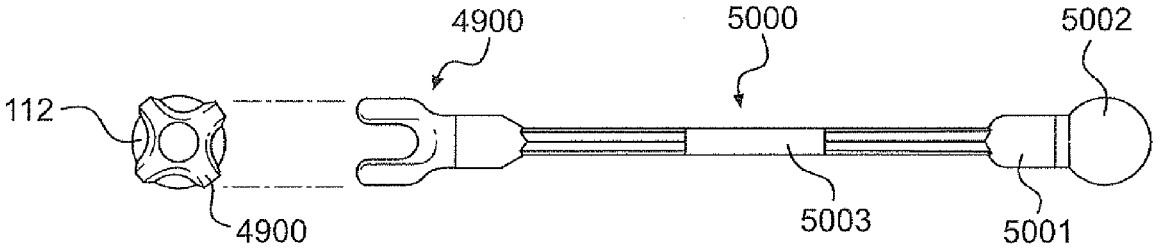

FIGS. 50A-50B are schematic diagrams illustrating a sphere shaft 5000, according to an embodiment of the present invention. The sphere shaft 5000 may be provided with a half tram shaft portion 4900 at one end and a ferromagnetic sphere portion 5002 at an opposite end. The half tram shaft portion 4900 and sphere portion 5002 may be connected by a rod portion 5003, which may be rigid or flexible. In an alternative embodiment, the sphere portion 5002 may be detachable, and the sphere shaft 5000 may comprise a magnet holder 5001 at one or both ends thereof for attachment to a ferromagnetic sphere.

Figure 51A:
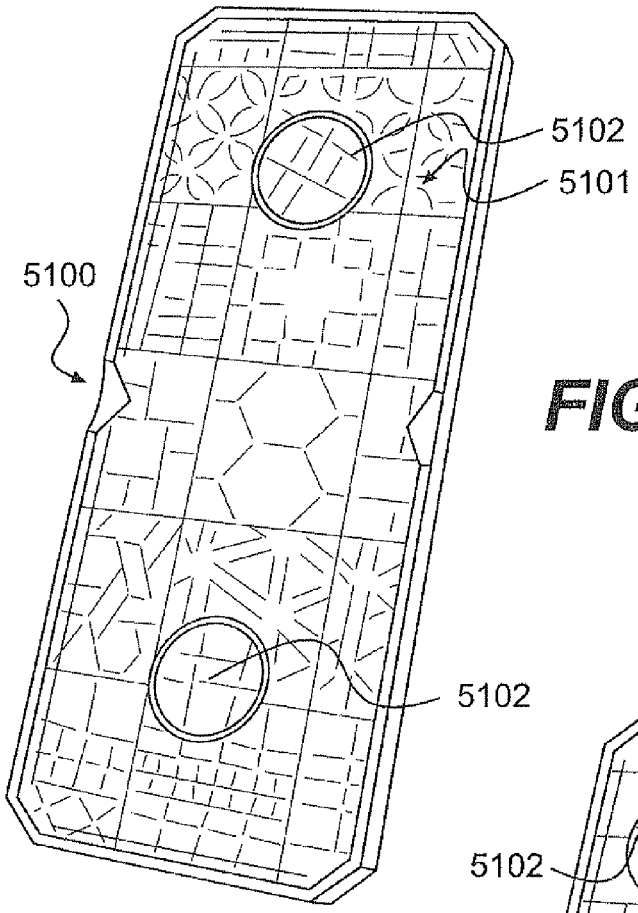
FIGS. 51A-51B are schematic diagrams illustrating a reversible panel, according to an embodiment of the present invention.
Figure 51B:
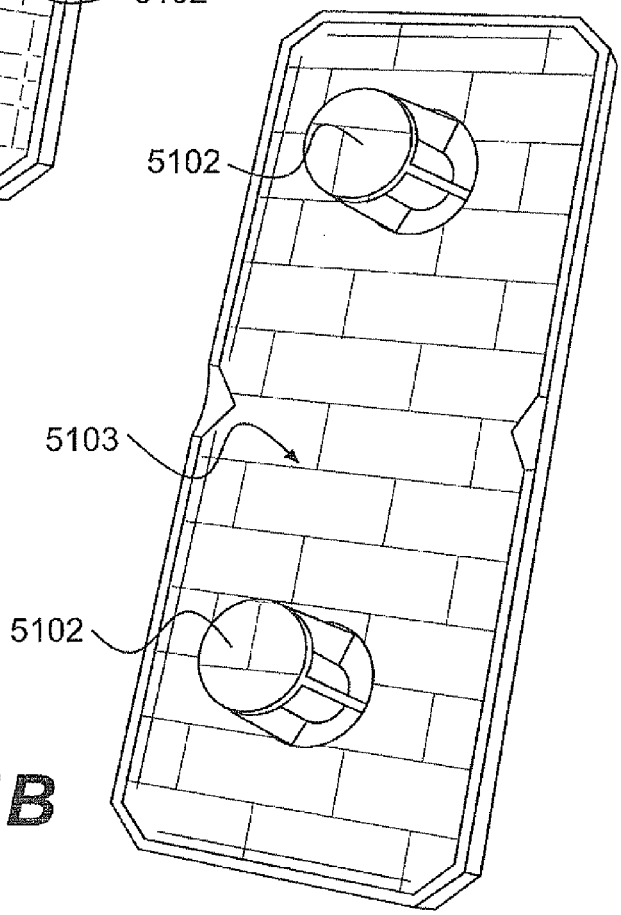

FIGS. 51A-51B are schematic diagrams illustrating a reversible panel 5100, according to an embodiment of the present invention. The panel 5100 has prongs 5102 that can be inserted into holes of construction elements described herein. The panel 5100 may have different surface designs or patterns to be used as decorative elements for the construction systems described herein. A first surface 5101 of the panel 5100 can be provided with, for example, a tile-like pattern while a second surface 5103 can be provided with, for example, a brick-like pattern. The prongs 5102 may be configured to slide in and out of the panel, at least to the degree of protrusion on either side shown in FIG. 51B, so that either side of the panel 5100 can be positioned on an outer side of a construction element or assembly.

Figure 52A:
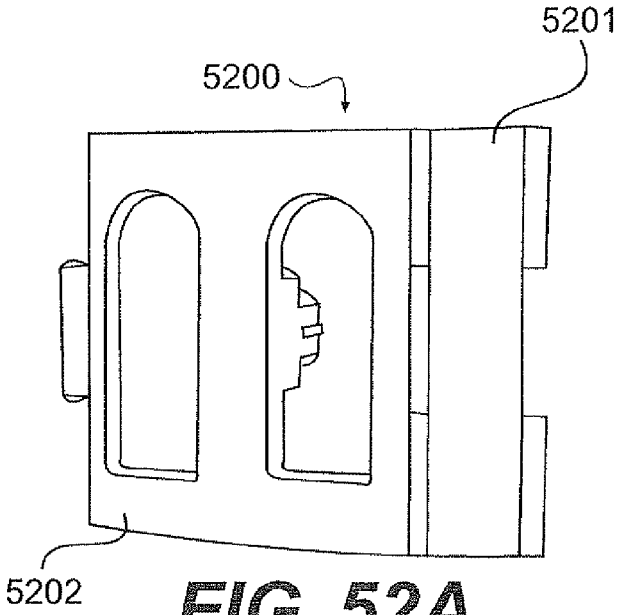
FIGS. 52A-52B are schematic diagrams illustrating a curved architectural panel, according to an embodiment of the present invention.
Figure 52B:
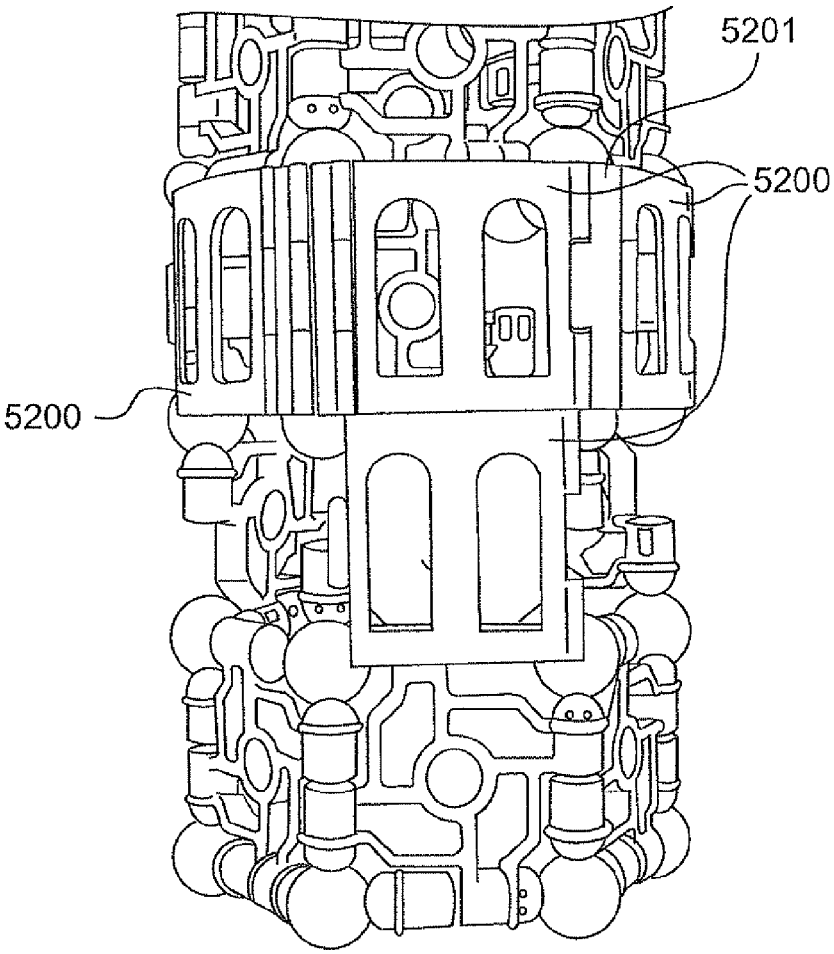

FIGS. 52A-52B are schematic diagrams illustrating a curved architectural panel 5200, according to an embodiment of the present invention. The curved architectural panel 5200 can be inserted into holes of construction elements described herein to provide decorative characteristics to an assembly or to provide for a rounded construction, as shown in FIG. 52B. The panel 5200 includes an attachment piece 5201 that may comprise metal inserts that can be attached to ferromagnetic spheres used in the construction of assemblies as described herein. The panel 5200 may include a curved portion 5202, which may include window cutouts in order to provide a rounded construction of a magnetic assembly. The curved panel 5200 may be attached to the edges of a construction of cubic elements, by means of attachment piece 5201 to provide a rounded structure, which may extend all the way around the cubic or block assembly, as shown in FIG. 52B.

Figure 53A:
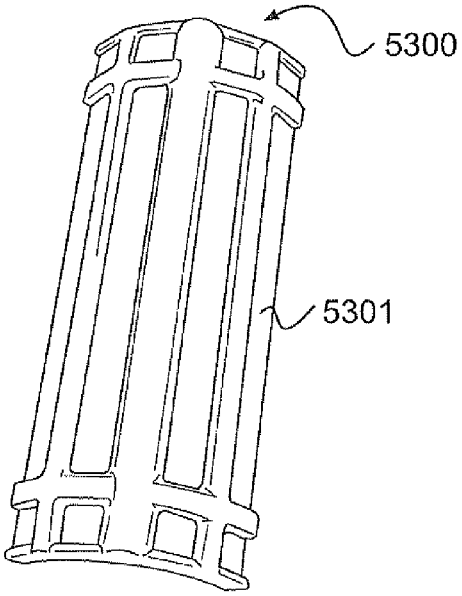
FIGS. 53A-53C are schematic diagrams illustrating a column with a metal insert, according to an embodiment of the present invention.
Figure 53B:
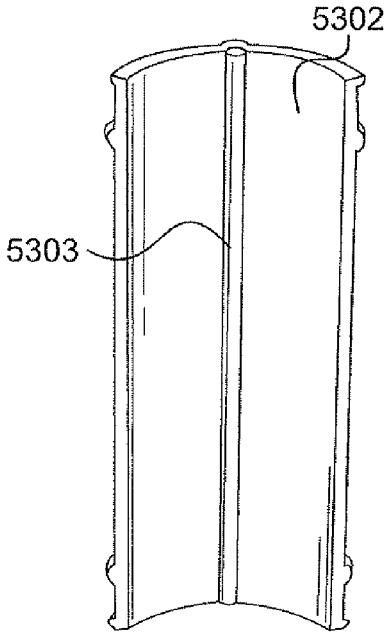
Figure 53C:
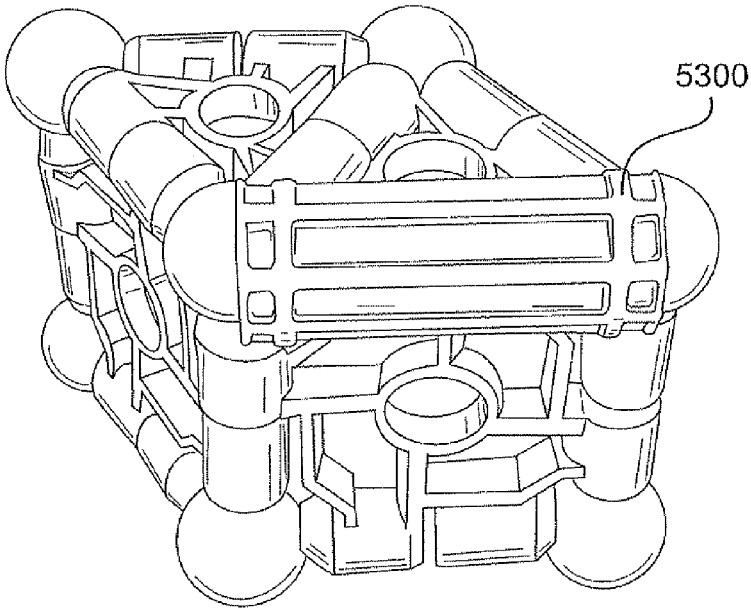

FIGS. 53A-53B are schematic diagrams illustrating a column 5300 with metal insert 5303, according to an embodiment of the present invention. The column 5300 may be attached to construction assemblies as described herein to produce a decorative column aspect to the assembly. The column 5300 includes a patterned outer surface 5301, which may be molded to form an architectural design, and an inner surface 5302. The metal insert 5303 may be permanently attached to the inner surface 5302 of the column 5300, for magnetically connecting to construction elements as described herein, such as ferromagnetic spheres as shown in FIG. 53C.

The foregoing disclosure of the preferred embodiments of the present invention has been presented for purposes of illustration and description. It is not intended to be exhaustive or to limit the invention to the precise forms disclosed. Many variations and modifications of the embodiments described herein will be apparent to one of ordinary skill in the art in light of the above disclosure. The scope of the invention is to be defined only by the claims, and by their equivalents.

Further, in describing representative embodiments of the present invention, the specification may have presented the method and/or process of the present invention as a particular sequence of steps. However, to the extent that the method or process does not rely on the particular order of steps set forth herein, the method or process should not be limited to the particular sequence of steps described. As one of ordinary skill in the art would appreciate, other sequences of steps may be possible. Therefore, the particular order of the steps set forth in the specification should not be construed as limitations on the claims. In addition, the claims directed to the method and/or process of the present invention should not be limited to the performance of their steps in the order written, and one skilled in the art can readily appreciate that the sequences may be varied and still remain within the spirit and scope of the present invention.

What is claimed is:

1. A magnetic construction assembly comprising:

at least two panels, each of the panels having at least two magnet holders located around the perimeter of the panel for embedding and positioning magnets therein;

magnets disposed in each of the magnet holders, each of the magnets having a dipole axis, the magnets being arranged in the magnet holders such that all of the dipole axes of magnets in a single panel are coplanar and intersect to define a polygon comprising an equilateral triangle; and at least two ferromagnetic spheres magnetically connected to magnets in the at least two panels, wherein two ferromagnetic spheres connect two adjacent panels such that a first ferromagnetic sphere attaches to a first magnet disposed on a first panel and a second magnet disposed on a second panel, and a second ferromagnetic sphere attaches to a third magnet disposed on the first panel and a fourth magnet disposed on the second panel, and wherein the dipole axes of the first magnet and the fourth magnet are collinear, and wherein the center of the first ferromagnetic sphere and the center of the second ferromagnetic sphere are collinear with the dipole axes of the first magnet and the fourth magnet.

2. The magnetic construction assembly of claim 1, wherein the magnets are cylindrical.

3. The magnetic construction assembly of claim 1, wherein the at least two panels are made of nonmagnetic material.

4. The magnetic construction assembly of claim 1, wherein only one magnet is provided in a panel for each side of the polygon defined by the intersection of the dipole axes.

5. The magnetic construction assembly of claim 1, wherein the first panel and the second panel each include a center body portion from which three arm portions extend to a respective magnet holder.

6. The magnetic construction assembly of claim 1, wherein the dipole axes of the first magnet and the fourth magnet define a pivot axis about which the first panel and the second panel are configured to rotate.

7. The magnetic construction assembly of claim 1, wherein the dipole axes of the first magnet and the second magnet intersect at an angle equal to the angle formed by adjacent sides of the polygon defined by the dipole axes of a panel that extends in a plane that is parallel to the plane of the intersection of the axes of the first magnet and the second magnet.

8. The magnetic construction assembly of claim 6, wherein the first panel and the second panel rotate with respect to each other a range greater than 180 degrees.

9. The magnetic construction assembly of claim 1, wherein the length of each of the magnet holders is less than half the length of an edge of the defined polygon.

10. The magnetic construction assembly of claim 1, wherein at least one panel comprises a hole in a body portion thereof, the hole being configured to receive rod-shaped construction elements.

11. The magnetic construction assembly of claim 1, wherein the at least two panels comprises four panels, each panel having magnet dipole axes that define a triangle, the panels being connected by four ferromagnetic spheres to form a triangular pyramid, wherein each of the edges of the triangular pyramid comprises a nested connection of adjacent panel edges.

12. A magnetic construction assembly comprising:

at least two panels, each of the panels having at least two magnet holders located around the perimeter of the panel for embedding and positioning magnets therein;

magnets disposed in each of the magnet holders, each of the magnets having a dipole axis, the magnets being arranged in the magnet holders such that all of the dipole axes of magnets in a single panel are coplanar and intersect to define a polygon comprising an equilateral triangle; and at least two ferromagnetic spheres magnetically connected to magnets in the at least two panels, wherein a hinge is formed between two adjacent panels by two ferromagnetic spheres that connect the two adjacent panels such that a first ferromagnetic sphere of the two ferromagnetic spheres attaches to a first magnet disposed on a first panel of the two adjacent panels and a second magnet disposed on a second panel of the two adjacent panels, and a second ferromagnetic sphere of the two ferromagnetic spheres attaches to a third magnet disposed on the first panel and a fourth magnet disposed on the second panel, such that the dipole axes of the first magnet and the fourth magnet are collinear, and wherein the center of the first ferromagnetic sphere and the center of the second ferromagnetic sphere are collinear with the dipole axes of the first magnet and the fourth magnet.

13. The magnetic construction assembly of claim 12, wherein at least one panel comprises a hole in a body portion thereof, the hole being configured to receive rod-shaped construction elements.

14. The magnetic construction element of claim 12, wherein the magnets are cylindrical.

15. The magnetic construction assembly of claim 12, wherein the at least two panels are made of nonmagnetic material.

16. The magnetic construction assembly of claim 12, wherein only one magnet is provided in a panel for each side of the polygon defined by the intersection of the dipole axes.

17. The magnetic construction assembly of claim 12, wherein the first panel and the second panel each include a center body portion from which three arm portions extend to a respective magnet holder.

18. The magnetic construction assembly of claim 12, wherein the first panel and the second panel rotate with respect to each other a range greater than 180 degrees.

19. The magnetic construction assembly of claim 12, wherein the length of each of the magnet holders is less than half the length of an edge of the defined polygon.

20. The magnetic construction assembly of claim 12, wherein the at least two panels comprises four panels, each panel having magnet dipole axes that define a triangle, the panels being connected by four ferromagnetic spheres to form a triangular pyramid, wherein each of the edges of the triangular pyramid comprises a nested connection of adjacent panel edges.

* * * * *